US009917405B2

(12) United States Patent
Ju et al.

(10) Patent No.: US 9,917,405 B2
(45) Date of Patent: Mar. 13, 2018

(54) ELECTRICAL CONNECTOR WITH CENTRAL SHIELD

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD., Keelung (TW)

( * ) Notice: Subject to any disclaimer, the term of this patent is extended or adjusted under 35 U.S.C. 154(b) by 209 days.

(21) Appl. No.: 14/626,709

(22) Filed: Feb. 19, 2015

(65) Prior Publication Data

US 2015/0244111 A1 Aug. 27, 2015

Related U.S. Application Data

(60) Provisional application No. 62/024,728, filed on Jul. 15, 2014, provisional application No. 61/942,830, filed on Feb. 21, 2014.

(51) Int. Cl.
*H01R 24/60* (2011.01)
*H01R 13/6585* (2011.01)
(Continued)

(52) U.S. Cl.
CPC ..... *H01R 13/6585* (2013.01); *H01R 13/6581* (2013.01); *H01R 13/6583* (2013.01);
(Continued)

(58) Field of Classification Search
CPC ..... H01R 23/688
(Continued)

(56) References Cited

U.S. PATENT DOCUMENTS 363,320 A 5/1887 De Benardos et al.
4,188,714 A 2/1980 Jean
(Continued)

FOREIGN PATENT DOCUMENTS

CN 201656023 U 11/2010
CN 102044802 A 5/2011
(Continued)

OTHER PUBLICATIONS

"USB Background" Total Phase. Internet Archive Wayback Machine, May 4, 2014.

*Primary Examiner* — Neil Abrams
(74) *Attorney, Agent, or Firm* — Locke Lord LLP; Tim Tingkang Xia, Esq.

(57) ABSTRACT

An electrical connector, for mating a mating connector having two metal elastic sheets, includes: an insulation body having a base portion and a tongue located at a front end thereof; an upper and lower rows of terminals fixed to the base portion, each terminal having a contact portion exposed from an upper or lower surface of the tongue; a middle shielding sheet, fixed to the base portion and tongue, and located between the two terminal rows; two snap-fit portions disposed at two sides of the middle shielding sheet and exposed from two sides of the tongue, where the two metal elastic sheets buckle the snap-fit portions to prevent disengagement; and an outer metal casing wrapping peripheries of the base portion and tongue. When the mating connector is inserted into the electrical connector after it's assembling, the two snap-fit portions are fixed to the mating connector to ensure stable high-frequency performance.

17 Claims, 54 Drawing Sheets

(51) Int. Cl.

| | |
|---|---|
| ***H01R 13/6581*** | (2011.01) |
| ***H01R 13/6591*** | (2011.01) |
| ***H01R 13/6583*** | (2011.01) |
| ***H01R 13/6594*** | (2011.01) |
| *H01R 107/00* | (2006.01) |
| *H01R 12/72* | (2011.01) |

(52) U.S. Cl.
CPC ..... *H01R 13/6591* (2013.01); *H01R 13/6594* (2013.01); *H01R 24/60* (2013.01); *H01R 12/724* (2013.01); *H01R 2107/00* (2013.01)

(58) Field of Classification Search
USPC ..... 439/607.09, 607.05, 108
See application file for complete search history.

(56) References Cited

U.S. PATENT DOCUMENTS 4,687,267 A 8/1987 Header et al.
4,824,383 A * 4/1989 Lemke ..... H01R 24/60 439/108
5,114,355 A 5/1992 Kimmel et al.
5,151,033 A 9/1992 Kawai et al.
5,240,424 A 8/1993 Honma et al.
6,074,225 A * 6/2000 Wu ..... H01R 23/6873 439/101
6,409,543 B1 6/2002 Astbury, Jr. et al.
6,540,556 B1 4/2003 Fu
7,048,550 B2 5/2006 Hyland et al.
7,416,428 B1 8/2008 Hung et al.
7,510,408 B2 3/2009 Tsurumi
7,563,140 B1 7/2009 Wan et al.
7,670,156 B2 * 3/2010 Chen ..... H01R 13/6485 439/108
7,731,535 B1 * 6/2010 Wan ..... H01R 13/65802 439/541.5
8,109,795 B2 * 2/2012 Lin ..... H01R 13/6461 439/660
8,535,069 B2 * 9/2013 Zhang ..... H01R 13/6471 439/108
8,684,769 B2 4/2014 Kao et al.
8,808,029 B2 * 8/2014 Castillo ..... H01R 13/6585 439/607.05
8,851,927 B2 * 10/2014 Hsu ..... H01R 12/724 439/607.11
8,864,586 B2 * 10/2014 Nguyen ..... G07F 17/32 463/42
8,956,187 B2 * 2/2015 He ..... H01R 13/504 439/607.35
8,961,235 B2 * 2/2015 Little ..... H01R 13/64 439/374
8,968,031 B2 * 3/2015 Simmel ..... H01R 13/659 439/108
8,997,345 B2 4/2015 Liu
9,022,800 B2 5/2015 Yang et al.
9,178,319 B2 * 11/2015 Little ..... H01R 13/6585
9,231,356 B1 * 1/2016 Ju ..... H01R 24/78
9,257,793 B2 * 2/2016 Lo ..... H01R 13/6461
9,276,365 B2 * 3/2016 Yu ..... H01R 13/6594
9,281,626 B2 3/2016 Lin et al.
9,281,642 B1 * 3/2016 Tseng ..... H01R 24/60
9,300,091 B2 * 3/2016 Katayanagi ..... H01R 24/76
9,300,095 B2 * 3/2016 Lin ..... H01R 24/60
9,325,128 B2 * 4/2016 Chen ..... H01R 12/724
9,337,585 B1 * 5/2016 Yang ..... H01R 13/6583
9,379,494 B1 * 6/2016 Hu ..... H01R 13/6594
9,385,481 B2 * 7/2016 Chung ..... H01R 24/60
9,431,772 B2 * 8/2016 Gao ..... H01R 13/6597
9,437,980 B2 * 9/2016 Ueda ..... H01R 12/724
9,444,199 B2 * 9/2016 Leng ..... H01R 13/6596
9,450,337 B2 * 9/2016 Kao ..... H01R 13/6461
9,450,339 B2 9/2016 Gao et al.
9,450,341 B2 * 9/2016 Kao ..... H01R 13/6585
9,461,378 B1 * 10/2016 Chen ..... H01R 12/707
9,461,415 B2 * 10/2016 Guo ..... H01R 13/41
9,466,924 B2 * 10/2016 Lin ..... H01R 13/6585
9,466,930 B2 * 10/2016 Little ..... H01R 24/60
9,490,580 B2 * 11/2016 Lan ..... H01R 13/646
9,496,653 B2 11/2016 Little et al.
9,496,657 B1 * 11/2016 Chang ..... H01R 13/6471
9,502,821 B2 * 11/2016 Little ..... H01R 13/6582
9,502,840 B2 * 11/2016 Kao ..... H01R 13/6581
9,502,841 B2 * 11/2016 Little ..... H01R 4/023
9,515,439 B2 * 12/2016 Ng ..... H01R 24/70
9,520,681 B2 12/2016 Peng et al.
9,525,227 B2 * 12/2016 Little ..... H01R 13/6273
9,525,241 B1 12/2016 Su et al.
9,537,263 B2 * 1/2017 Gao ..... H01R 13/6582
9,537,272 B2 * 1/2017 Chien ..... H01R 24/62
9,548,568 B2 * 1/2017 Miyoshi ..... H01R 13/428
9,553,391 B2 * 1/2017 Ono ..... H01R 12/712
9,553,410 B2 * 1/2017 Zhao ..... H01R 13/6581
9,564,716 B2 * 2/2017 Kao ..... H01R 13/6586
9,577,373 B2 * 2/2017 Kato ..... H01R 13/6275
9,577,387 B2 2/2017 Hu et al.
9,601,876 B2 3/2017 Jiang et al.
9,608,391 B2 * 3/2017 Little ..... H01R 24/60
9,614,310 B2 * 4/2017 Tsai ..... H01R 12/724
9,627,817 B2 * 4/2017 Chang ..... H01R 13/6594
9,640,923 B2 5/2017 Kao et al.
9,647,369 B2 * 5/2017 Tsai ..... H01R 4/02
9,647,377 B1 * 5/2017 Peng ..... H01R 13/504
9,653,831 B2 * 5/2017 Hoyack ..... H01R 12/91
9,653,851 B1 * 5/2017 Yuan ..... H01R 13/6594
9,660,399 B2 * 5/2017 Hsu ..... H01R 24/60
9,673,569 B2 * 6/2017 Zhang ..... H01R 13/6585
9,680,254 B1 * 6/2017 Nishikata ..... H01R 13/627
9,698,536 B2 * 7/2017 Little ..... H01R 13/6583
9,705,267 B2 * 7/2017 Cheng ..... H01R 24/60
9,728,885 B2 * 8/2017 Yokoyama ..... H01R 13/502
9,728,899 B2 * 8/2017 Peng ..... H01R 13/6581
9,735,512 B2 * 8/2017 Hsu ..... H01R 13/6596
9,748,701 B2 * 8/2017 Tsai ..... H01R 13/6585
9,748,712 B2 * 8/2017 Guo ..... H01R 24/60
9,761,973 B2 9/2017 Tsai et al.
9,768,560 B2 * 9/2017 Yao ..... H01R 13/6594
9,780,492 B1 * 10/2017 Wang ..... H01R 13/6471
9,787,027 B2 * 10/2017 Liu ..... H01R 13/642
9,806,464 B1 * 10/2017 Wang ..... H01R 13/6471
2007/0243757 A1 10/2007 Wan et al.
2008/0311418 A1 12/2008 Czerwinski
2009/0139072 A1 6/2009 Buckus et al.
2012/0071032 A1 * 3/2012 Tsai ..... H01R 12/724 439/660
2013/0244473 A1 9/2013 McKee et al.
2013/0273784 A1 10/2013 Little et al.
2014/0073184 A1 3/2014 Zhao et al.
2014/0187086 A1 7/2014 Little et al.
2014/0194005 A1 7/2014 Little et al.
2015/0072557 A1 3/2015 Kamei et al.
2015/0171562 A1 6/2015 Gao et al.
2015/0194770 A1 7/2015 Little et al.
2015/0244111 A1 * 8/2015 Ju ..... H01R 13/6585 439/607.05
2015/0295362 A1 * 10/2015 Tziviskos ..... H01R 13/6581 439/607.01
2015/0333451 A1 11/2015 Kao et al.
2015/0340791 A1 11/2015 Kao et al.
2016/0013591 A1 1/2016 Ueda et al.
2016/0020560 A1 1/2016 Ju et al.
2016/0020569 A1 * 1/2016 Ju ..... H01R 24/78 439/607.01
2016/0020572 A1 1/2016 Ju et al.
2016/0064869 A1 * 3/2016 Yu ..... H01R 24/60 439/607.05
2016/0087378 A1 * 3/2016 Chen ..... H01R 12/724 439/607.34
2016/0149350 A1 5/2016 Kao et al.
2016/0197443 A1 * 7/2016 Zhang ..... H01R 13/6585 439/607.05
2016/0233630 A1 8/2016 Cheng et al.
2016/0352049 A1 12/2016 Long

(56) References Cited

U.S. PATENT DOCUMENTS

| | | | | |
|---|---|---|---|---|
| 2016/0380389 | A1 | 12/2016 | Ju et al. | |
| 2017/0033519 | A1 | 2/2017 | Little et al. | |
| 2017/0373440 | A1* | 12/2017 | Zhao | H01R 13/6581 |

FOREIGN PATENT DOCUMENTS

| | | | |
|---|---|---|---|
| CN | 201829743 | U | 5/2011 |
| CN | 202395222 | U | 8/2012 |
| CN | 202513384 | U | 10/2012 |
| CN | M440566 | U | 11/2012 |
| CN | 203423303 | U | 2/2014 |
| CN | 203445352 | U | 2/2014 |
| CN | 103972732 | A | 8/2014 |
| CN | 104037550 | A | 9/2014 |
| CN | 203859322 | U | 10/2014 |
| CN | 203859329 | U | 10/2014 |
| CN | 204030143 | U | 12/2014 |
| TW | 201532347 | A | 8/2015 |
| TW | 201545423 | A | 12/2015 |

* cited by examiner

100

ELECTRICAL CONNECTOR WITH CENTRAL SHIELD

CROSS-REFERENCE TO RELATED APPLICATION

This application claims priority to and the benefit of, pursuant to 35 U.S.C. § 119(e), U.S. provisional patent application Ser. No. 61/942,830, filed Feb. 21, 2014, entitled "ELECTRICAL CONNECTOR," by Chin Chi Lin, and U.S. provisional patent application Ser. No. 62/024,728, filed Jul. 15, 2014, entitled "ELECTRICAL CONNECTOR," by Ted Ju. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector and an electrical connector assembly, and more particularly to an electrical connector with high-frequency performance and an electrical connector assembly.

BACKGROUND OF THE INVENTION

With fast development of electronic elements, design specifications of the USB organization are also always being updated and upgraded. From USB2.0 at beginning to USB3.0 and USB3.1 at present, or even the USB TYPE C specification, the transmission speed is faster and faster. To satisfy higher high-frequency requirements, applicant has spent a large quantity of efforts and capitals in cooperatively developing those types of products, so that mass production can be implemented, and efficiency can be improved.

Therefore, it is necessary to design an improved electrical connector and an electrical connector assembly, so as to overcome the foregoing problem.

SUMMARY OF THE INVENTION

In view of the above problems in the related art, the present invention is directed to an electrical connector in firm snap-fit to ensure stable high-frequency performance and an electrical connector assembly thereof.

To achieve the foregoing objective, the present invention uses the following technical means:

An electrical connector is used for mating with a mating connector. The mating connector has at least two metal elastic sheets. The electrical connector includes: an insulation body, where the insulation body has a base portion and a tongue located at a front end of the base portion; multiple terminals fixedly disposed in the base portion in a manner of an upper row and a lower row, where each of the terminals has a contact portion exposed from either an upper surface or a lower surface of the tongue, and the mating connector and the contact portion are contacted; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue, where two of the metal elastic sheets buckle the snap-fit portions to stop the metal elastic sheet from being disengaged; and an outer metal casing, where the outer metal casing wraps peripheries of the base portion and the tongue.

In one embodiment, the electrical connector further has an inner metal casing. The inner metal casing has at least one covering portion disposed on an upper surface of the tongue, and at least one extending portion extending from the covering portion toward the base portion. The extending portion has at least one contact arm, and the contact arm urges an inner wall of the outer metal casing. The extending portion is provided with two positioning portions, the base portion is provided with two positioning slots corresponding to the two positioning portions, and the two positioning slots accommodate and fix the two positioning portions.

In one embodiment, the upper row of multiple terminals are separately two grounding terminals, two power supply terminals and two signal terminals, the lower row of multiple terminals are separately two grounding terminals, two power supply terminals and two signal terminals, and the upper row of multiple terminals and the lower row of multiple terminals are disposed symmetrically on the upper surface and the lower surface of the tongue.

In one embodiment, the middle shielding sheet has a plate portion fixedly disposed in the tongue. Two protruding portions extend separately from two sides of the plate portion out of the two sides of the tongue, two of the snap-fit portions are grooves disposed at the two protruding portions, and the two grooves are located out of the two sides of the tongue.

In one embodiment, the outer metal casing has a wrapping casing and a shielding casing. The wrapping casing wraps the peripheries of the base portion and the tongue. The shielding casing is disposed out of the wrapping casing. Each of two sides of the wrapping casing has a first soldering pin. Each of two sides of the shielding casing has a second soldering pin. The first soldering pin and the second soldering pin are staggered front and back. The first soldering pin is close to a lateral side of the base portion, and the second soldering pin is close to a lateral side of the tongue.

In one embodiment, the wrapping casing has a first rear wall, and the shielding casing has a second rear wall. The first rear wall has a first middle portion and first sheltering portions located at two sides of the first middle portion. The second rear wall has a second middle portion and a second sheltering portion connected to a lower part of the second middle portion. The first middle portion and the second middle portion are approximately superposed front and back, the second rear wall forms a notch at a place corresponding to the first sheltering portion, and the second sheltering portion exceeds the first middle portion downward.

Another technology means is as follows:

An electrical connector assembly includes an electrical connector and a mating connector. The electrical connector includes: an insulation body, where the insulation body has a base portion and a tongue located at a front end of the base portion, multiple terminals are fixedly disposed in the base portion in a manner of an upper row and a lower row, and each of the terminals has a contact portion exposed from either of an upper surface and a lower surface of the tongue; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue; and an outer metal casing, where the outer metal casing wraps peripheries of the base portion and the tongue, and two of the metal elastic sheets buckle the snap-fit portions to stop the metal elastic sheet from being disengaged. The mating connector has two metal elastic sheets corresponding to two of the snap-fit portions. When the mating connector and the electrical connector are mated, the two metal elastic sheets are respectively cooperatively fixed to two of the snap-fit portions, and the mating connector and the contact portion are contacted.

In one embodiment, the mating connector has an insertion portion, the insertion portion has a mating space, each of two sides of the insertion portion has a hollowing portion in communication with the mating space, the two metal elastic sheets are at least partially located at the two sides of the insertion portion, and pass through the hollowing portion to enter the mating space, and the tongue and the snap-fit portions are located in the mating space.

In one embodiment, the mating connector has a metal cover. The metal cover is formed by means of one-piece drawing or stretching. The metal cover has a front segment and a rear segment connected to each other. The front segment has a top surface and a bottom surface provided opposite to each other, and two side surfaces connected to the top surface and the bottom surface. A place at where the top surface or the bottom surface is connected to the rear segment is provided with a step. The two side surfaces and the rear segment are in a form of direct extension.

Compared with the related art, the present invention has the following beneficial effects:

When the mating connector is inserted into the electrical connector after the electrical connector is completely assembled, two of the snap-fit portions are disposed at two sides of the tongue and cooperatively fixed to the mating connector, thereby being in firm snap-fit to ensure stable high-frequency performance.

Figure 1:
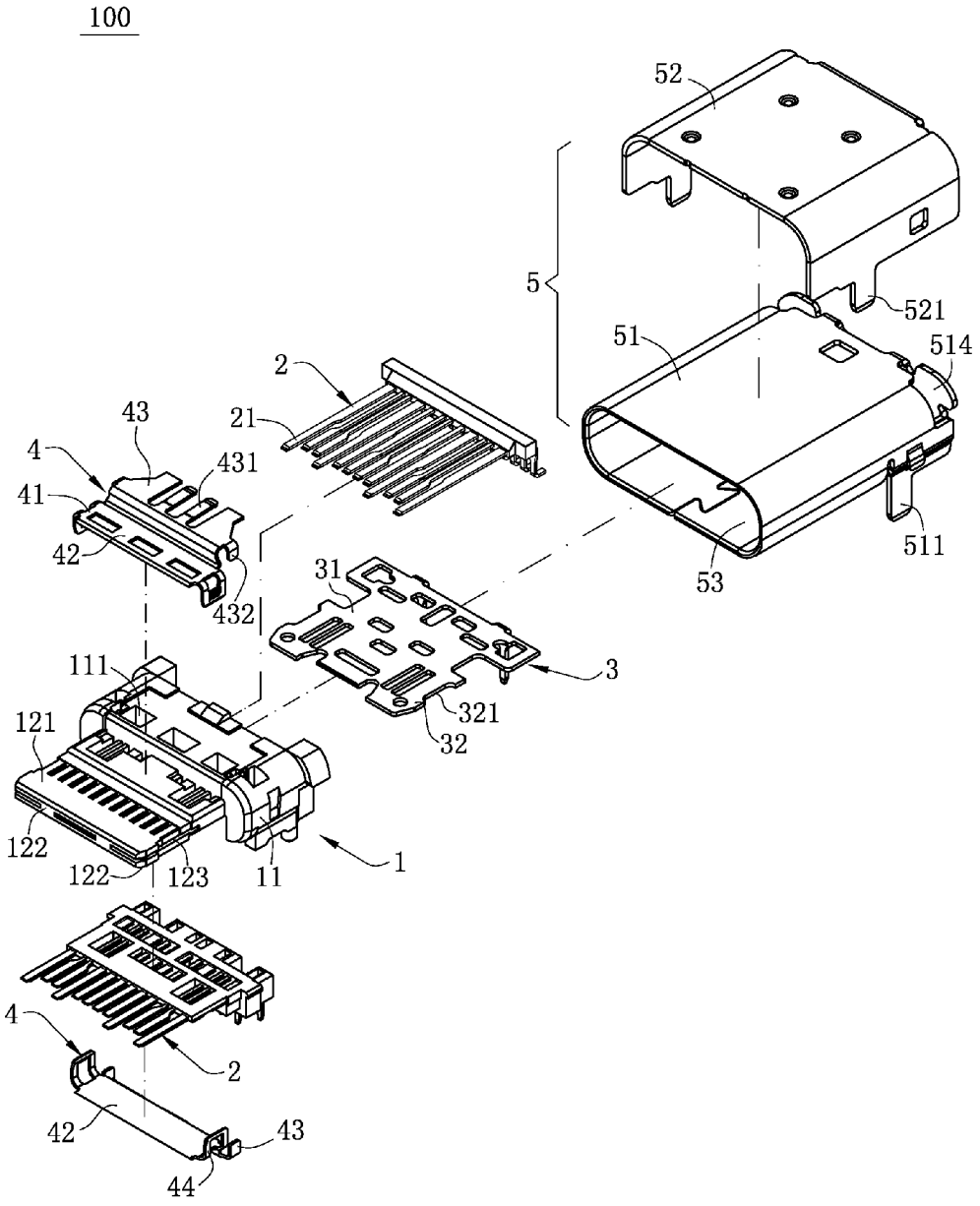
FIG. 1 is a three-dimensional exploded view of an electrical connector according to one embodiment of the present invention.

Numerals shown in the figures according to certain embodiments of the invention:

| | | | |
|---|---|---|---|
| electrical connector 100 | insulation body 1 | base portion 11 | positioning slot 111 |
| tongue 12 | upper surface 121 | lower surface 122 | snap-fit slot 123 |
| terminal 2 | contact portion 21 | middle shielding sheet 3 | plate portion 31 |
| protruding portion 32 | groove 321 | inner metal casing 4 | upper shielding sheet 41 |
| covering portion 42 | extending portion 43 | contact arm 431 | positioning portion 432 |
| lower shielding sheet 44 | outer metal casing 5 | wrapping casing 51 | first soldering pin 511 |
| first rear wall 512 | first middle portion 513 | first sheltering portion 514 | shielding casing 52 |
| second soldering pin 521 | second rear wall 522 | second middle portion 523 | second sheltering portion 524 |
| notch 525 | inserting space 53 | | |
| mating connector 200 | main body 6 | insertion portion 7 | top 71 |
| bottom 72 | mating space 73 | hollow portion 74 | metal elastic sheet 8 |
| upper grounding sheet 81 | lower grounding sheet 82 | middle grounding sheet 83 | metal cover 9 |
| front segment 91 | top surface 91 | bottom surface 92 | side surface 913 |
| rear segment 92 | step 93 | | |

DETAILED DESCRIPTION OF THE INVENTION

For convenience of better understanding objectives, structures, features and efficacies of the present invention, the present invention is further described with reference to accompanying drawings and specific implementation manners.

As shown in FIG. 1, FIG. 16, FIG. 7, and FIG. 12, an electrical connector 100 of the present invention is an electrical connector socket supporting high-speed data transmission, and a mating connector 200 is an electrical connection plug supporting high-speed data transmission.

Figure 16:
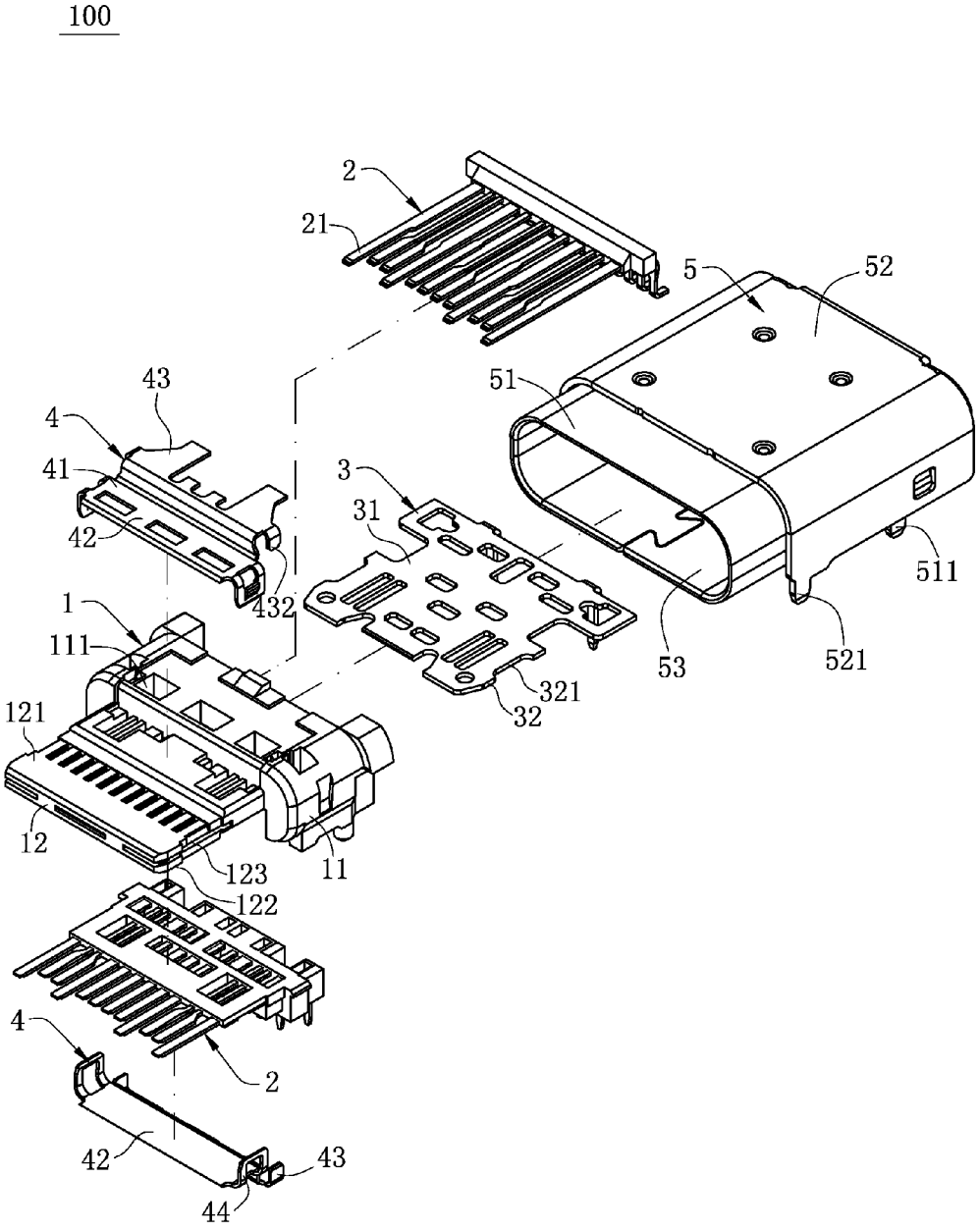
FIG. 16 is a three-dimensional exploded view of an electrical connector according to a third embodiment of the present invention.
Figure 17:
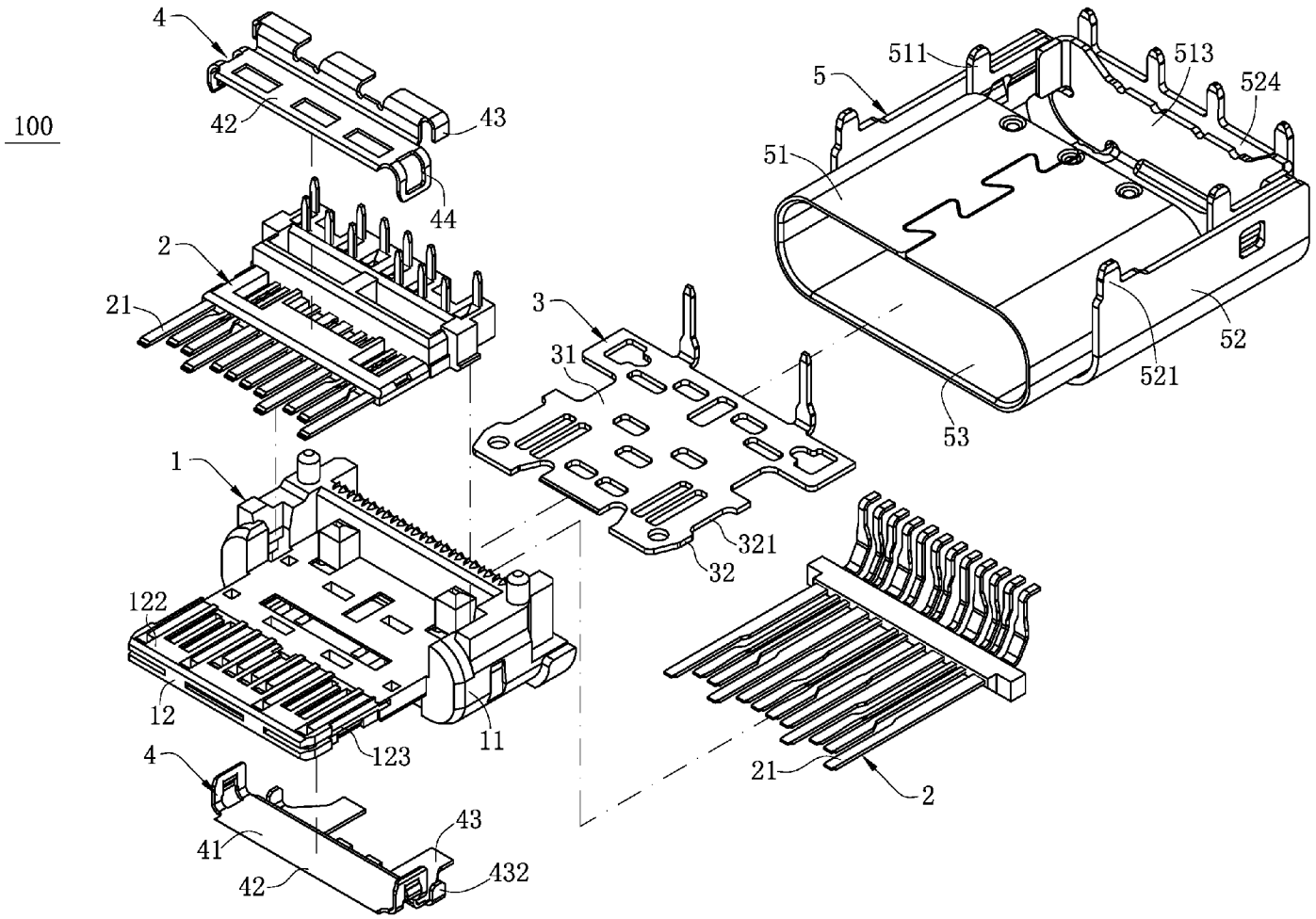
FIG. 17 is a three-dimensional exploded view of the electrical connector viewed from another viewing angle according to the third embodiment of the present invention.

As shown in FIG. 1 and FIG. 16, the electrical connector 100 includes an insulation body 1; multiple terminals 2 fixedly disposed at the insulation body 1; a middle shielding sheet 3 fixedly disposed at the insulation body 1; an inner metal casing 4, covering and fixed onto the insulation body 1; and an outer metal casing 5, framing the insulation body 1 and the inner metal casing 4 to form an insertion space 53.

As shown in FIG. 7 to FIG. 11, the mating connector 200 has a main body 6 and an insertion portion 7 formed by extending forward from the main body 6. The insertion portion 7 has a mating space 73. Each of two sides of the insertion portion 7 has a hollowing portion 74 in communication with the mating space 73. Two metal elastic sheets 8 are fixed to two sides of the main body 6, and partially extend forward and are located at the two sides of the insertion portion 7. The two metal elastic sheets 8 pass through the hollowing portion 74 to enter the mating space 73, and are conveniently for stable snap-fitting with the electrical connector 100. An upper grounding sheet 81 and a lower grounding sheet 82 are respectively disposed at a top 71 and a bottom 72 of the insertion portion 7. The upper grounding sheet 81 and the lower grounding sheet 82 at least partially pass through the insertion portion 7 to enter the mating space 73, so as to be cooperatively fixed to the electrical connector 100, and a grounding objective may further be achieved. A middle grounding sheet 83 is located in the main body 6 and the insertion portion 7.

As shown in FIG. 12 to FIG. 15, the mating connector 200 further has a metal cover 9 surrounding the main body 6 and the insertion portion 7. The metal cover 9 is formed by means of one-piece drawing or stretching. The metal cover 9 has a front segment 91 and a rear segment 92 connected to each other. The front segment 91 has a top surface 911 and a bottom surface 912 disposed opposite to each other, and two side surfaces 913 connected to the top surface 911 and the bottom surface 912. A place at which the top surface 911 or the bottom surface 912 is connected to the rear segment 92 is provided with a step 93. The two side surfaces 913 and the rear segment 92 are in a form of direct extension, that is, the top surface 911 and the bottom surface 912 of the front segment 91 are backward reamed, so that the place at which the top surface 911 or the bottom surface 912 is connected to the rear segment 92 is provided with the step 93, while the two side surfaces 913 of the front segment 91 are not backward reamed, and therefore a place at which each of the two side surfaces 913 is connected to the rear segment 92 is not provided with any step 93, so as to facilitate molding and save the space in the width direction. The upper grounding sheet 81, the lower grounding sheet 82 and the middle grounding sheet 83 all contact the metal cover 9, grounding paths become more, and the grounding effect is stable.

Figure 2:
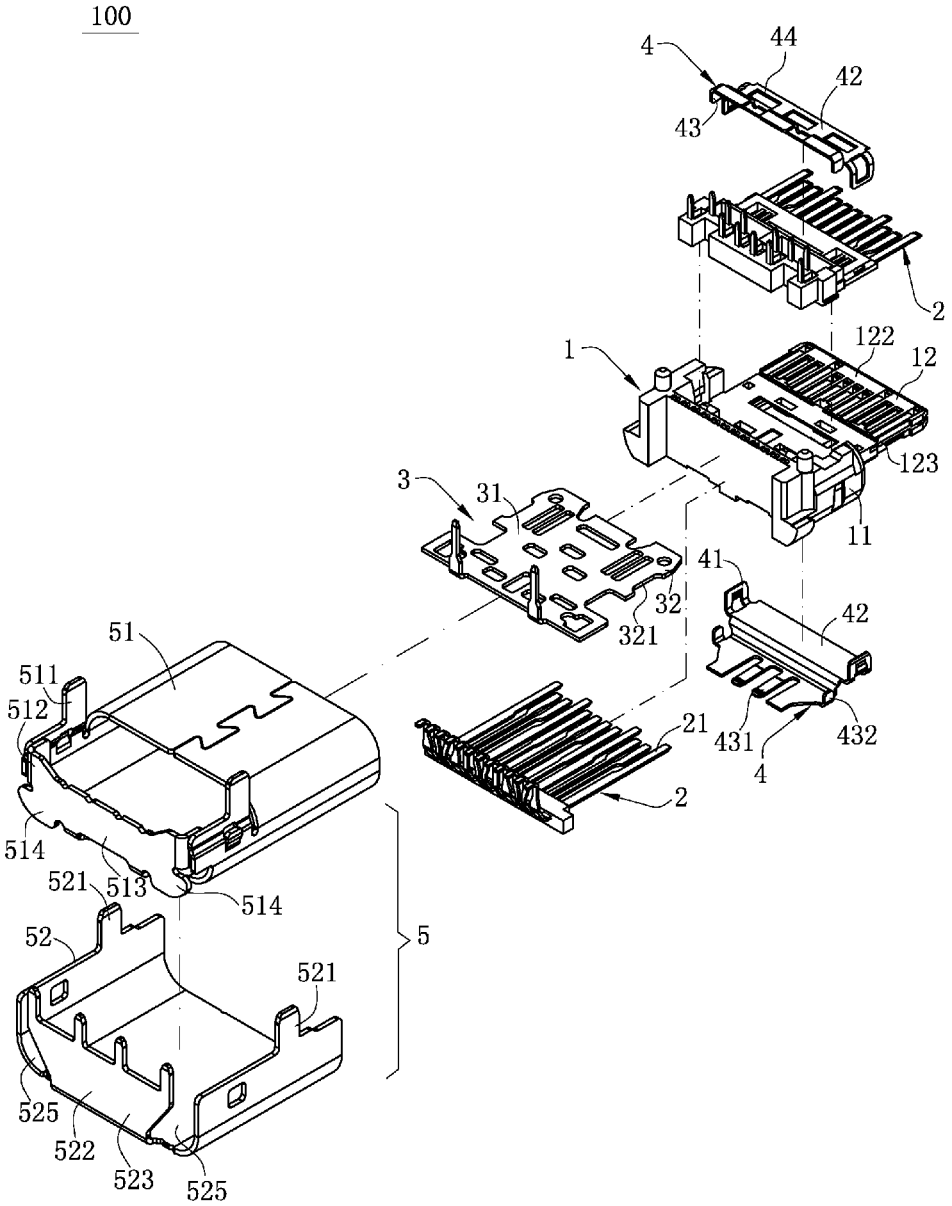
FIG. 2 is a three-dimensional exploded view of the electrical connector viewed from another viewing angle according to one embodiment of the present invention.
Figure 3:
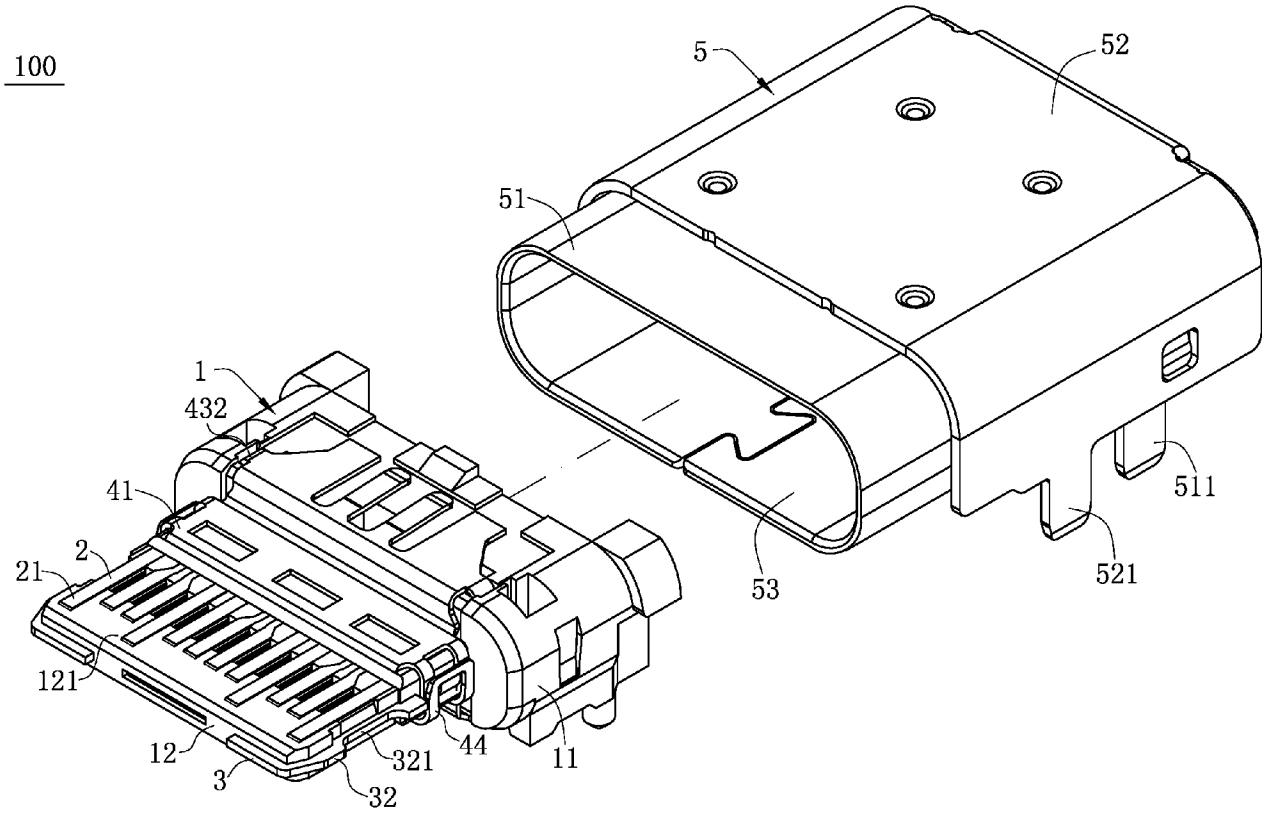
FIG. 3 is a partial three-dimensional exploded view of the electrical connector according to one embodiment of the present invention.
Figure 4:
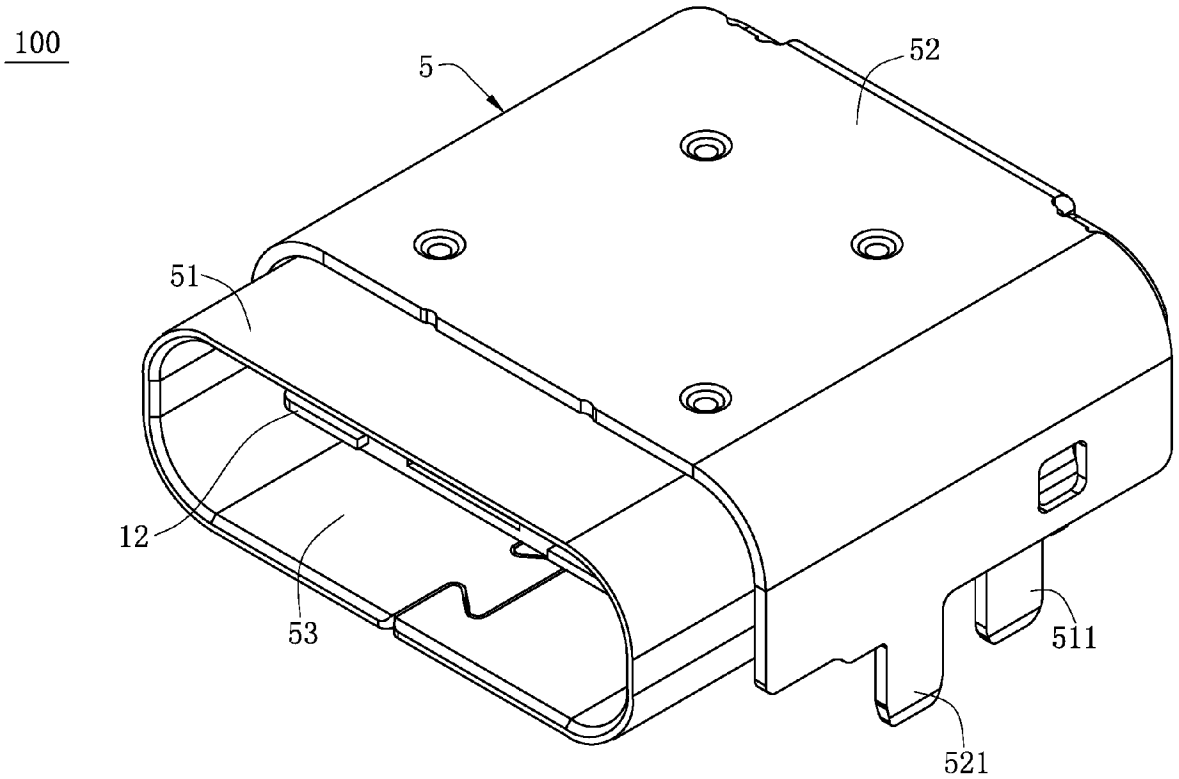
FIG. 4 is a three-dimensional assembly drawing of the electrical connector according to one embodiment of the present invention.

As shown in FIG. 1 to FIG. 3, the insulation body 1 has a base portion 11 and a tongue 12 located at a front end of the base portion 11. The base portion 11 is provided with two positioning slots 111. The tongue 12 has an upper surface 121 and a lower surface 122 disposed opposite to each other. Each of two sides of the tongue 12 is provided with a snap-fit slot 123, and the two snap-fit slots 123 are formed into two snap-fit portions (not labeled). When the mating connector 200 and the electrical connector 100 are mated, the two metal elastic sheets 8 are respectively cooperatively fixed to the two snap-fit portions, and the tongue 12 and the snap-fit slots 123 are all located in the mating space 73.

As shown in FIG. 1 to FIG. 3, the multiple terminals 2 are fixedly disposed in the base portion 11 in a manner of an upper row and a lower row. Each of the terminals has a contact portion 21 exposed from an upper surface 121 or a lower surface 122 of the tongue 12, so that the mating connector 200 and the contact portions 21 are contacted. The multiple terminals 2 include multiple pairs of high-speed terminals (not labeled), two power supply terminals (not labeled), two grounding terminals (not labeled), two reserved terminals (not labeled) and the like. In other embodiments (not shown), the upper row of multiple terminals 2 are separately two grounding terminals, two power supply terminals, two signal terminals and two reserved terminals, the lower row of multiple terminals 2 are separately two grounding terminals, two power supply terminals, two signal terminals and two reserved terminals, the upper row of multiple terminals 2 and the lower row of multiple terminals 2 are disposed symmetrically on the upper surface 121 and the lower surface 122 of the tongue 12, where the signal terminals are non-high-speed terminals. Certainly, in some embodiments, the reserved terminals (not shown) may further be removed. That is, the terminal type may be adjusted when necessary, and the functionality is enhanced. The high-speed terminals of the multiple terminals 2 are differential signal terminals. Parts of the differential signal terminals, located in the base portion 11 and the tongue 12 are close to each other, and the differential signal terminals are away from the grounding terminals at an adjacent side.

The number of the multiple terminals 2 may reach to 24. The upper row of terminals 2 are 12 in number, and are separately a grounding terminal, a pair of high-speed terminals, a power supply terminal, a reserved terminal, two usb2.0 terminals, a reserved terminal, a power supply terminal, a pair of high-speed terminals and a grounding terminal. Correspondingly, the lower row of terminals 2 are 12 in number, and are distributed corresponding to the upper row of terminals 2, so that the mating connector 200 may be inserted into the electrical connector 100 in dual orientation.

The terminals 2 are large in number, and the electrical connector 100 is very small in volume, and therefore the multiple terminals 2 are arranged very densely in the insulation body 1. In this way, the assembly difficulty increases, and the electrical connector 100 is in the USB C TYPE, which has very high requirements on volume and high-frequency, and therefore the terminals 2 in the electrical connector 100 cannot be mounted to the insulation body 1 in an assembly manner. Therefore, the insulation body 1 has three parts independent from each other. The upper row of terminals 2 are integrally formed in a first part of the insulation body 1 by means of injection molding, the lower row of terminals 2 are integrally formed in a second part of the insulation body 1 by means of injection molding, and then the two are mounted in a third part of the insulation body 1. Certainly, in other embodiments, it may also be that, the insulation body 1 has two parts independent from each other, the upper row of terminals 2 are integrally formed in a first part of the insulation body 1 by means of injection molding, the lower row of terminals 2 are integrally formed in a second part of the insulation body 1 by means of injection molding, then the two are mounted and fixed together, and a third part does not need to be used. Alternatively, when requirements on high-frequency and functions of the electrical connector 100 are low, the terminals 2 are correspondingly reduced in number, and it may be appropriately considered that some of the terminals 2 are mounted, and other terminals are integrally formed by means of injection molding.

Multiple locations of the insulation body 1, corresponding to the terminals 2, are each provided with an adjustment hole (not labeled). The adjustment hole enables the terminals 2 to be exposed out of the insulation body 1, and is used for adjusting impedance of the terminals 2, so that the electrical connector 100 may meet the high-frequency requirements in the industry.

As shown in FIG. 1, the middle shielding sheet 3 is fixedly disposed at the base portion 11 and the tongue 12, and the middle shielding sheet 3 is located between the upper row of terminals 2 and the lower row of terminals 2, so as to ensure the shielding effect, and ensure high-frequency performance. The middle shielding sheet 3 has a plate portion 31 fixedly disposed in the tongue 12. Two protruding portions 32 separately extend out of the two sides of the tongue 12 from two sides of the plate portion 31. The two snap-fit portions are grooves 321 disposed at the two protruding portions 32. The two grooves 321 are located out of the two sides of the tongue 12, and locations of the grooves 321 are corresponding to locations of the snap-fit slots 123. When the mating connector 200 is inserted into the electrical connector 100 (not shown), the insertion portion 7 enters the insertion space 53, and the metal elastic sheet 8 are snap-fit in the snap-fit slots 123 and the grooves 321. Certainly, in other embodiments, the tongue 12 is not provided with the snap-fit slots 123, and only the protruding portions 32 are provided with the grooves 321 cooperatively fixed to the metal elastic sheet 8, or, only the tongue 12 is provided with the snap-fit slots 123 cooperatively fixed to the metal elastic sheets 8.

Two sides of the middle shielding sheet 3 separately extend out of the tongue 12 laterally, the front end of the middle shielding sheet 3 extends forward out of the front end of the tongue 12, and when the mating connector 200 and the electrical connector 100 are butted, the front end of the tongue 12 may be prevented from abrasion. A baffle plate (not labeled) extends from the back end of the middle shielding sheet 3, and the baffle plate is located between a welding portion (not labeled) of the upper row of terminals 2 and a welding portion (not labeled) of the lower row of terminals 2, and used for shielding signal interference between the two rows of terminals 2.

As shown in FIG. 1, the inner metal casing 4 is formed by buckling an upper shielding sheet 41 and a lower shielding sheet 44 to each other, and is assembled simply and easily. Each of the upper shielding sheet 41 and the lower shielding sheet 44 has a covering portion 42 disposed respectively on the upper surface 121 or the lower surface 122 of the tongue 12, an extending portion 43 extends backward from each of the covering portions 42. The extending portions 43 are stuck to and are covering the base portion 11. The extending portion 43 close to the upper surface 121 has two contact arms 431, and the contact arms 431 urge an inner wall of the outer metal casing 5, so as to increase shielding performance and be grounded. Certainly, in other embodiments, the extending portion 43 may extend backward only from the covering portion 42 stuck and covering to the upper surface 121, and the extending portion 43 has one or more contact arms 431, as long as the one or more contact arms 431 can contact the inner wall of the outer metal casing 5. Additionally, the extending portion 43 is provided with two positioning portions 432, and the two positioning slots 111 accommodate and fix the two positioning portions 432. The upper shielding sheet 41 and the lower shielding sheet 44 are in a frame shape and integrally formed, and the covering portion 42 of each of the upper shielding sheet 41 and the lower shielding sheet 44 is provided with at least one blind hole (not labeled), which helps the mating connector 200 snap-fit and fix with the blind hole. Certainly, the blind hole may also run through in the direction of the tongue 12 to form a through-hole (not labeled), or even, a through-hole corresponding to the upper surface 121 and the lower surface 122 of the tongue 12 is also further depressed, which further helps the mating connector 200 snap-fit and fix with the blind hole, which is not easily disengaged.

Figure 18:
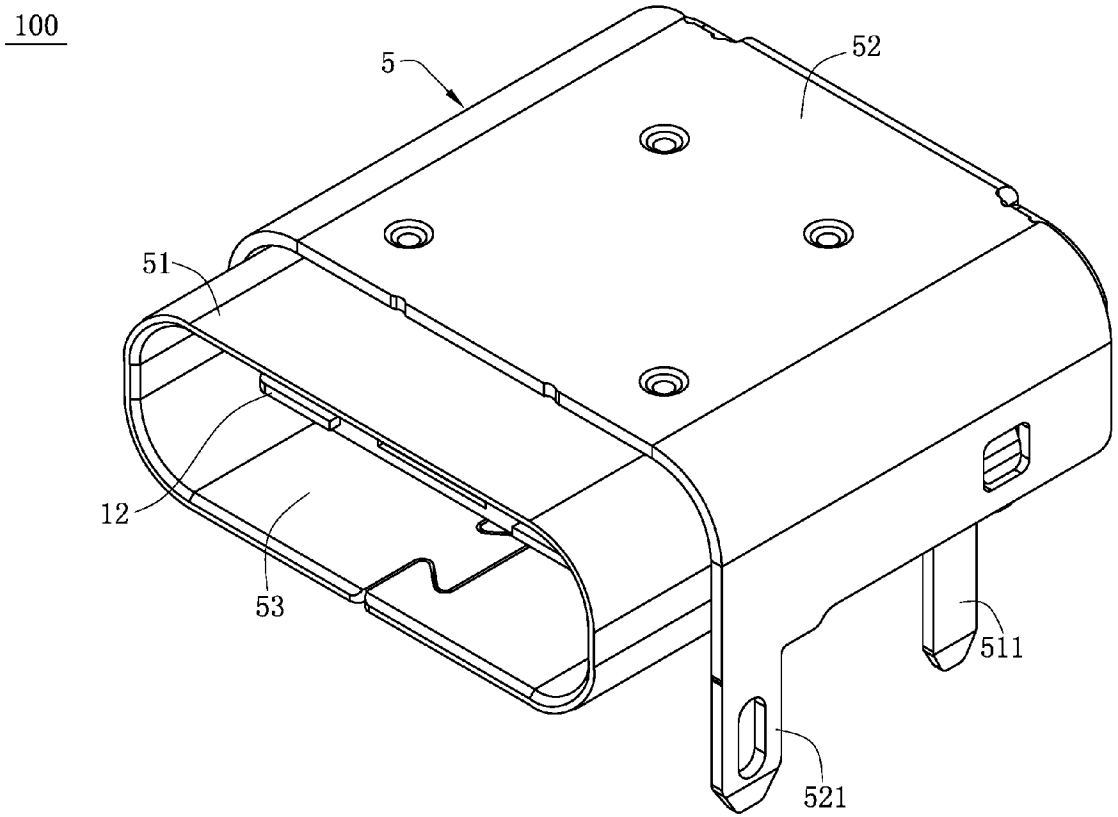
FIG. 18 is a three-dimensional assembly view of an electrical connector according to a fourth embodiment of the present invention.
Figure 19:
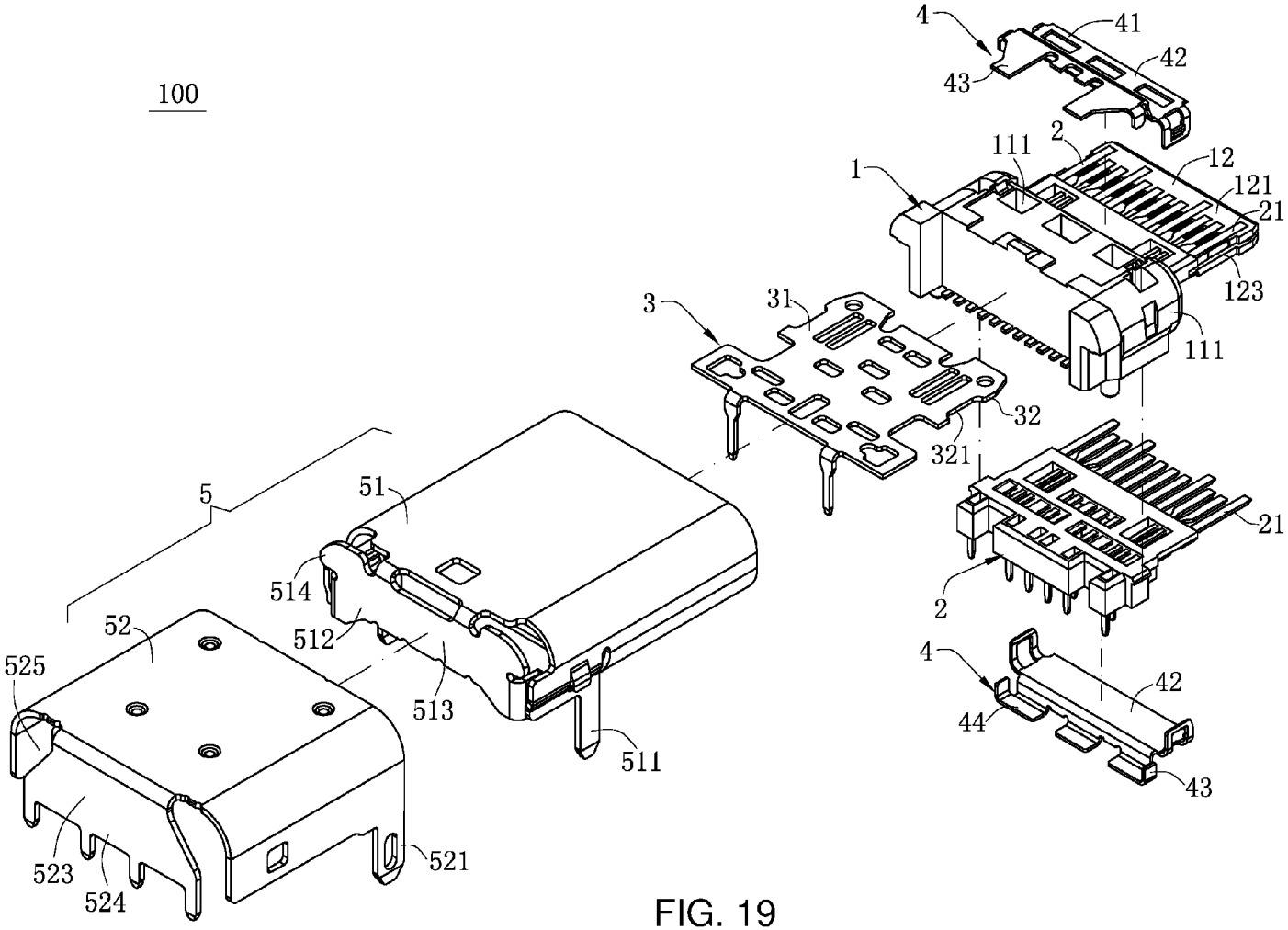
FIG. 19 is a three-dimensional exploded view of the electrical connector according to the fourth embodiment of the present invention.
Figure 20:
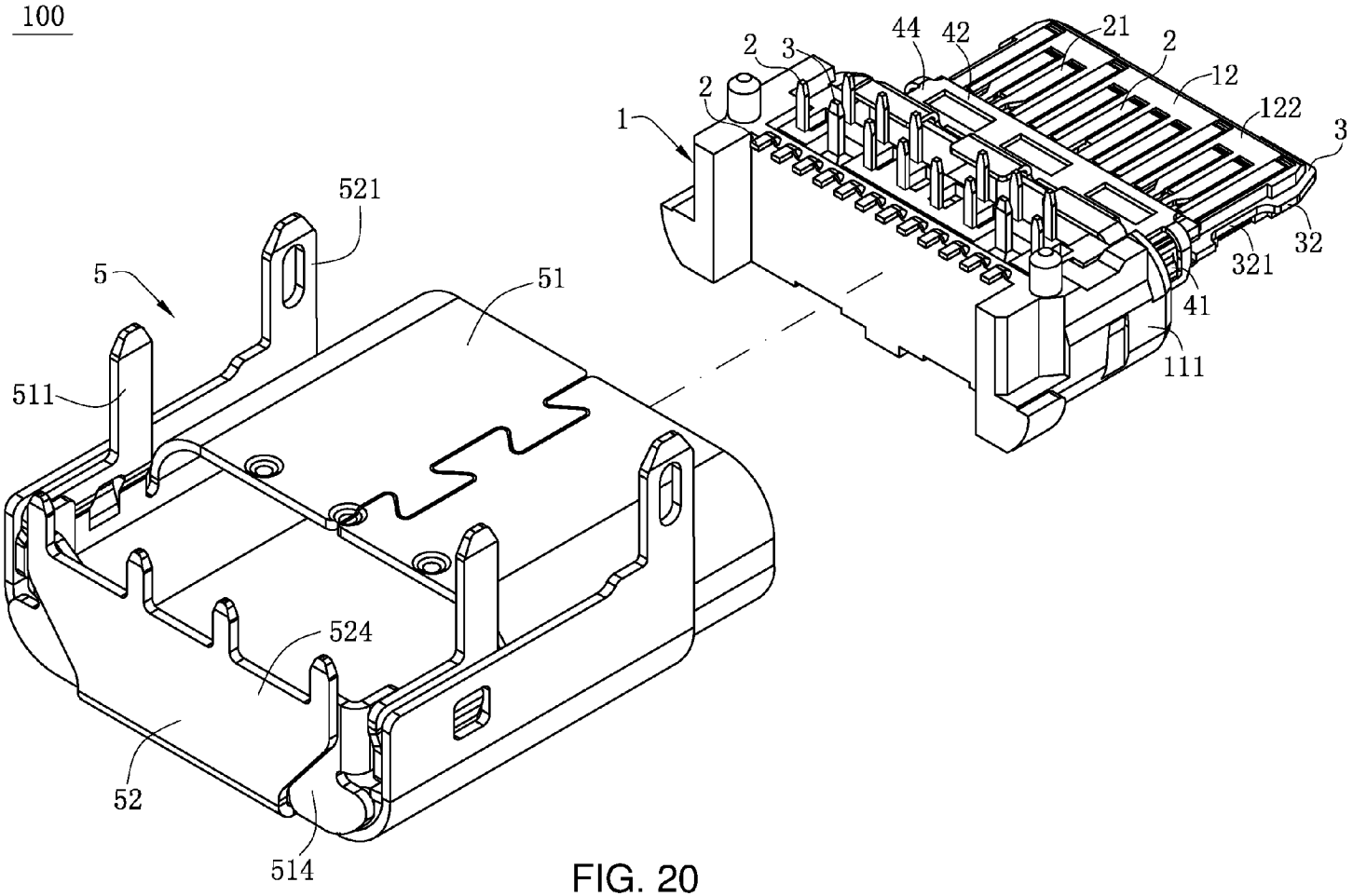
FIG. 20 is a partial three-dimensional exploded view of the electrical connector according to the fourth embodiment of the present invention.

As shown in FIG. 1 to FIG. 5, the outer metal casing 5 wraps peripheries of the base portion 11 and the tongue 12. The outer metal casing 5 has a wrapping casing 51 and a shielding casing 52. The wrapping casing 51 wraps the peripheries of the base portion 11 and the tongue 12, and the shielding casing 52 is disposed out of the wrapping casing 51. The double protection can reduce signal loss as much as possible. Each of two sides of the wrapping casing 51 has a first soldering pin 511, each of two sides of the shielding casing 52 has a second soldering pin 521. The first soldering pin 511 and the second soldering pin 521 are staggered front and back. The first soldering pin 511 is close to the lateral side of the base portion 11, and the second soldering pin 521 is close to the lateral side of the tongue 12, and therefore the electrical connector 100 is stably mounted on a circuit board 300, and not easily disengaged. Certainly, in other embodiments, it may also be that, the first soldering pins 511 and the second soldering pins 521 are all located at the front end, or are all located at the back end, the multiple terminals 2 in the electrical connector 100 are welded on the circuit board 300 at welding locations (not labeled), and from a side viewing angle, the front and back arrangement relationship among the first soldering pins 511, the second soldering pins 521 and the welding locations may be appropriately adjusted and changed, as long as the electrical connector 100 is well and stably mounted on the circuit board 300. As shown in FIG. 18, a through-hole (not labeled) runs through each of the second soldering pin 521, and when the second soldering pins 521 are welded onto the circuit board 300, the contact area of coated solder paste and the second soldering pins 521 are increased, so as to ensure that the second soldering pins 521 and the circuit board 300 are stably positioned.

Figure 5:
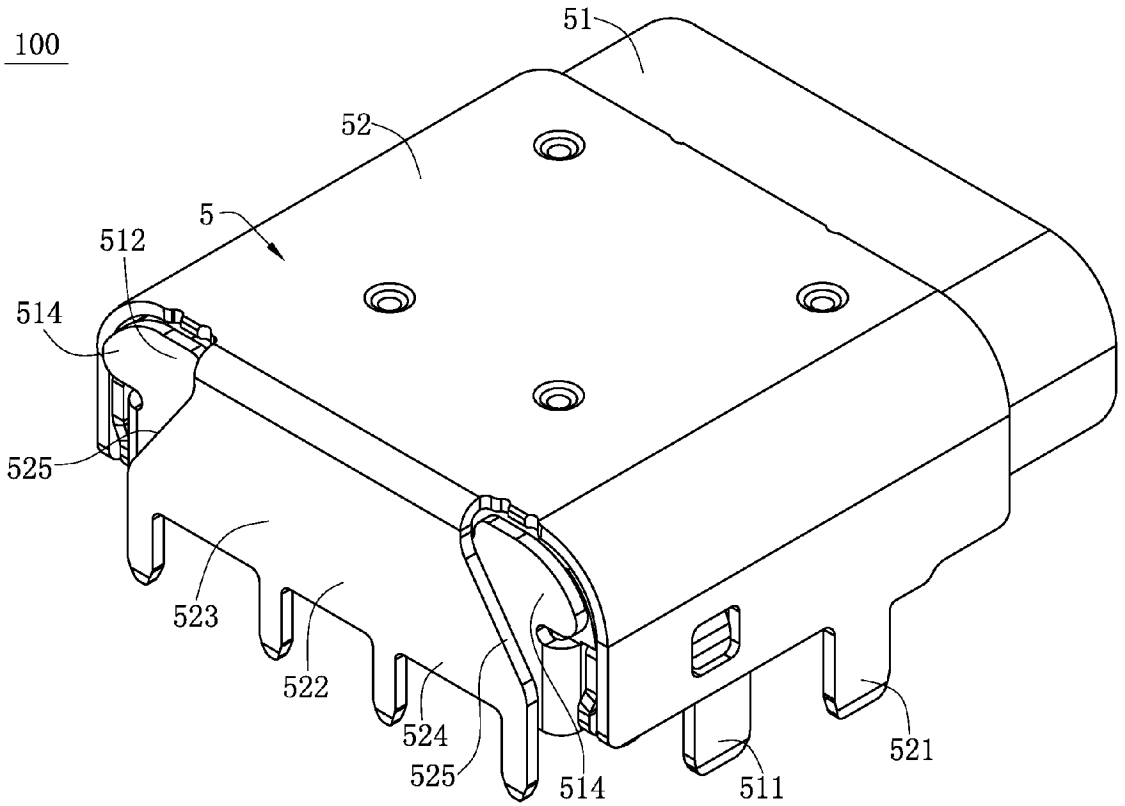
FIG. 5 is a three-dimensional exploded view of the electrical connector viewed from another viewing angle according to one embodiment of the present invention.
Figure 6:
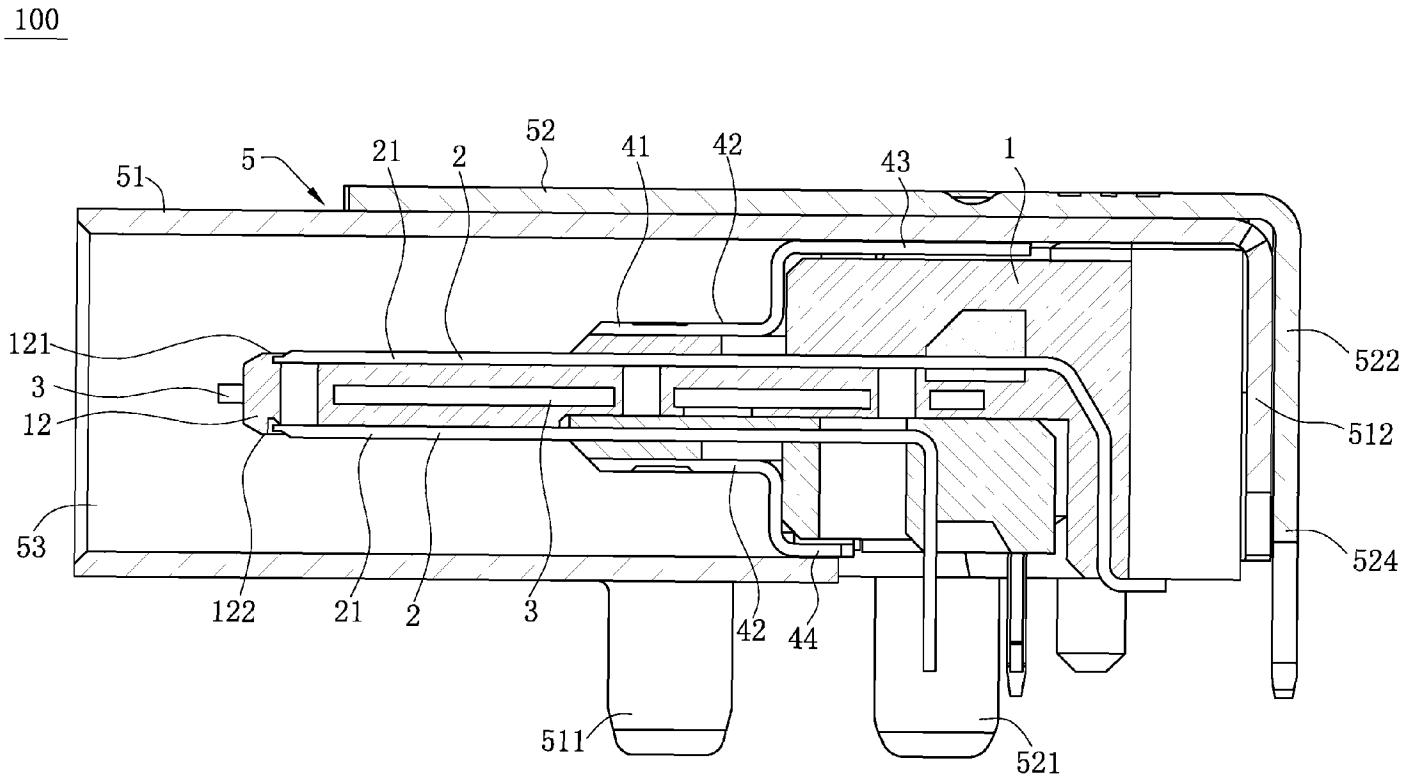
FIG. 6 is a sectional view of the electrical connector according to one embodiment of the present invention.
Figure 7:
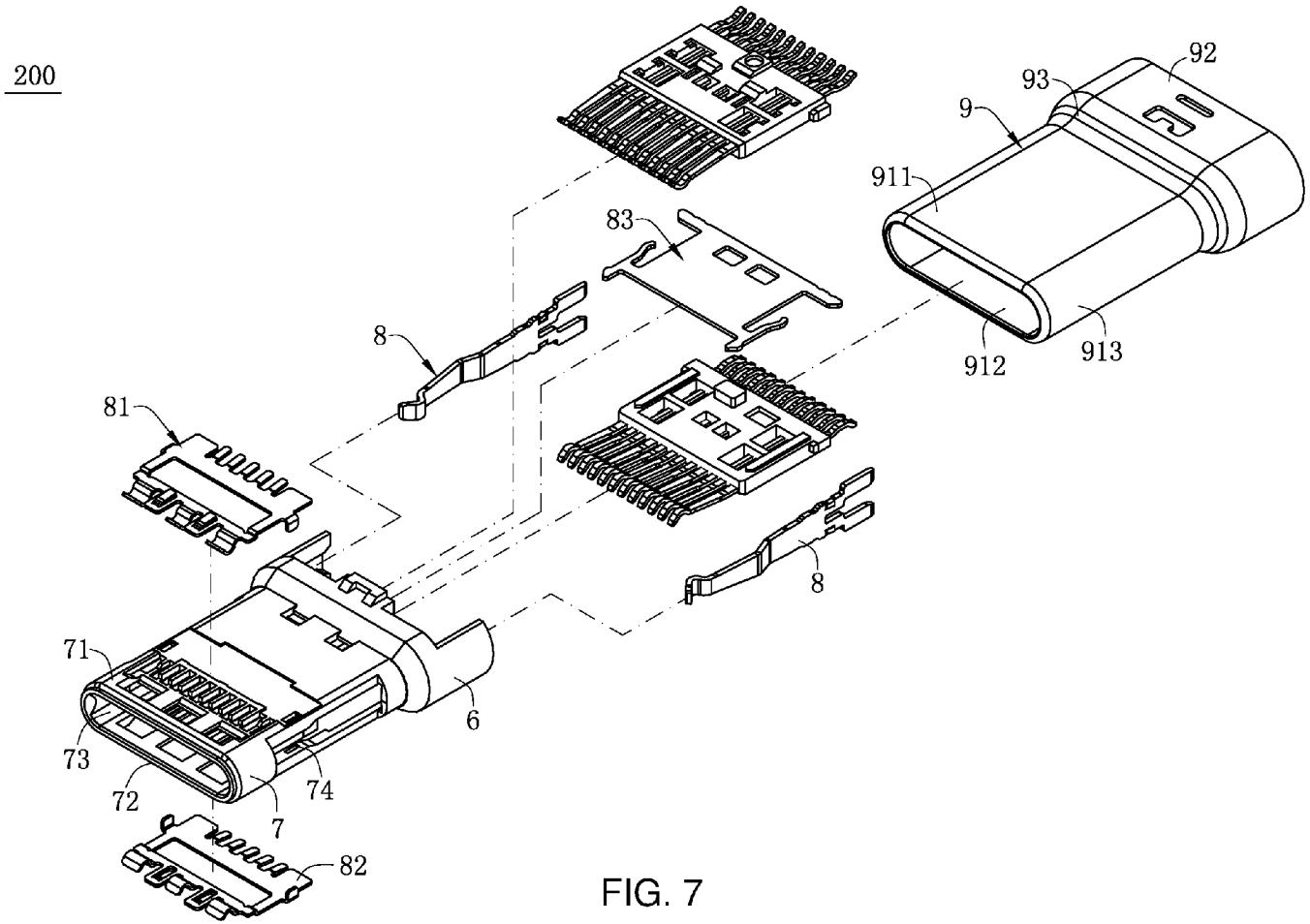
FIG. 7 is a three-dimensional exploded view of a mating connector according to one embodiment of the present invention.
Figure 8:
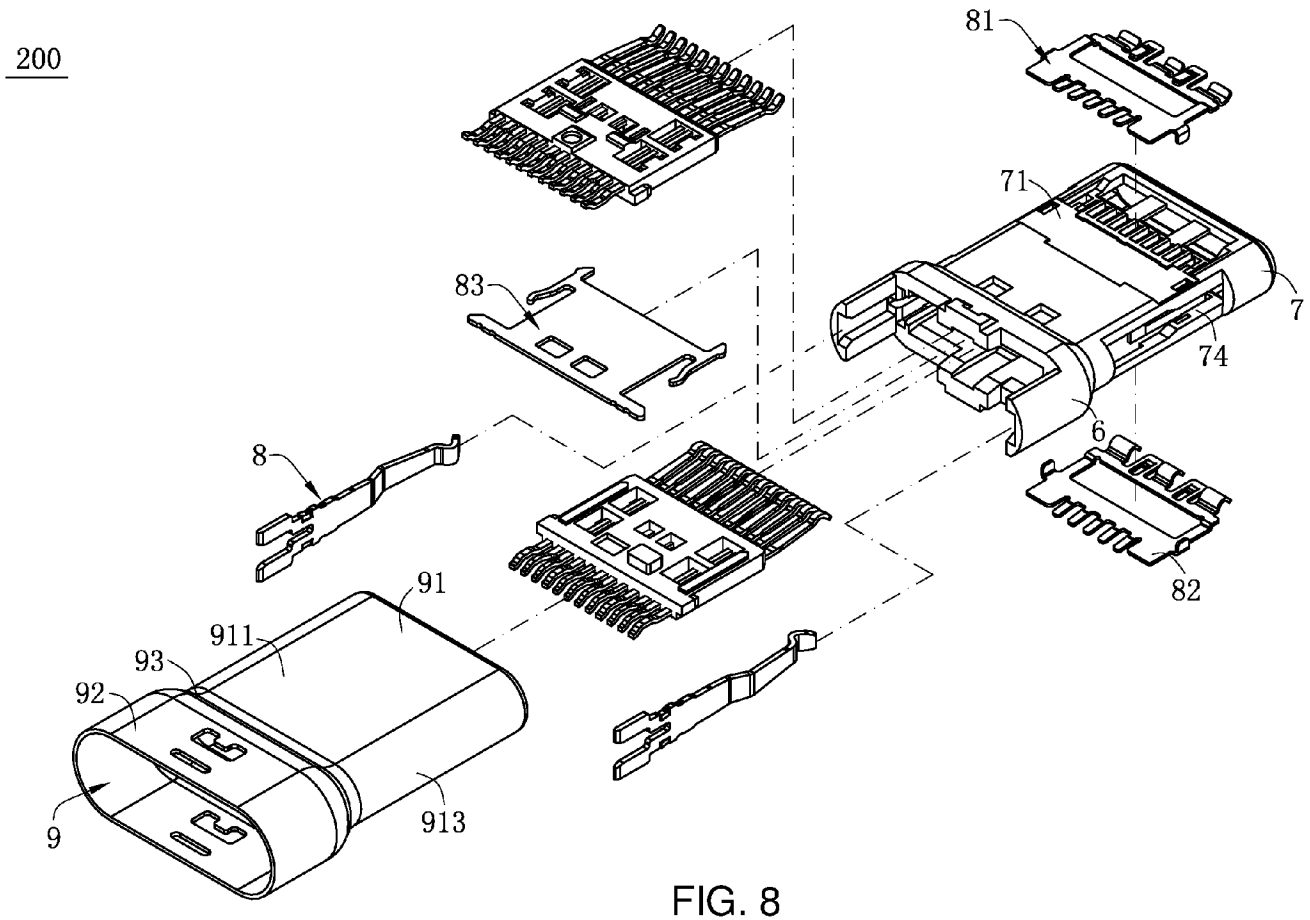
FIG. 8 is a three-dimensional exploded view of the mating connector viewed from another viewing angle according to one embodiment of the present invention.
Figure 9:
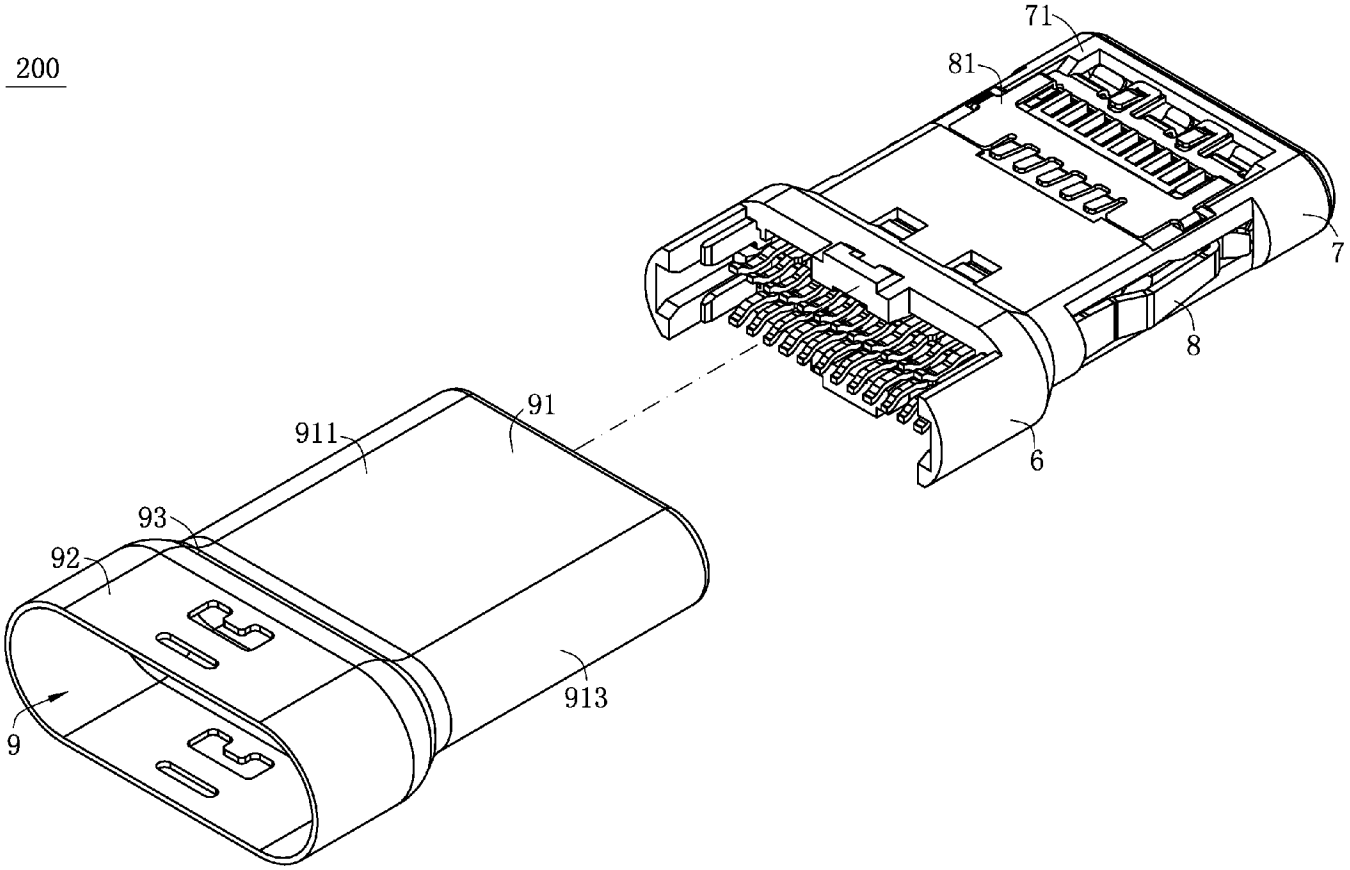
FIG. 9 is a partial three-dimensional exploded view of the mating connector according to one embodiment of the present invention.
Figure 10:
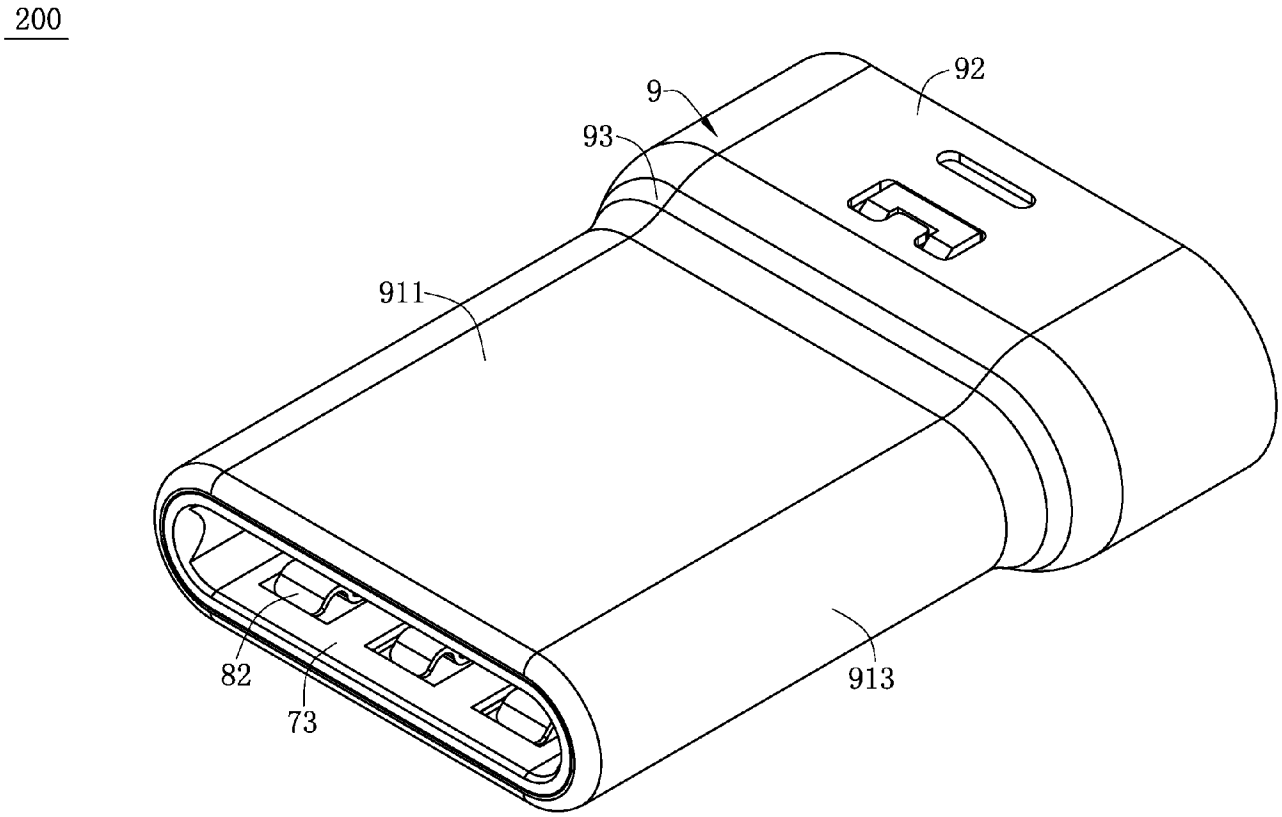
FIG. 10 is a three-dimensional assembly drawing of the mating connector according to one embodiment of the present invention.
Figure 11:
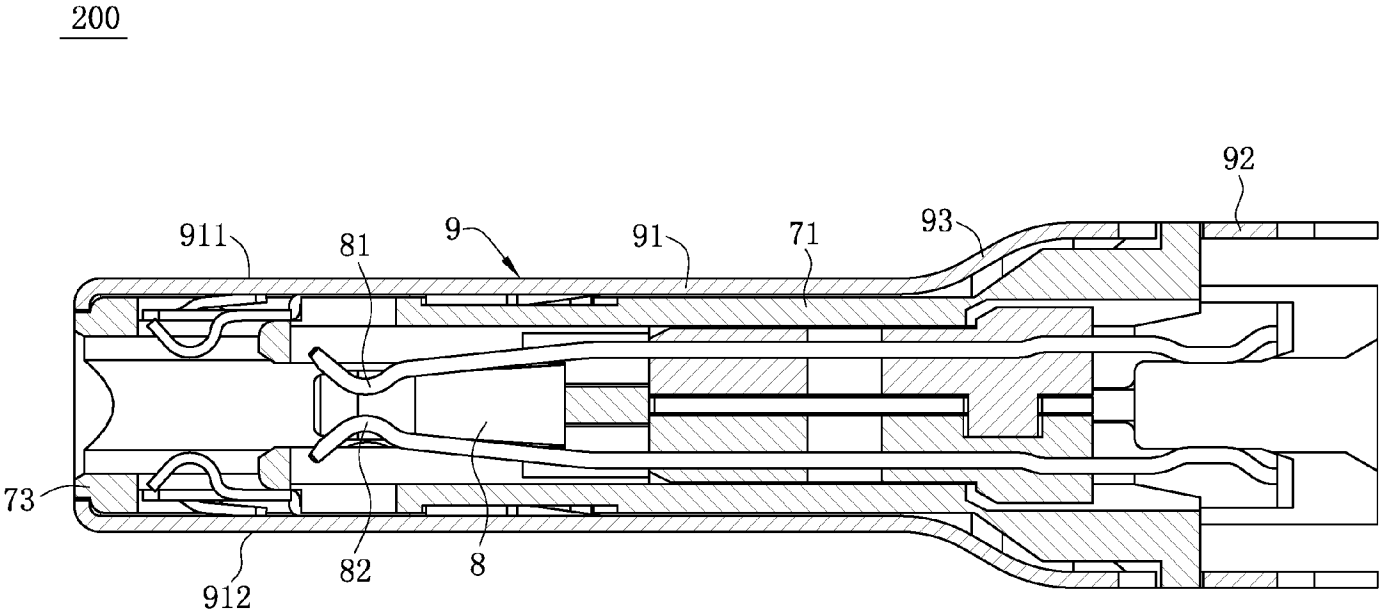
FIG. 11 is a sectional view of the mating connector according to one embodiment of the present invention.
Figure 12:
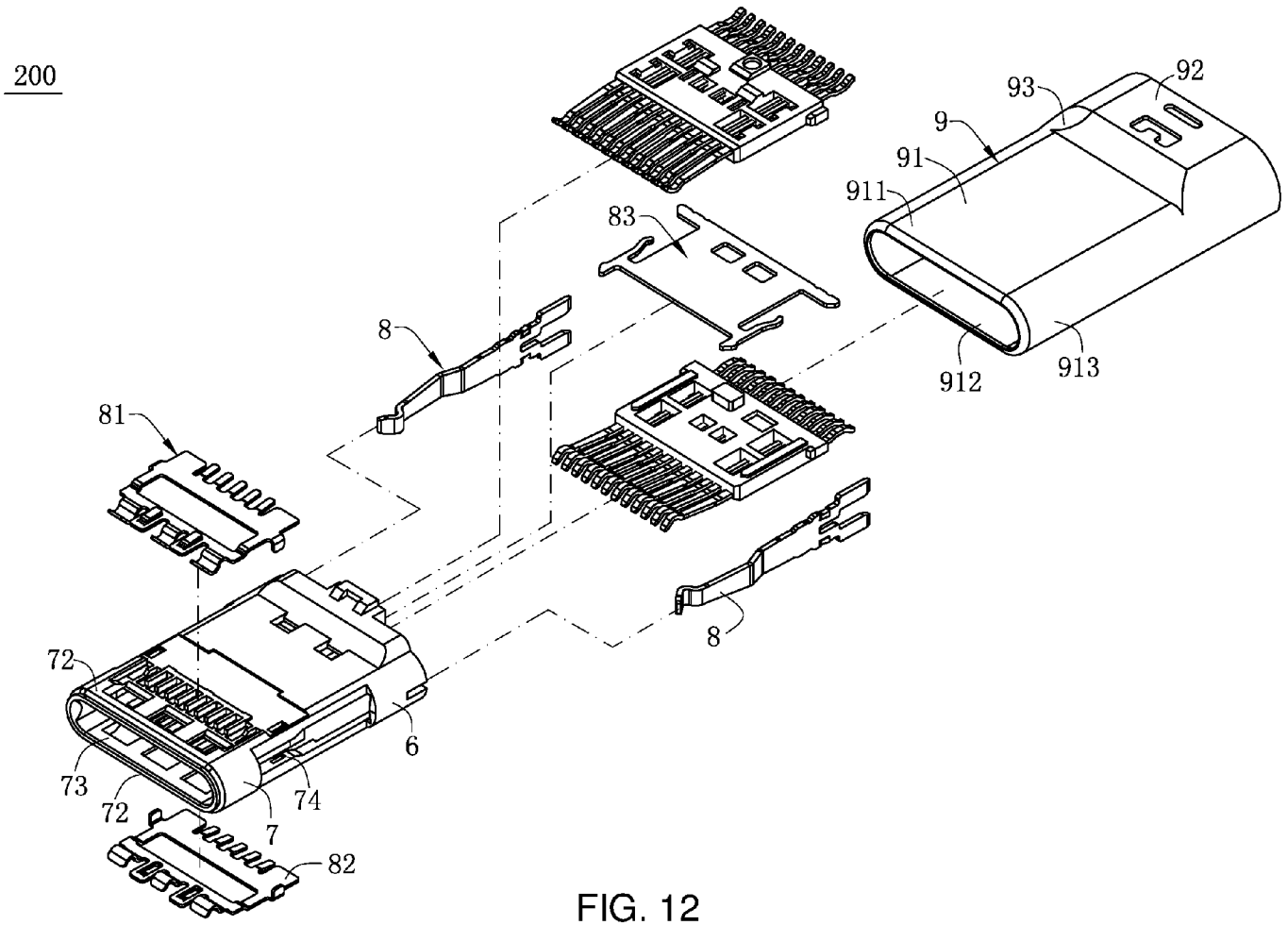
FIG. 12 is a three-dimensional exploded view of a mating connector according to a second embodiment of the present invention.
Figure 13:
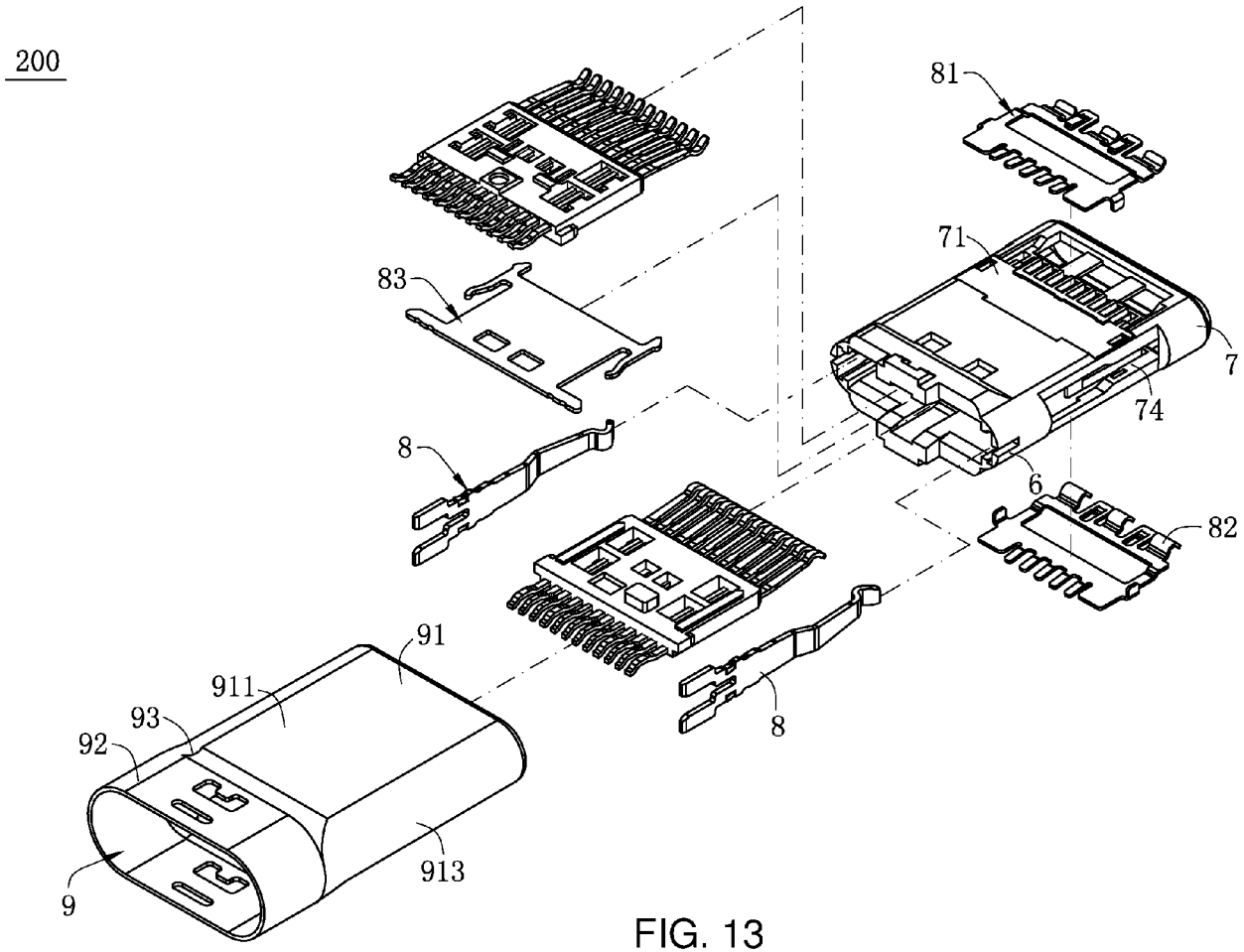
FIG. 13 is a three-dimensional exploded view of the mating connector viewed from another viewing angle according to the second embodiment of the present invention.
Figure 14:
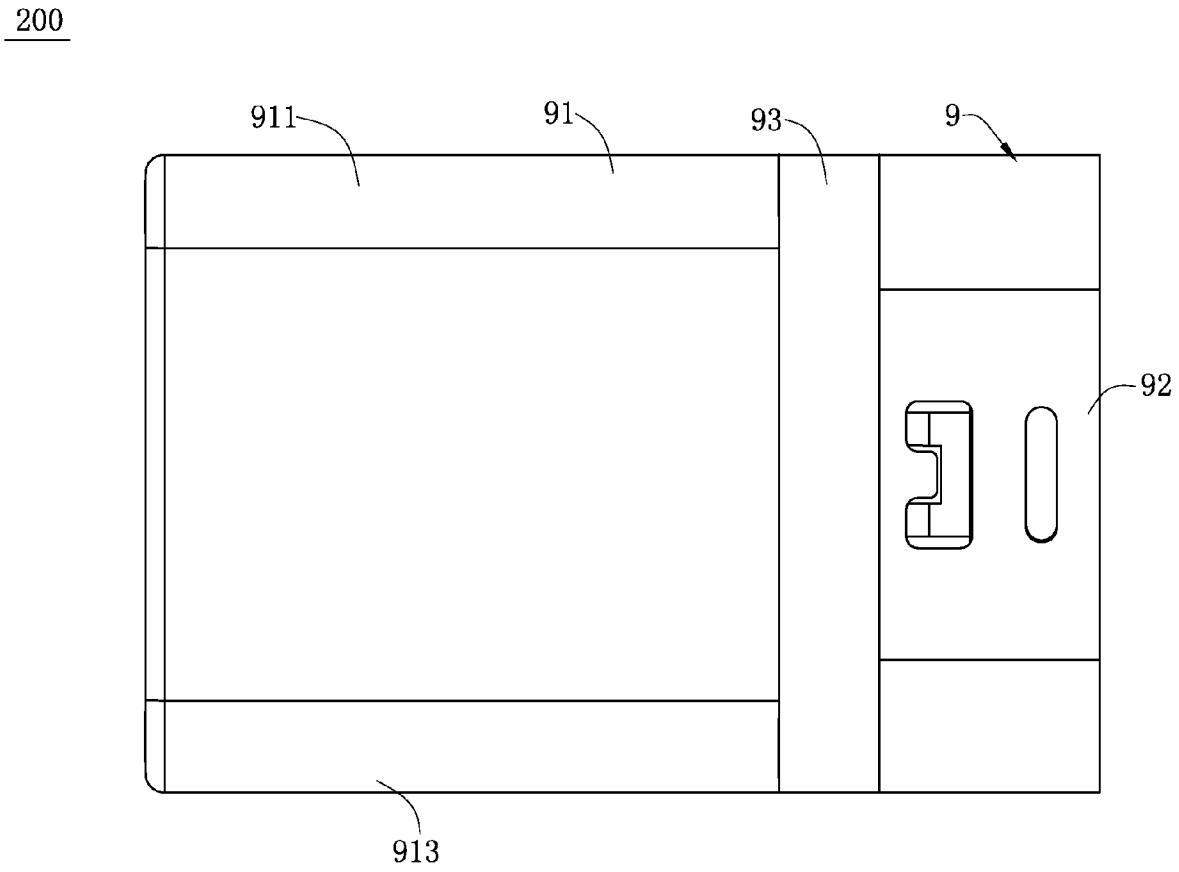
FIG. 14 is a top view of a metal cover of the mating connector according to the second embodiment of the present invention.
Figure 15:
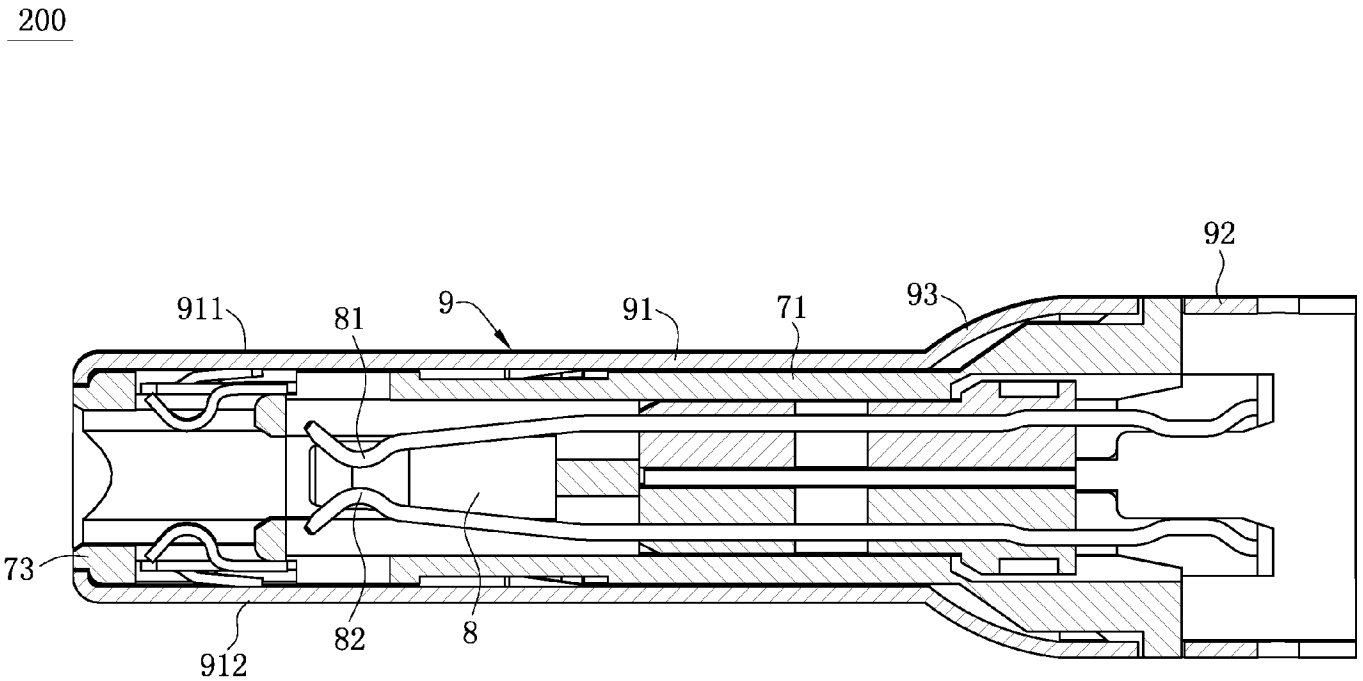
FIG. 15 is a sectional view of the mating connector according to the second embodiment of the present invention.

As shown in FIG. 5 and FIG. 6, the wrapping casing 51 has a first rear wall 512, and the shielding casing 52 has a second rear wall 522. The first rear wall 512 has a first middle portion 513 and first sheltering portions 514 located at two sides of the first middle portion 513. The second rear wall 522 has a second middle portion 523 and a second sheltering portion 524 connected to a lower part of the second middle portion 523. The first middle portion 513 and the second middle portion 523 are approximately superposed front and back. A place of the second rear wall 522 corresponding to the first sheltering portion 514 forms a notch 525, and the second sheltering portion 524 exceeds the first middle portion 513 downward. The electrical connector 100 can be conveniently welded, and a good shielding effect can be ensured, so as to prevent signals from being leaked from the behind, and save materials. Multiple fixing pins (not labeled) extends downward from the second rear wall 522, and used for cooperating with the first soldering pins 511 and the second soldering pins 521 to stably position the electrical connector 100 onto the circuit board 300.

Figure 48:
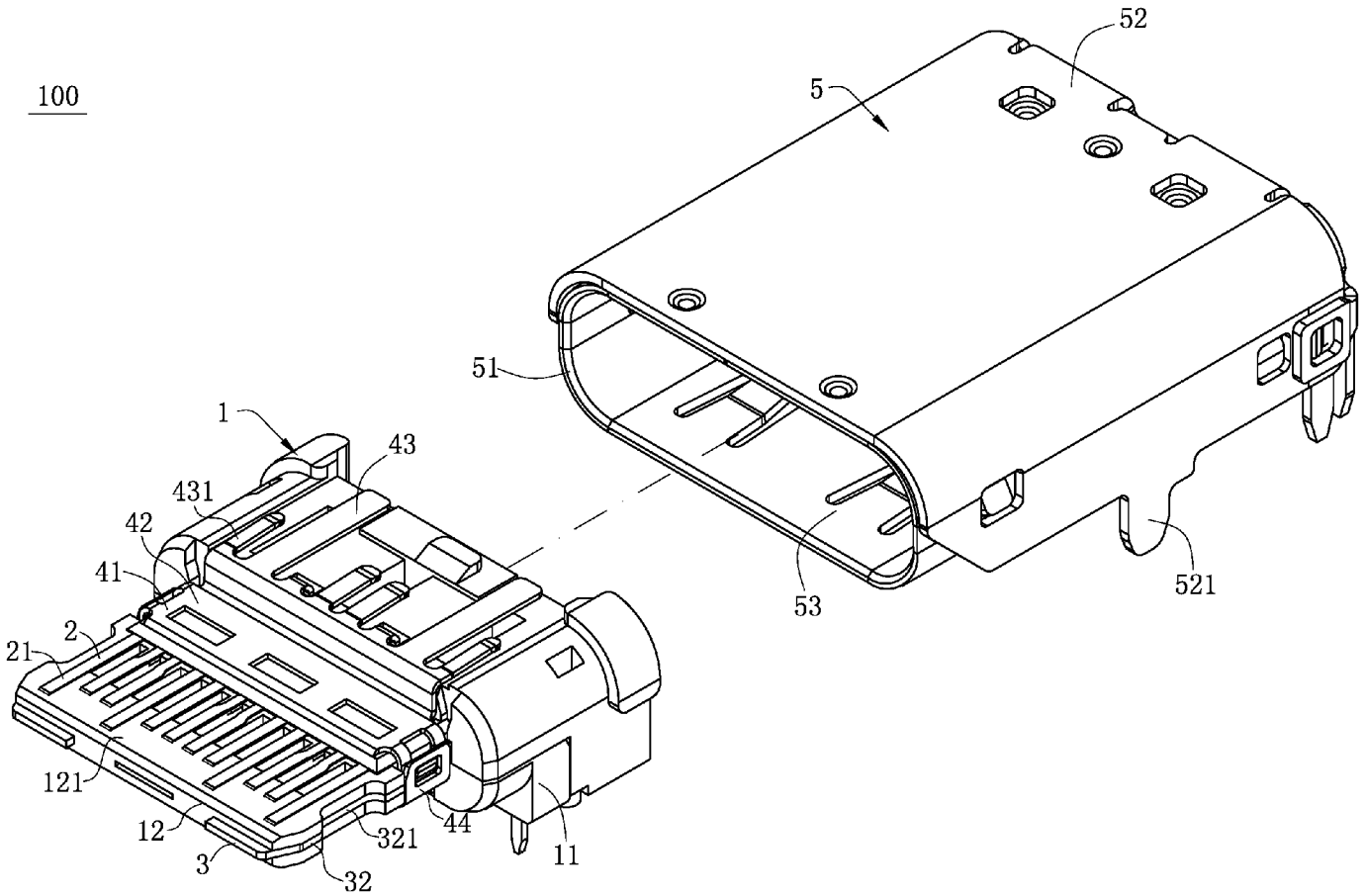
FIG. 48 is a partial three-dimensional exploded view of the electrical connector according to the thirteenth embodiment of the present invention.
Figure 49:
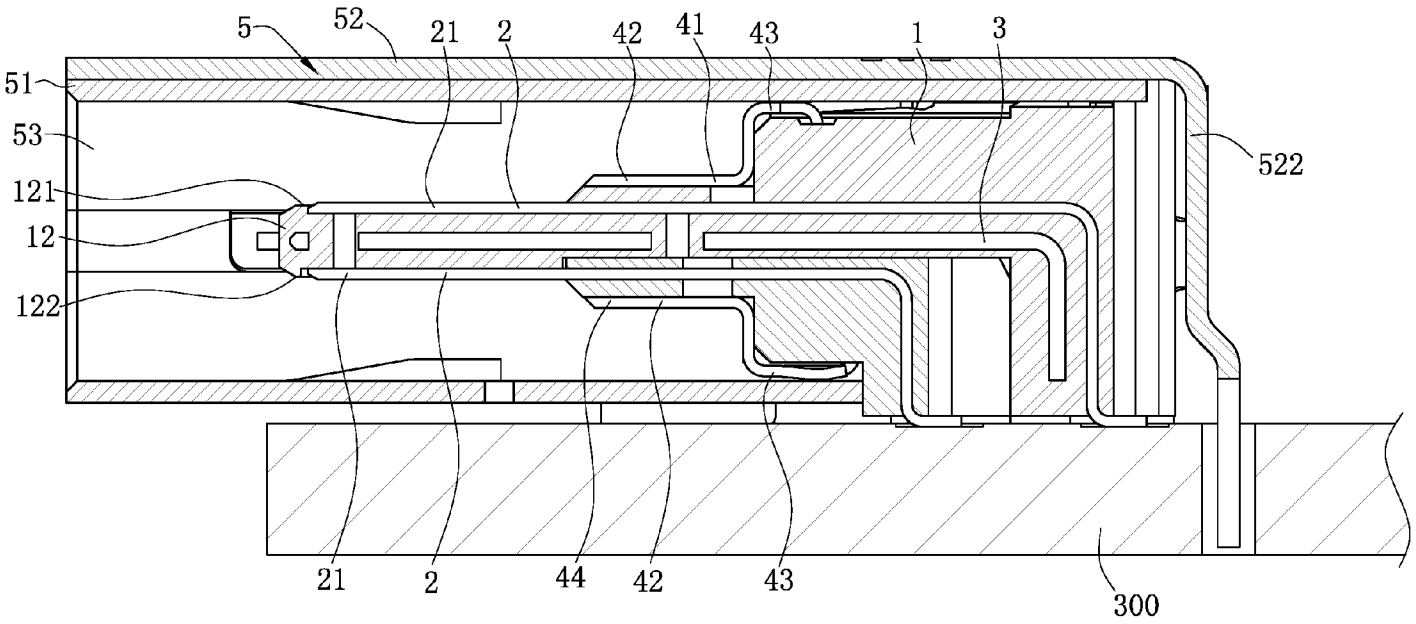
FIG. 49 is a sectional view of the electrical connector according to the thirteenth embodiment of the present invention.
Figure 50:
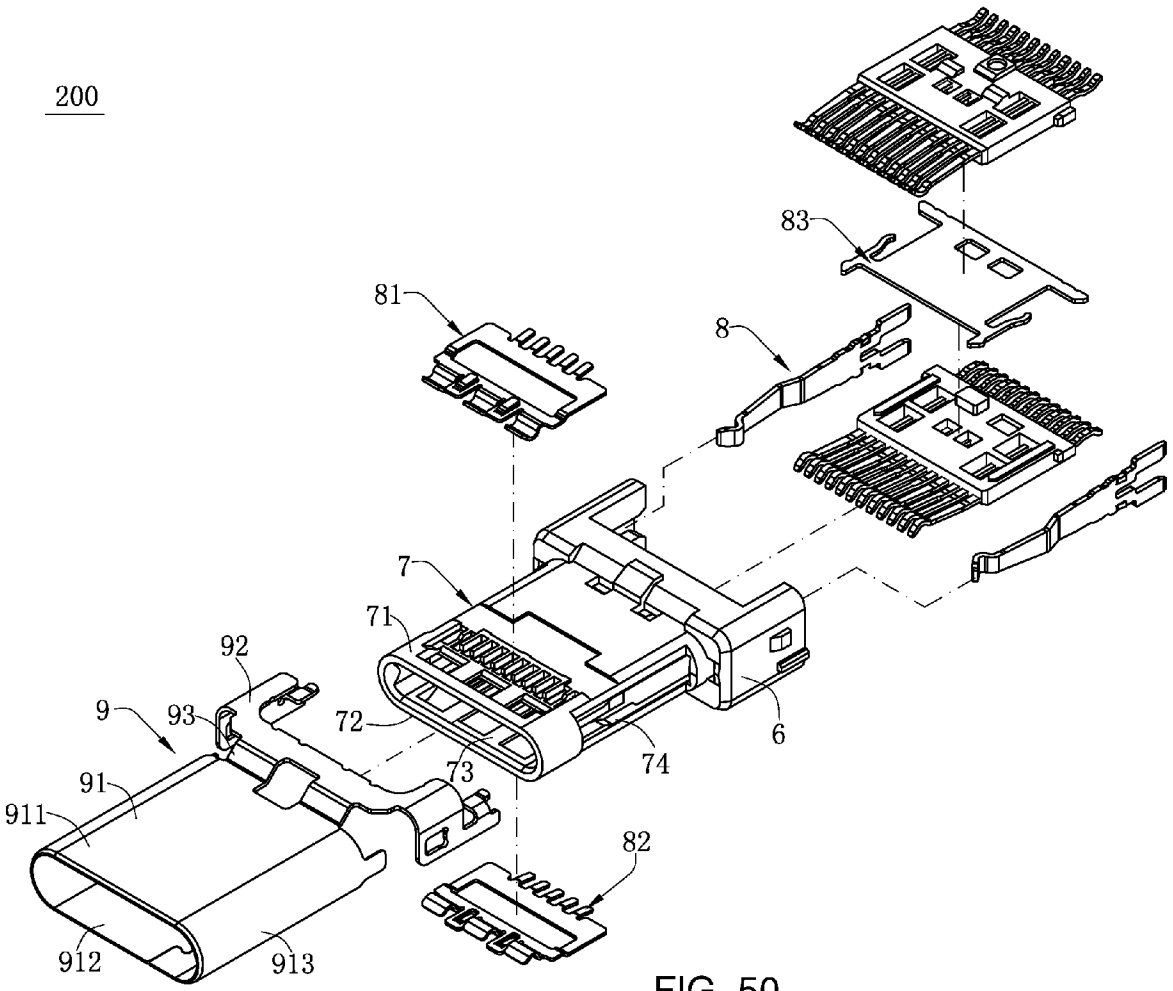
FIG. 50 is a three-dimensional exploded view of a mating connector according to a fourteenth embodiment of the present invention.
Figure 51:
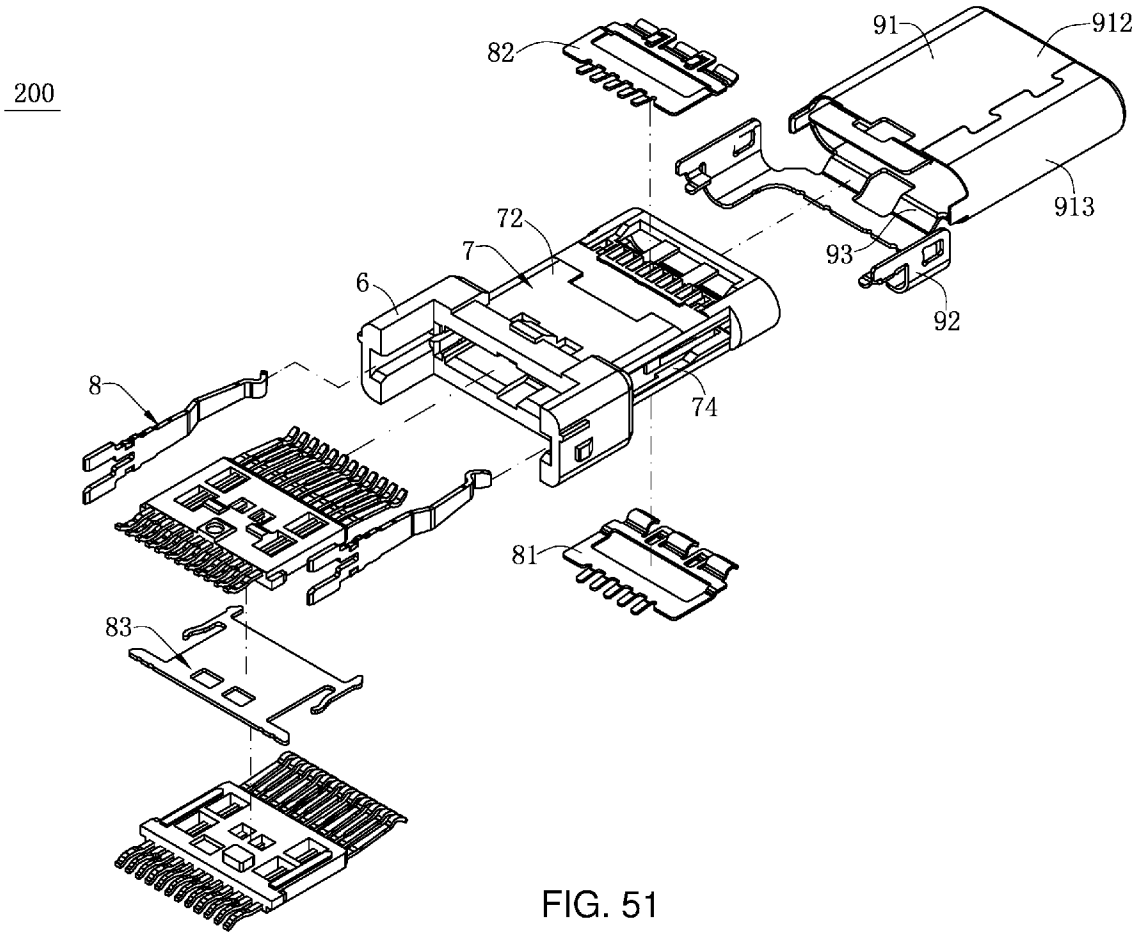
FIG. 51 is a three-dimensional exploded view of the mating connector viewed from another viewing angle according to the fourteenth embodiment of the present invention.
Figure 52:
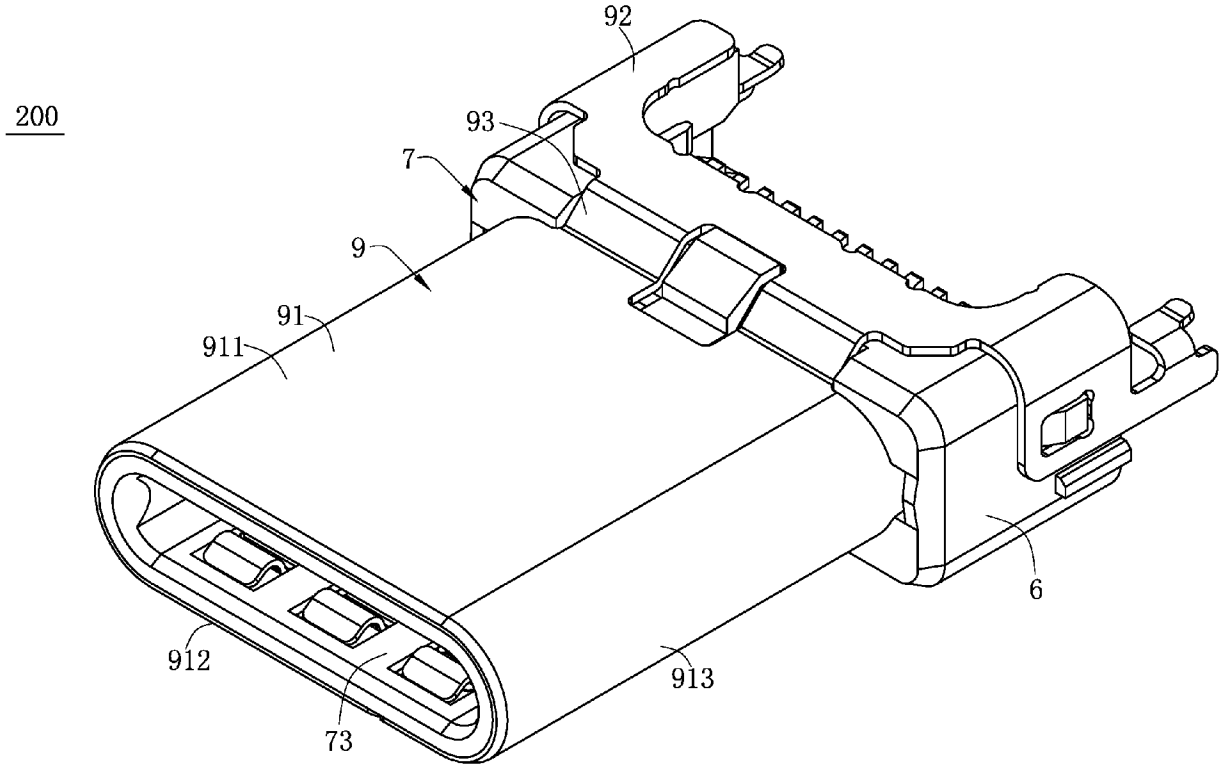
FIG. 52 is a three-dimensional assembly view of the mating connector according to the fourteenth embodiment of the present invention.
Figure 53:
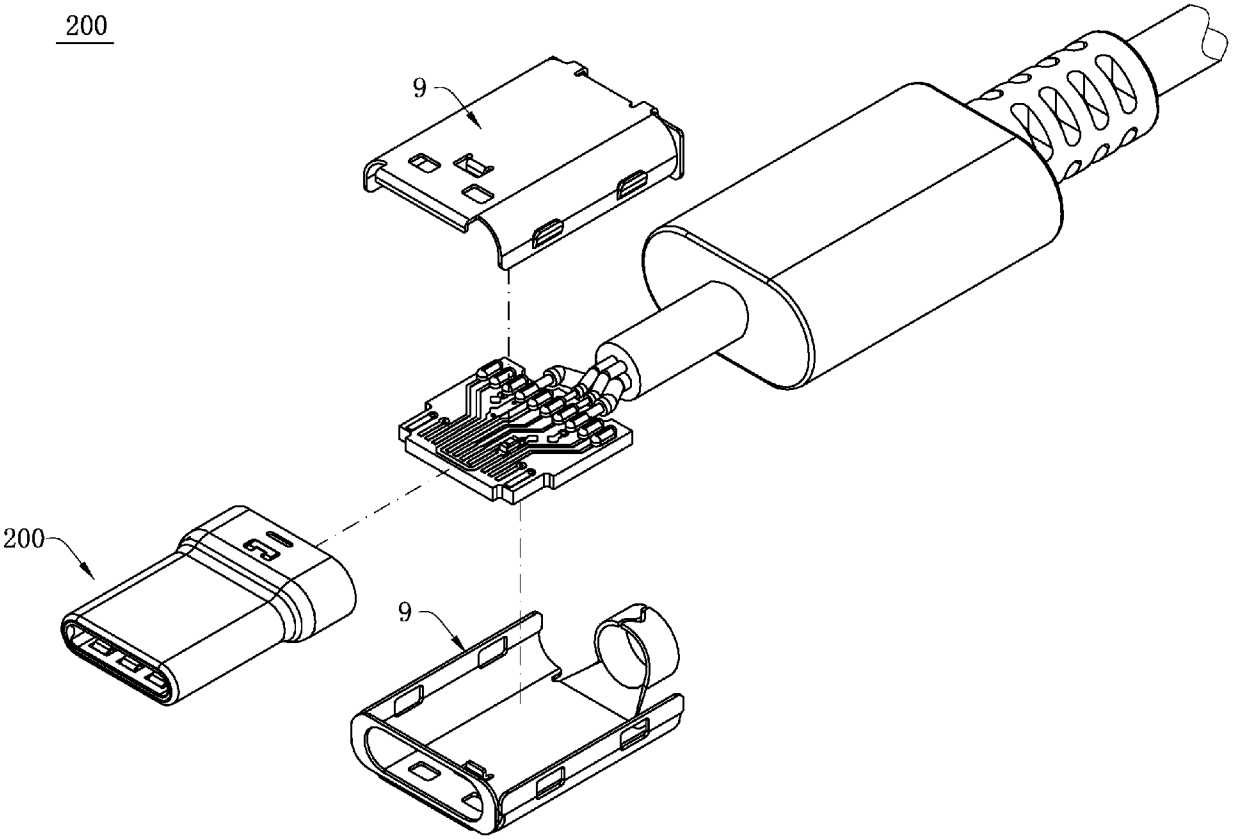
FIG. 53 is a three-dimensional exploded view of a mating connector according to a fifteenth embodiment of the present invention.
Figure 54:
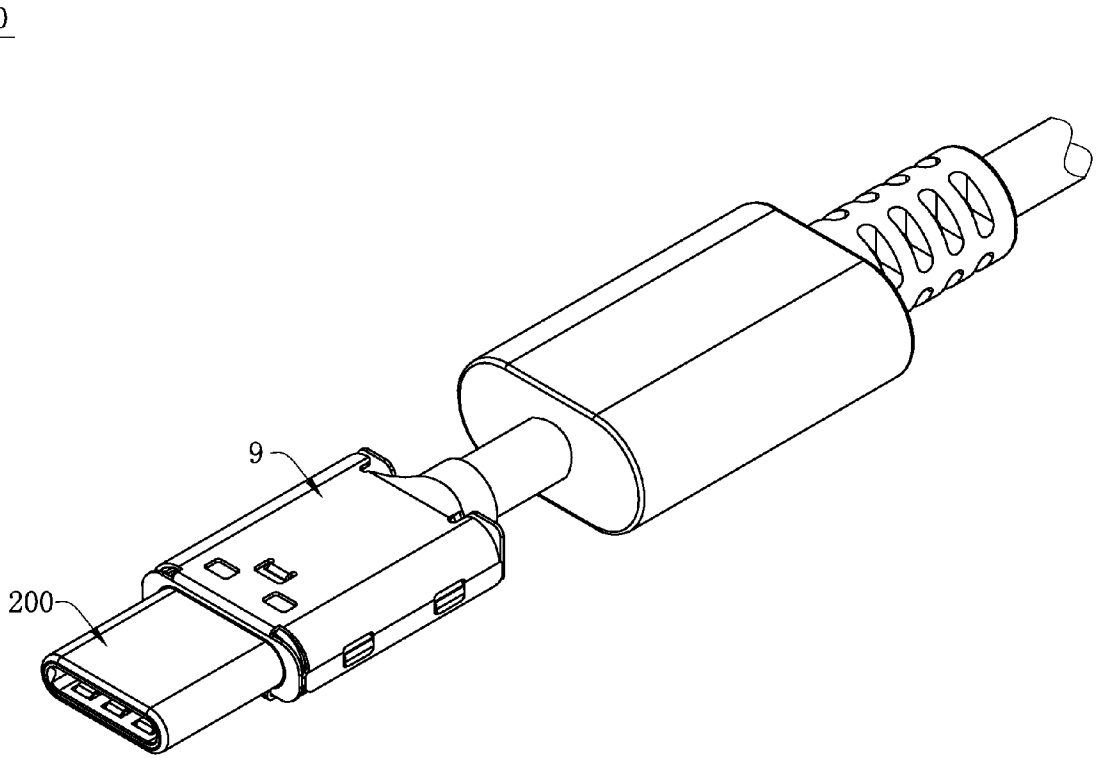
FIG. 54 is a three-dimensional assembly view of the mating connector according to the fifteenth embodiment of the present invention.

As shown in FIG. 48, structures bending forward are further disposed at two sides of the second rear wall 522, to further snap-fit two side walls of the shielding casing 52, so that the shielding casing 52 is not easily loosen, and it may also be ensure that the signals in the electrical connector 100 are not easily leaked from behind the rear side.

Figure 21:
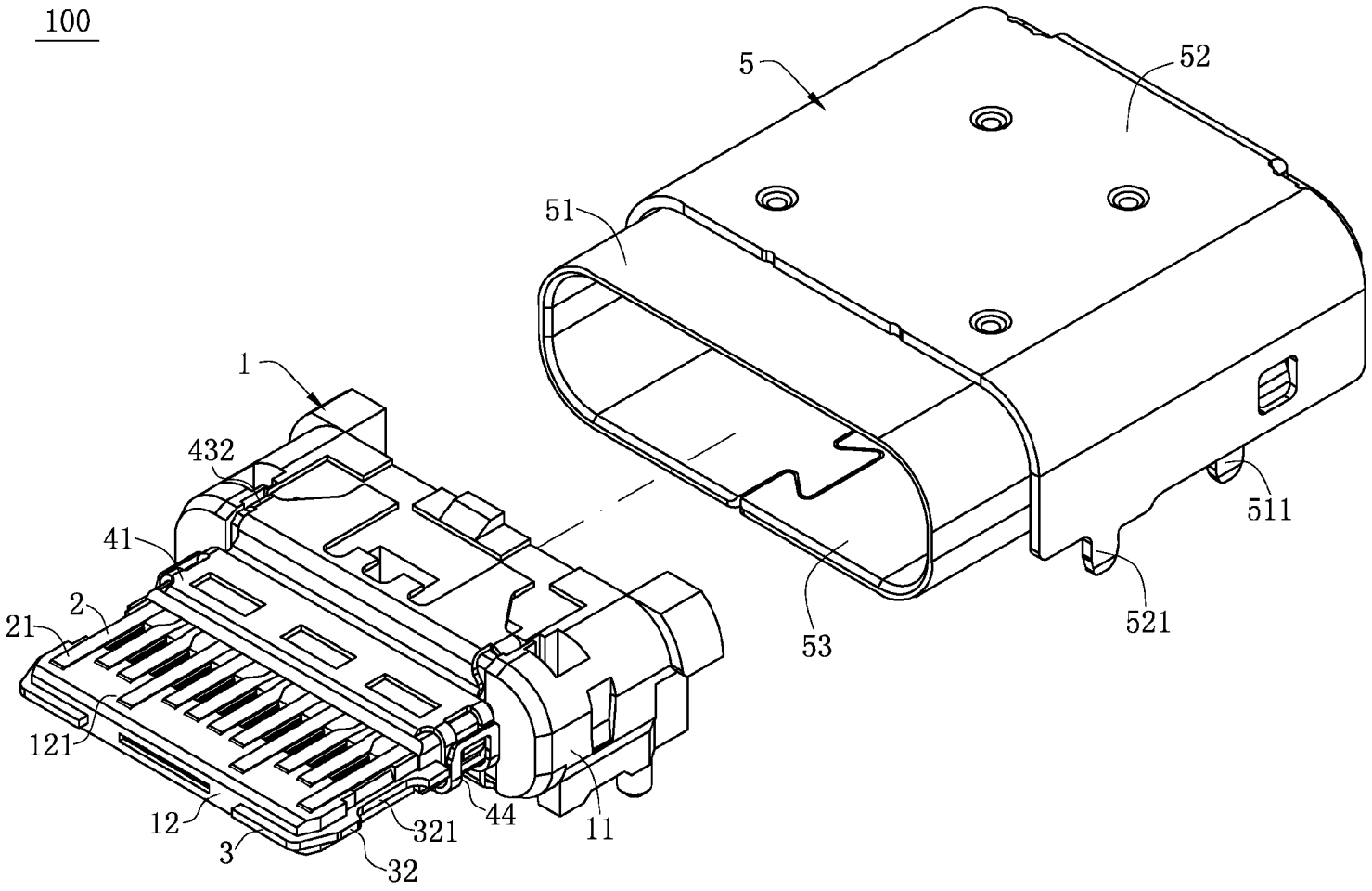
FIG. 21 is a partial three-dimensional exploded view of an electrical connector according to a fifth embodiment of the present invention.
Figure 22:
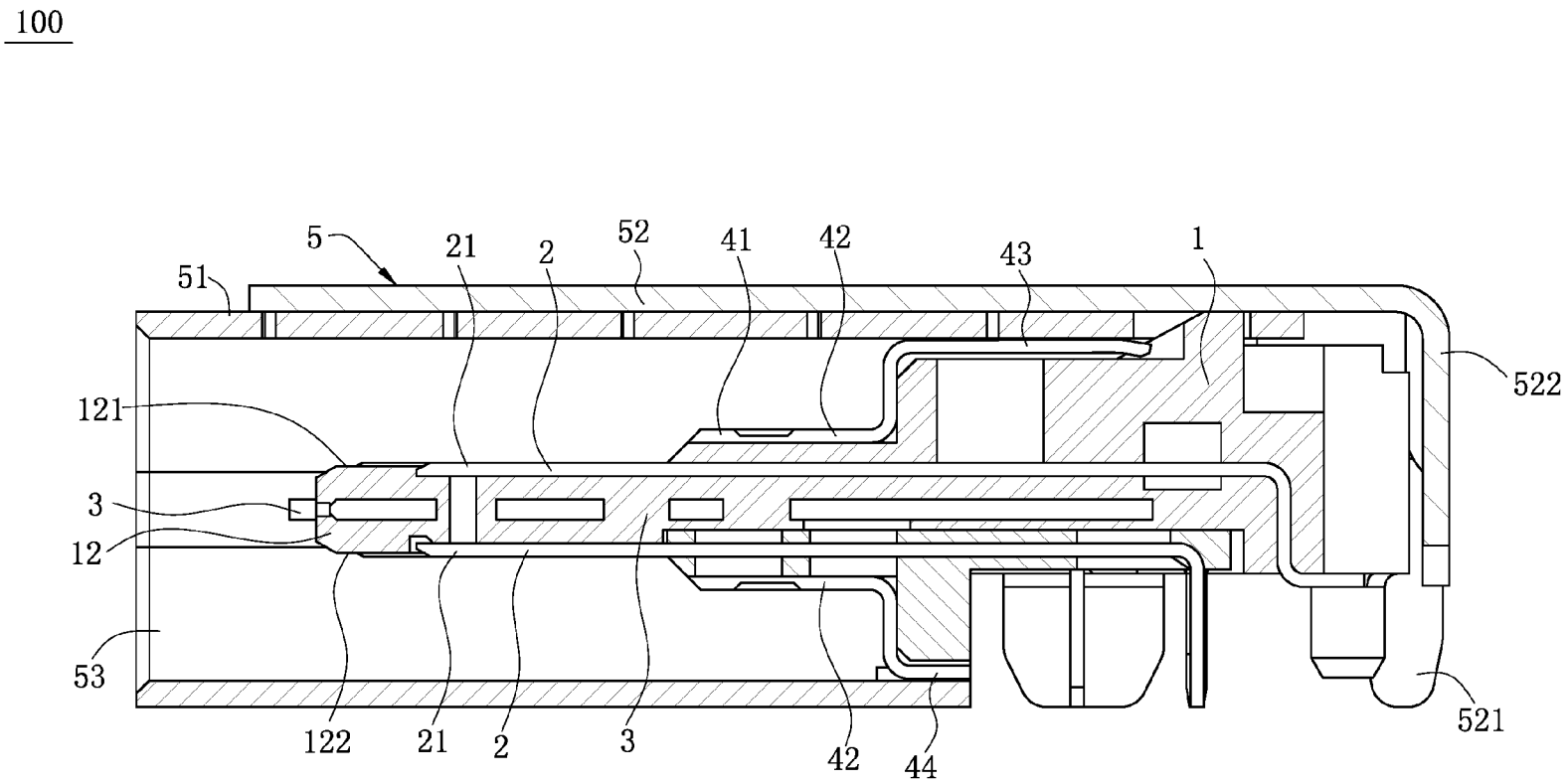
FIG. 22 is a sectional view of the electrical connector according to the fifth embodiment of the present invention.
Figure 23:
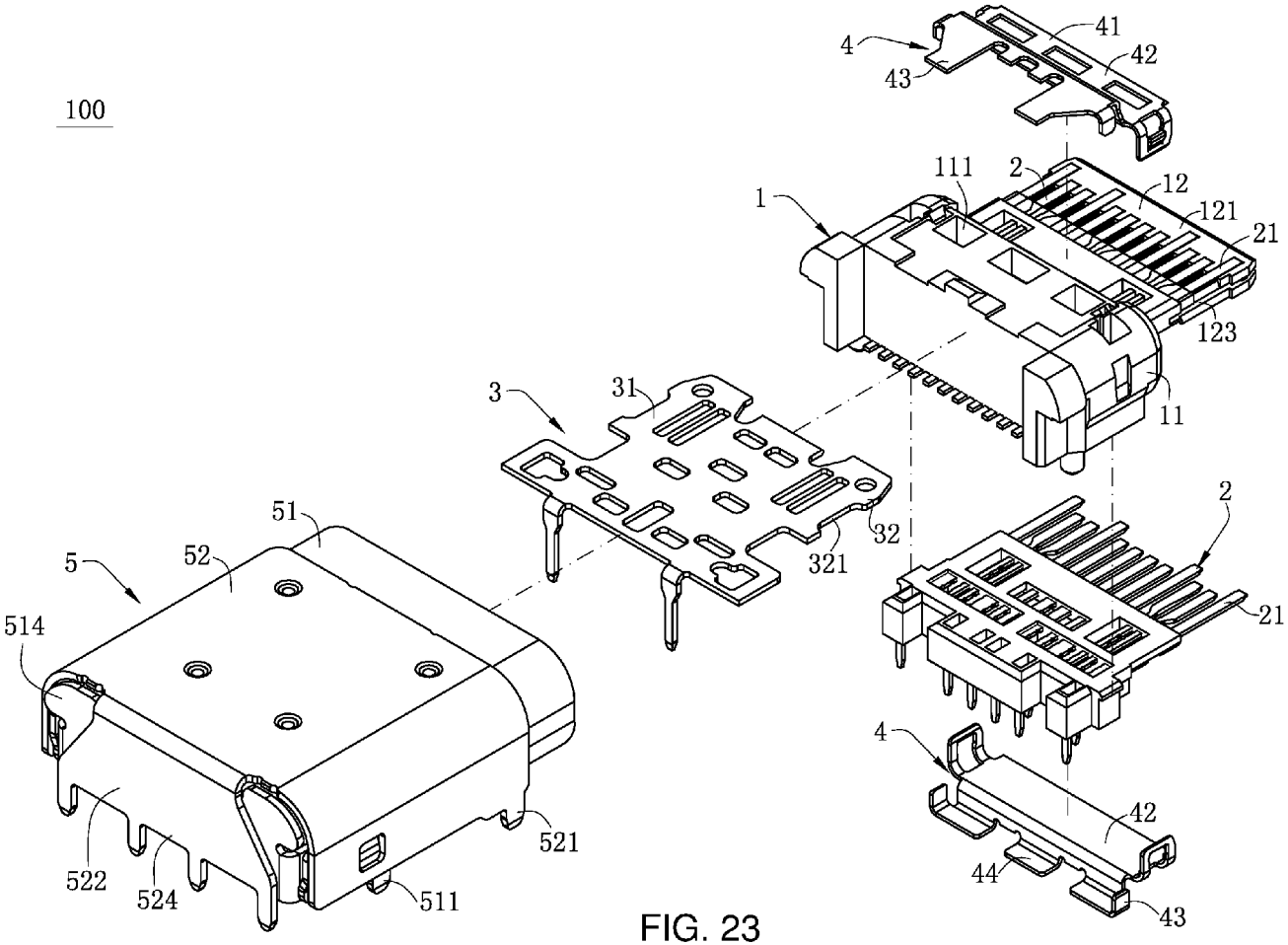
FIG. 23 is a three-dimensional exploded view of an electrical connector according to a sixth embodiment of the present invention.
Figure 24:
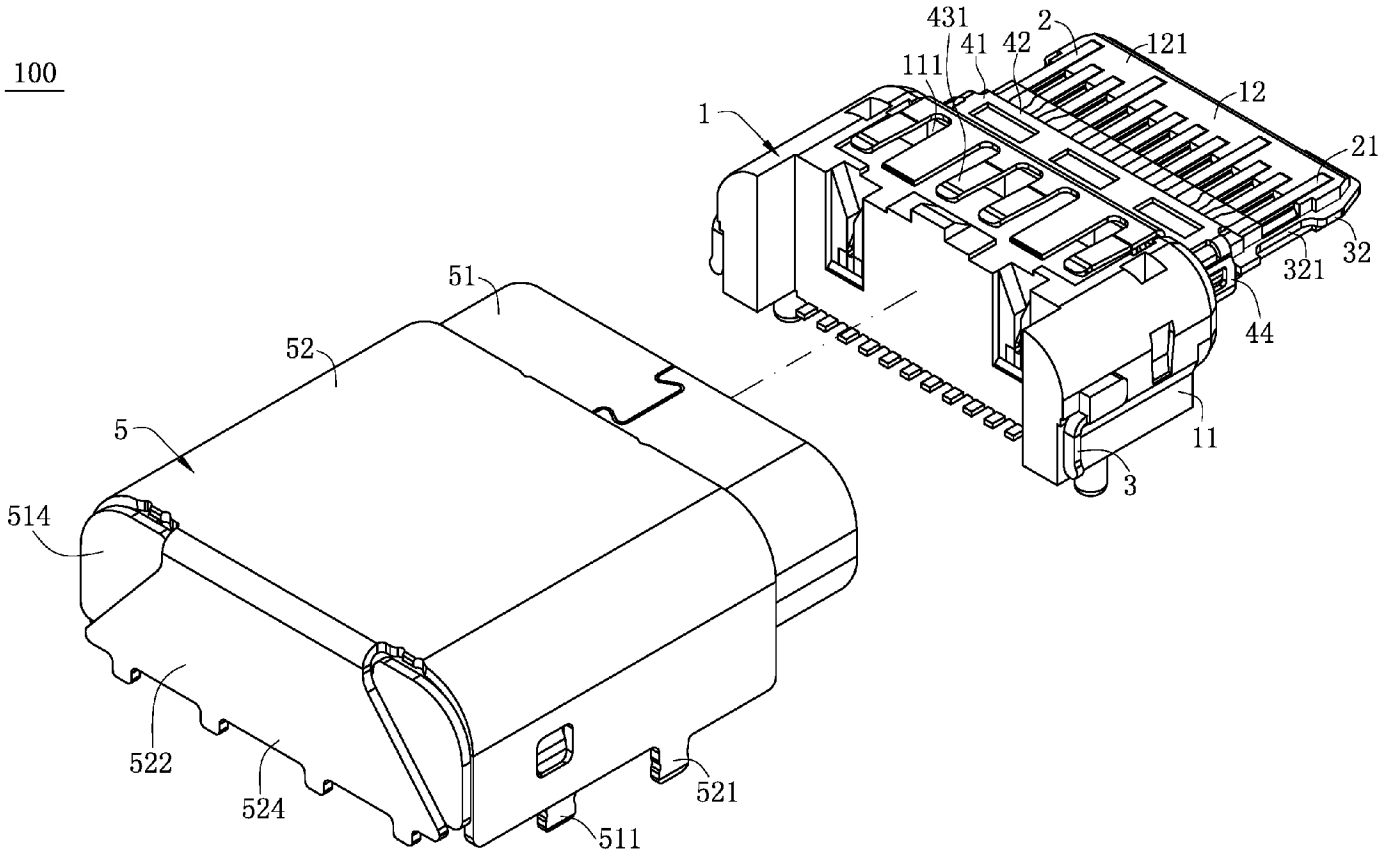
FIG. 24 is a partial three-dimensional exploded view of an electrical connector according to a seventh embodiment of the present invention.
Figure 25:
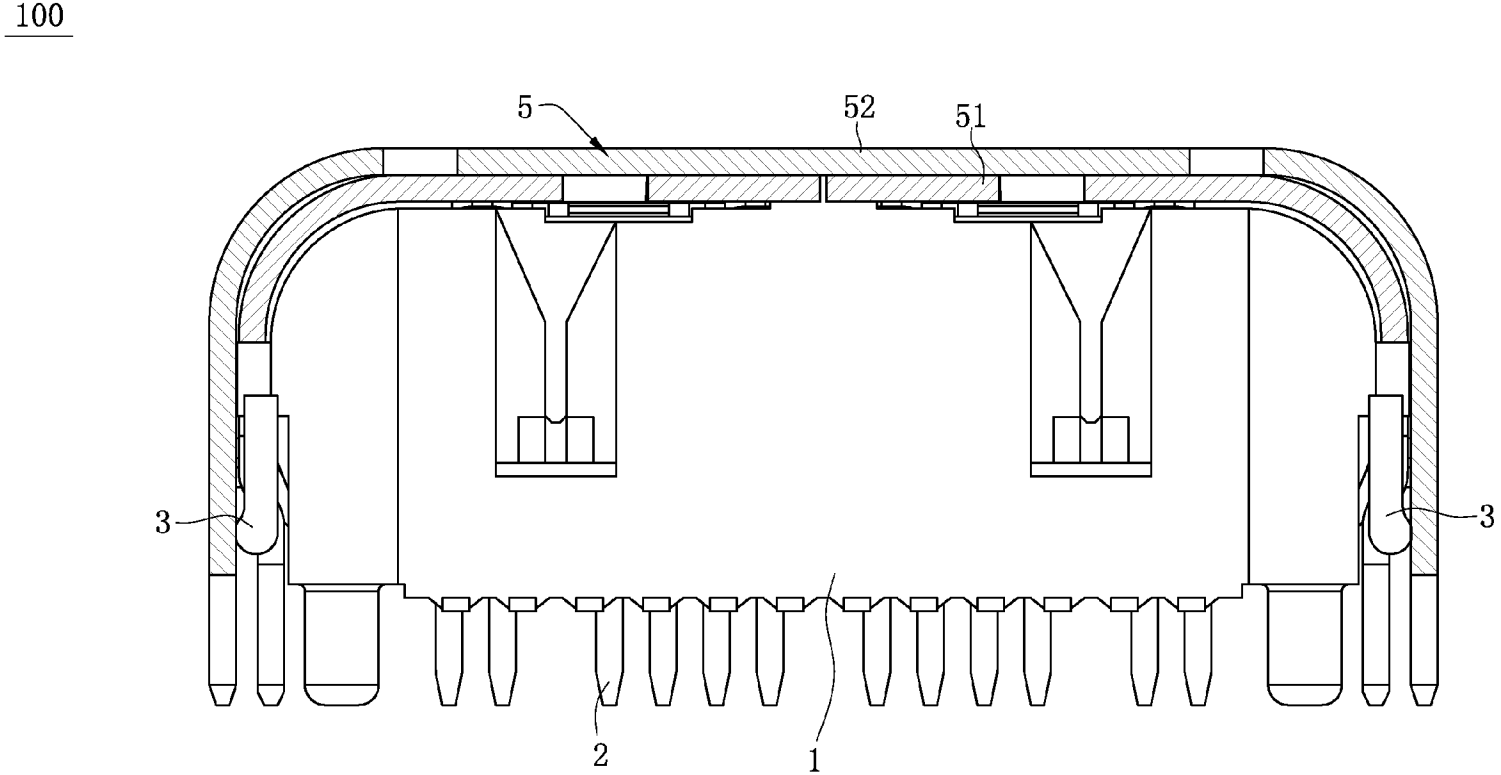
FIG. 25 is a sectional view of the electrical connector according to the seventh embodiment of the present invention.
Figure 26:
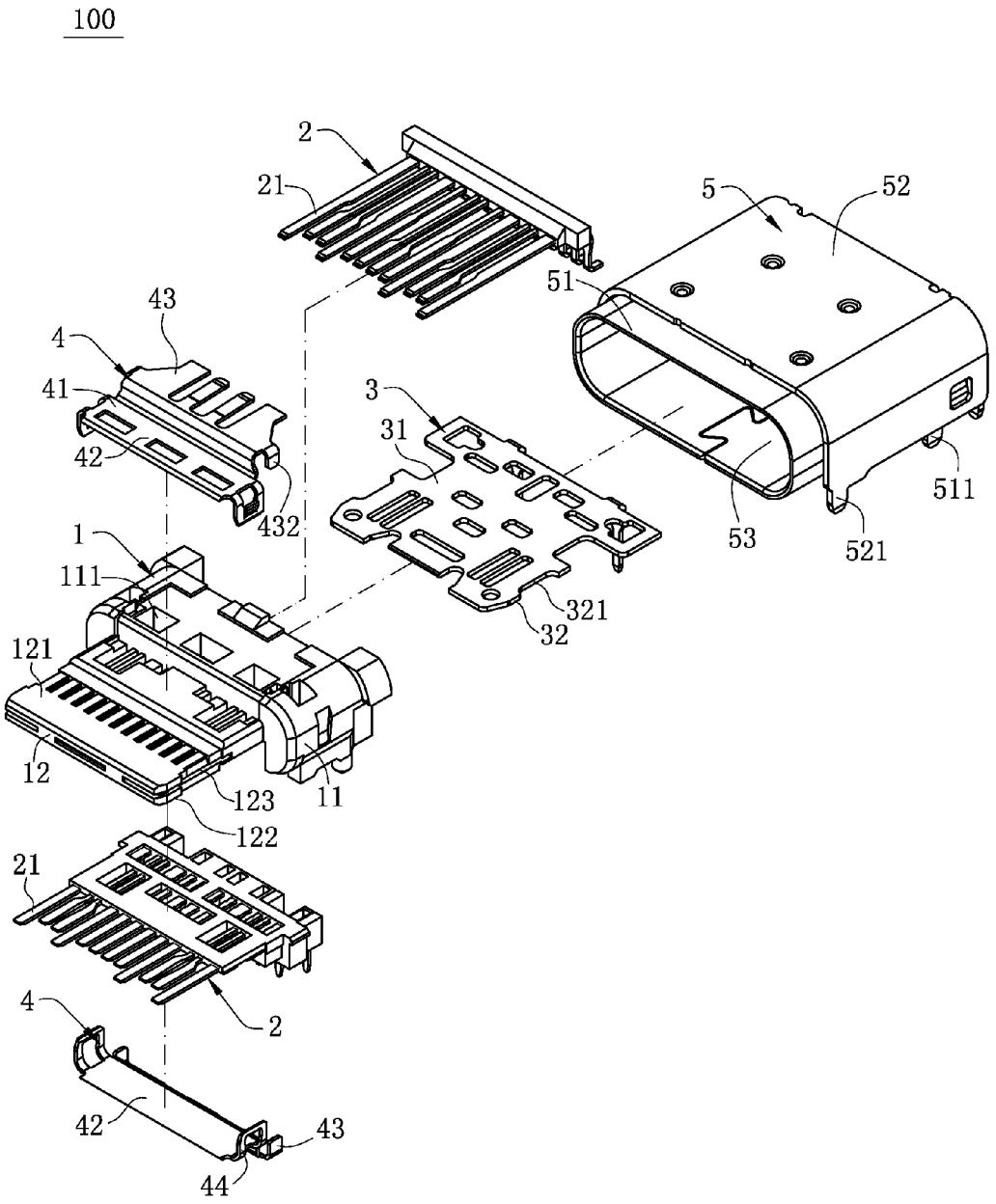
FIG. 26 is a three-dimensional exploded view of an electrical connector according to an eighth embodiment of the present invention.
Figure 27:
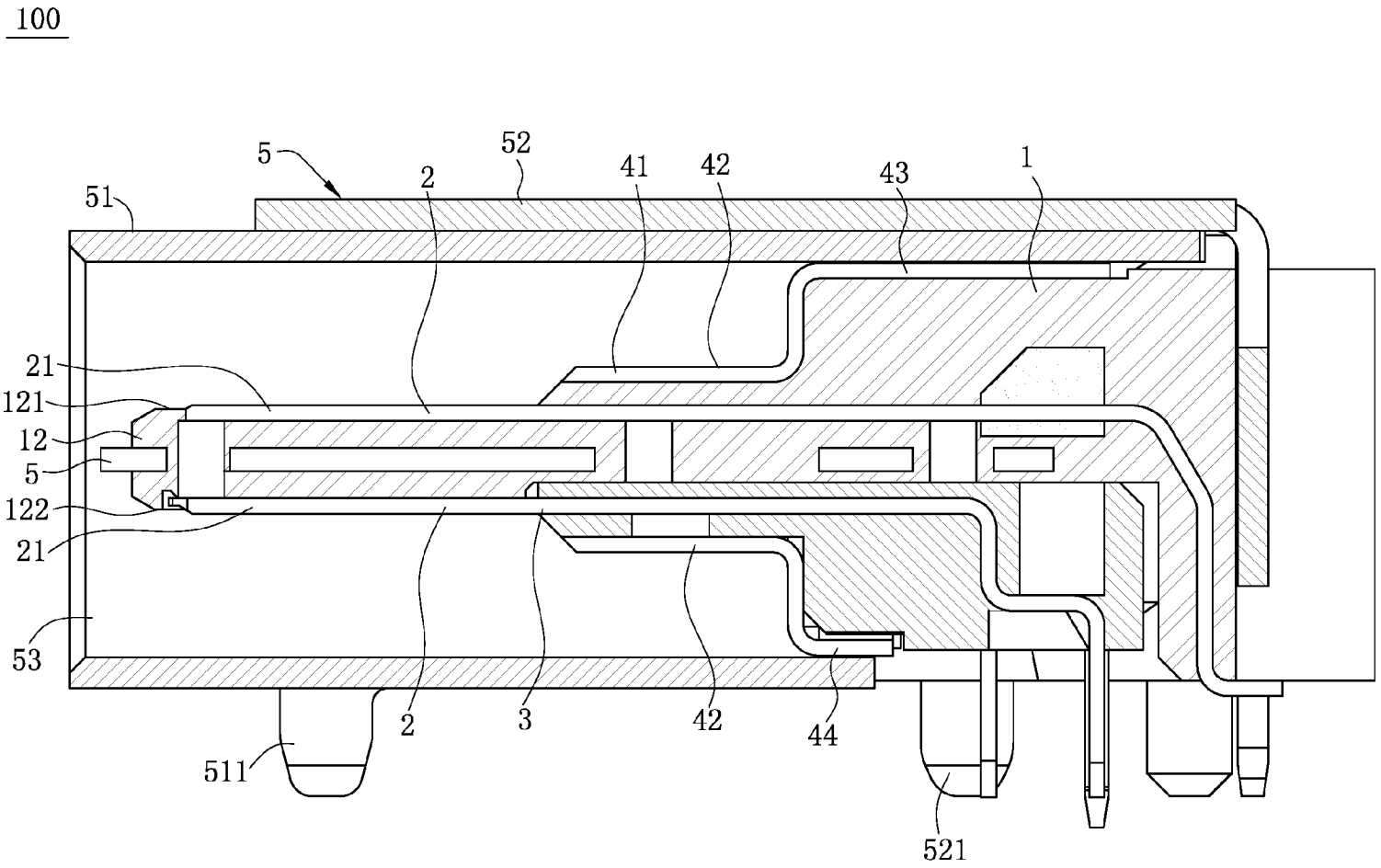
FIG. 27 is a sectional view of the electrical connector according to the eighth embodiment of the present invention.
Figure 28:
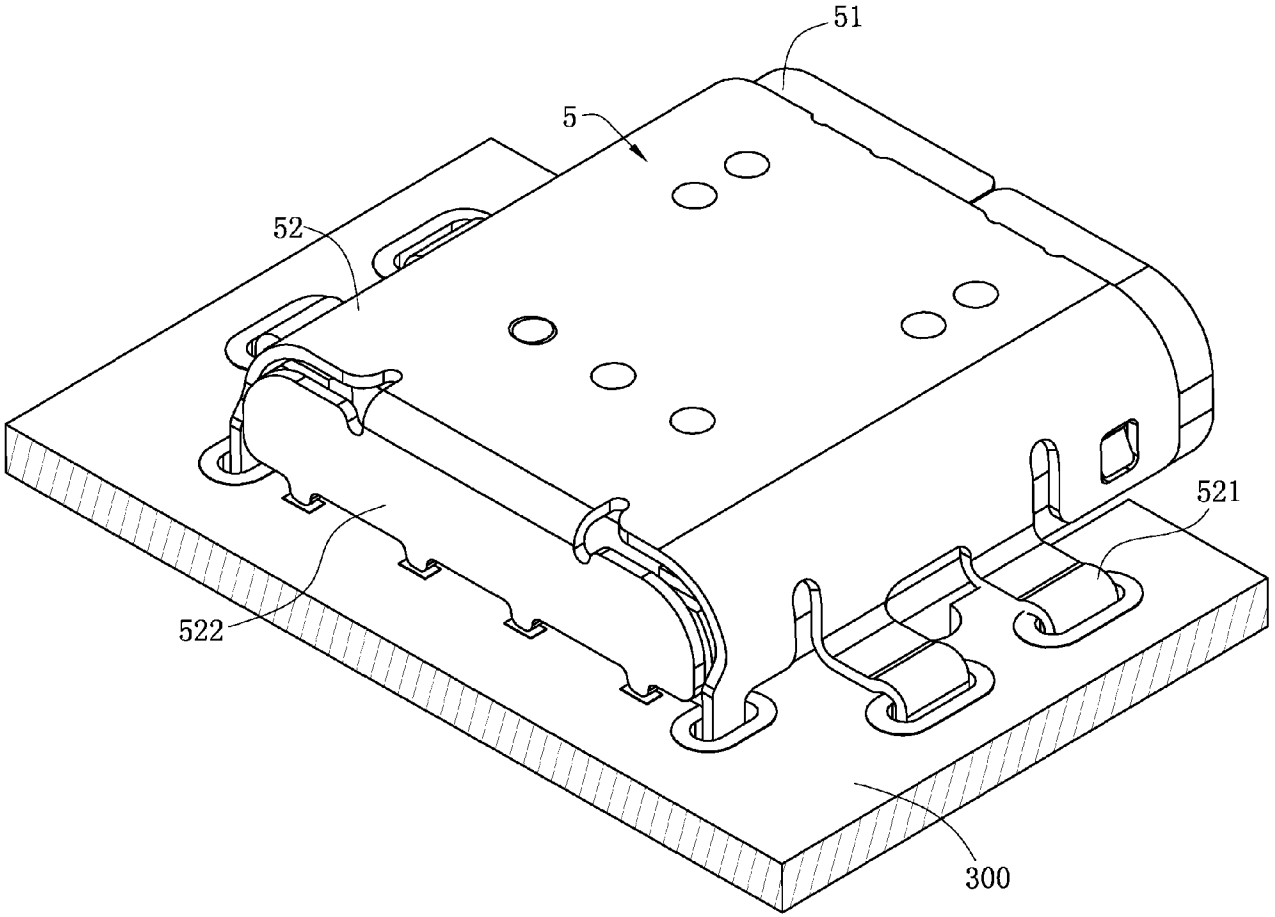
FIG. 28 is a three-dimensional assembly view of an electrical connector mounted on a circuit board according to a ninth embodiment of the present invention.
Figure 29:
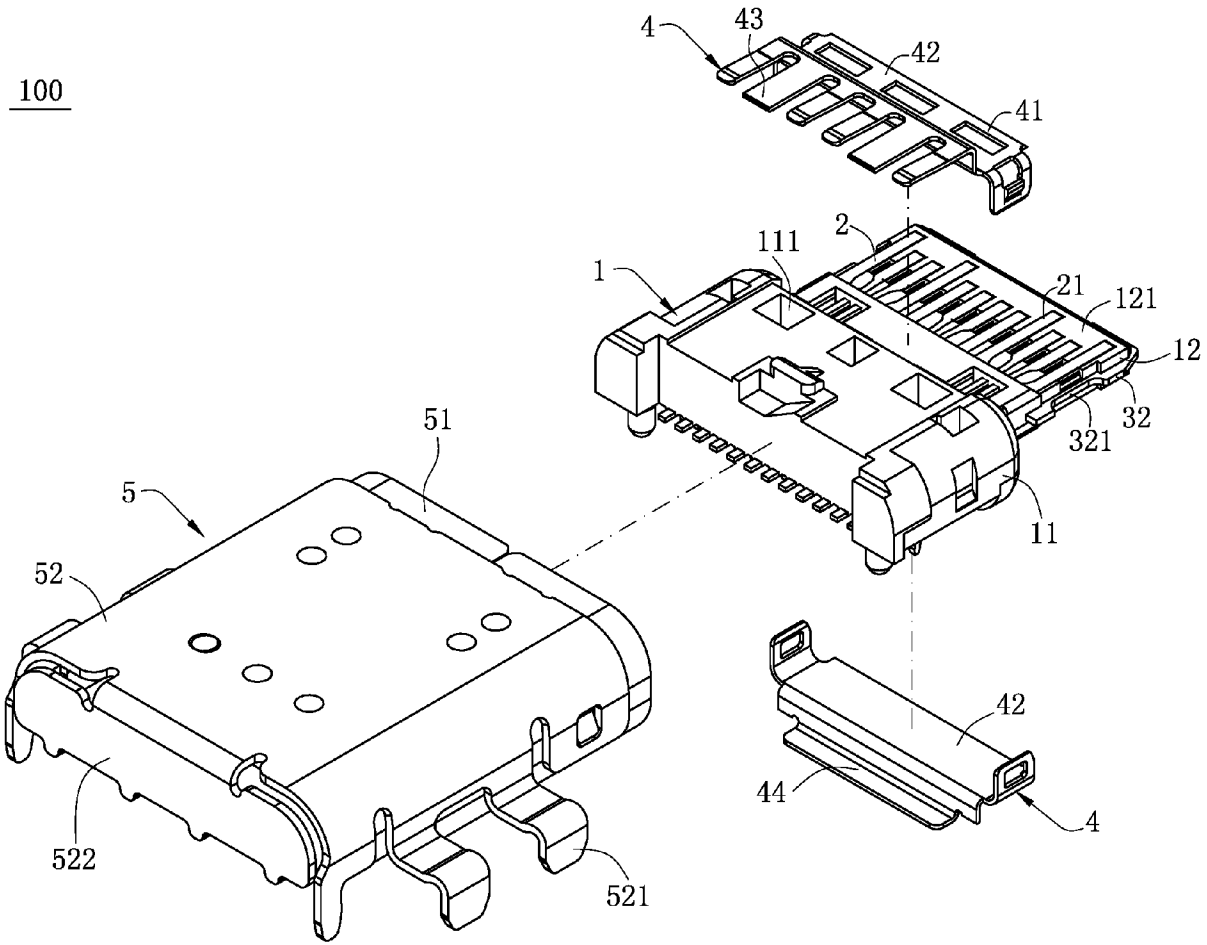
FIG. 29 is a three-dimensional exploded view of the electrical connector according to the ninth embodiment of the present invention.
Figure 30:
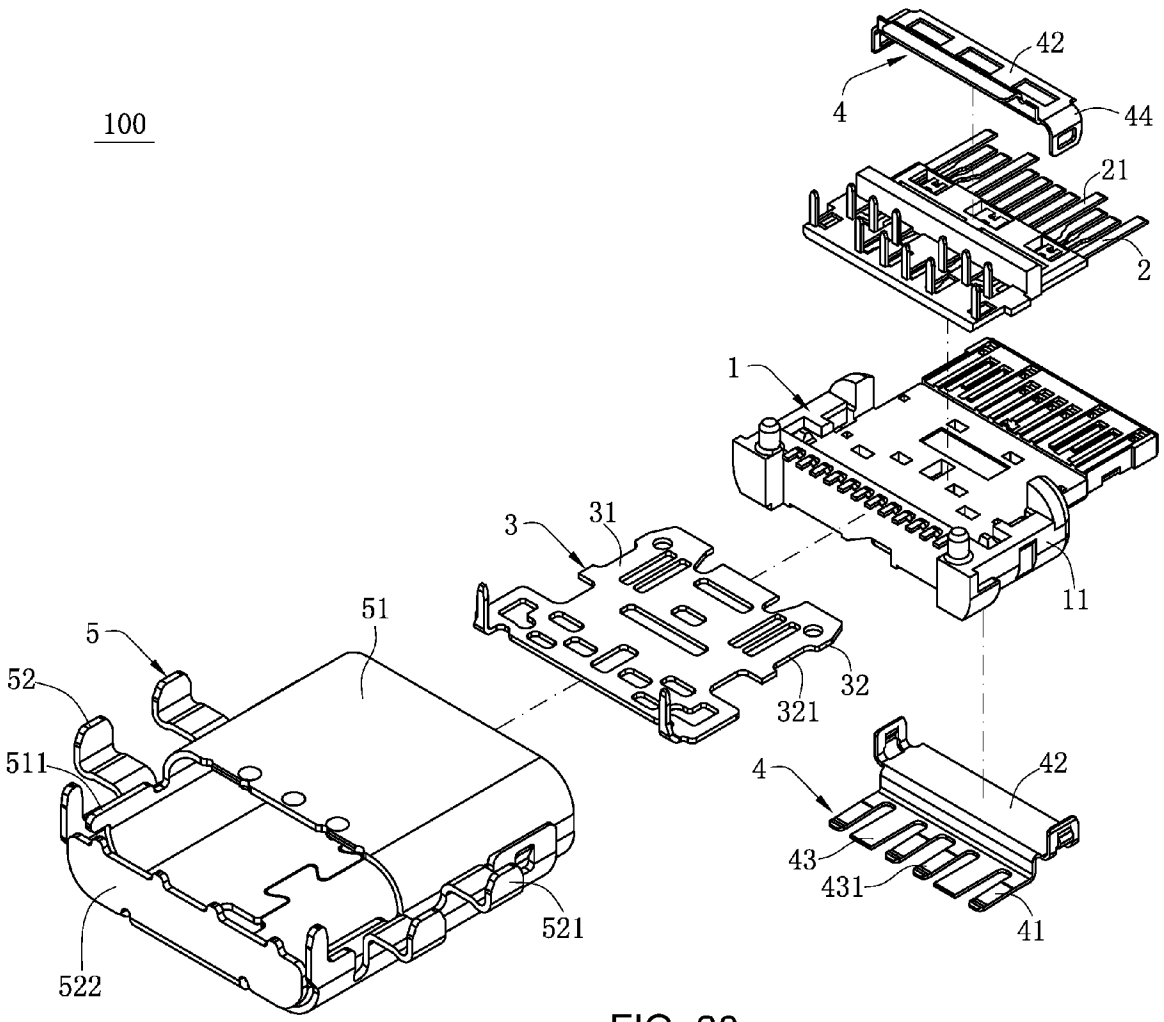
FIG. 30 is a three-dimensional exploded view of the electrical connector viewed from another viewing angle according to the ninth embodiment of the present invention.

As shown in FIG. 21 and FIG. 22, the electrical connector 100 is of a sinking board type, and the tongue 12 and the terminals 2 are all located above the circuit board 300.

Figure 31:
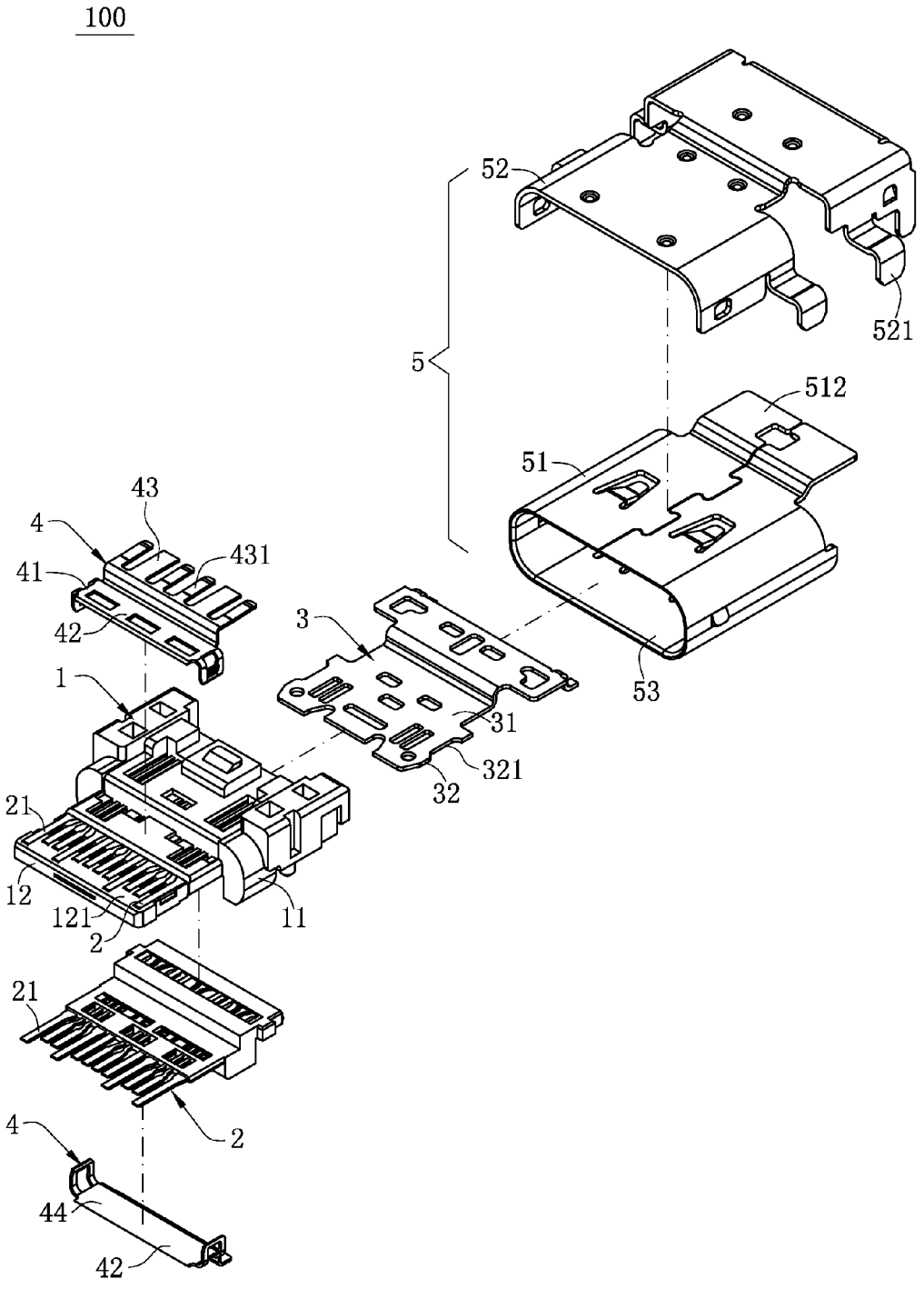
FIG. 31 is a three-dimensional exploded view of an electrical connector according to a tenth embodiment of the present invention.
Figure 32:
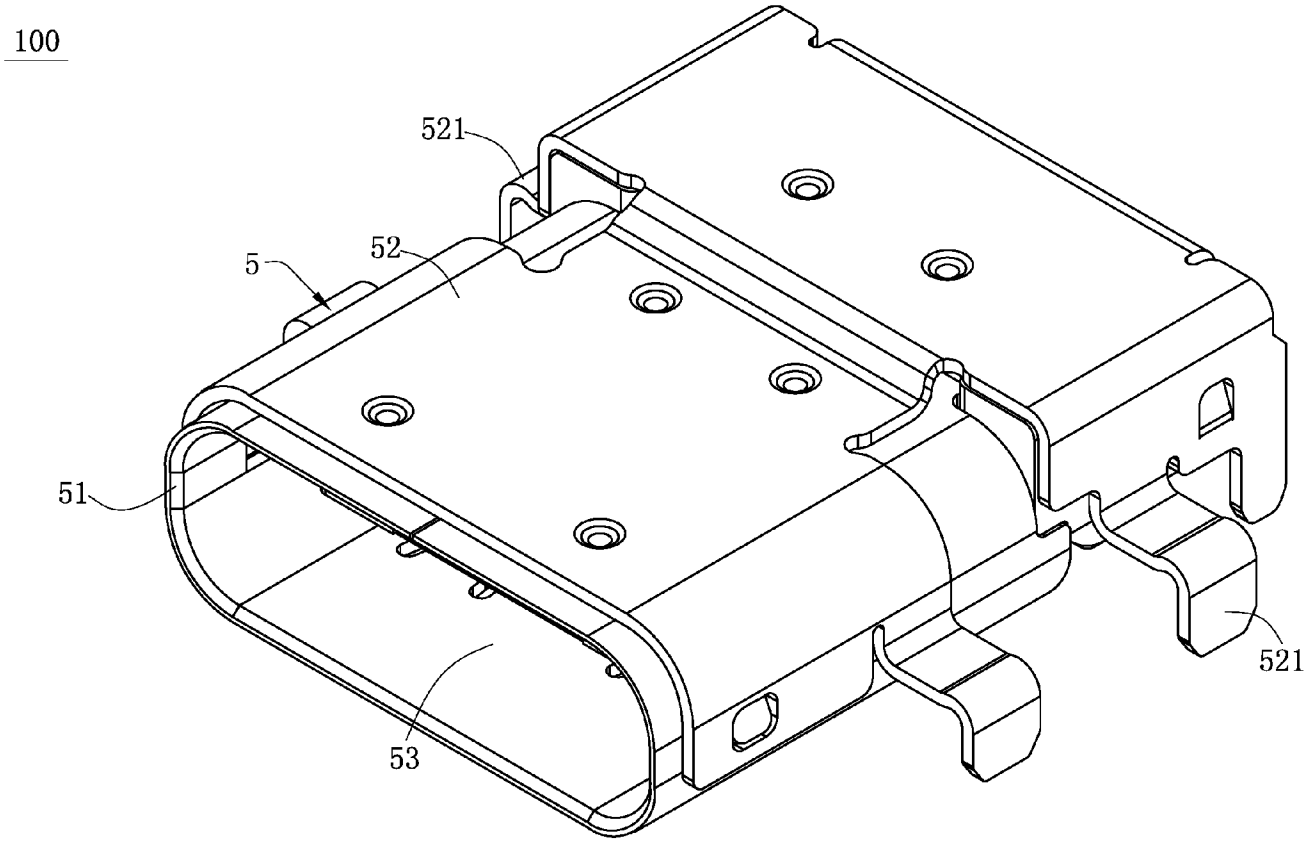
FIG. 32 is a three-dimensional assembly view of the electrical connector according to the tenth embodiment of the present invention.
Figure 33:
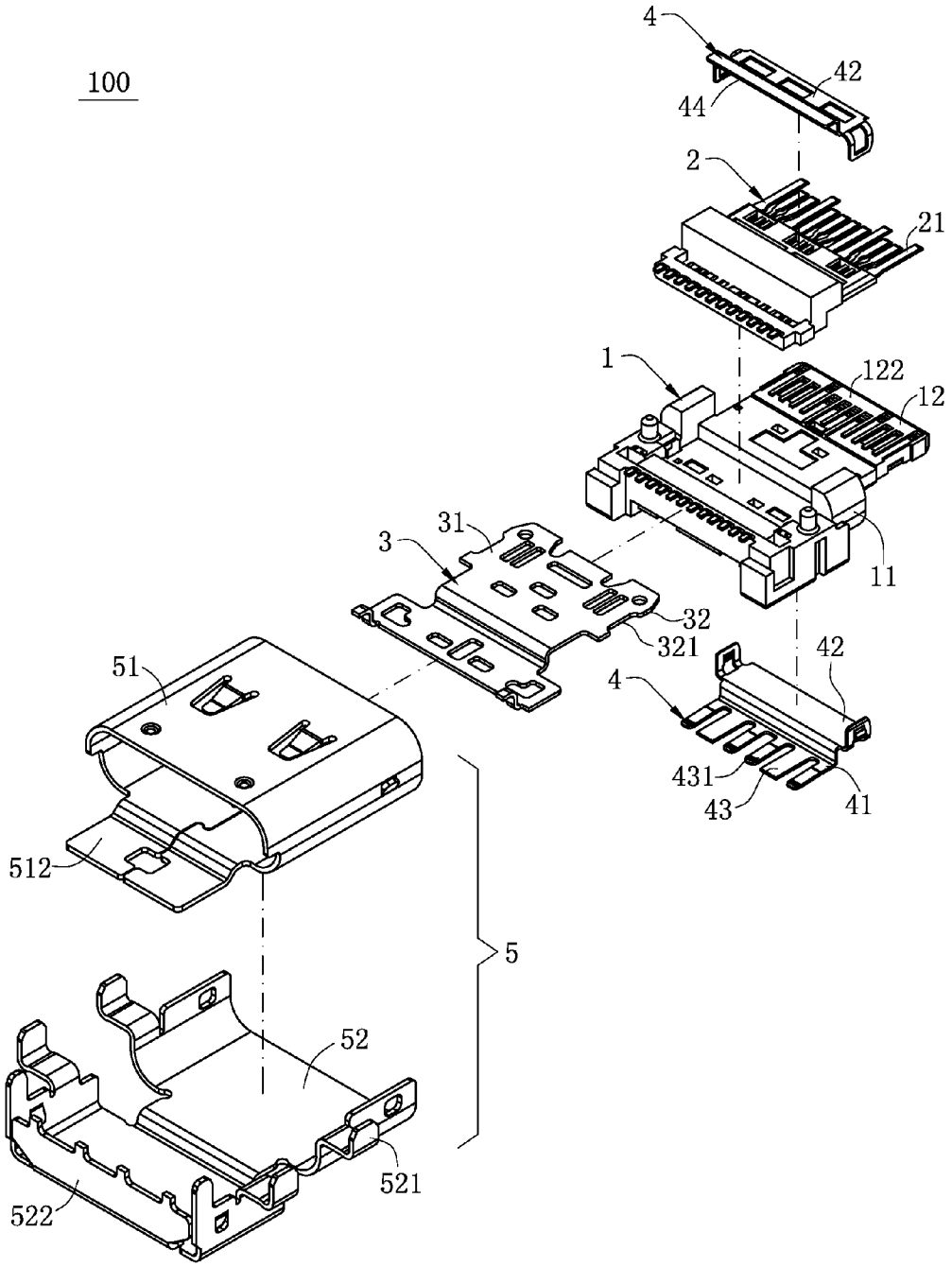
FIG. 33 is a three-dimensional exploded view of the electrical connector viewed from another viewing angle according to the tenth embodiment of the present invention.
Figure 34:
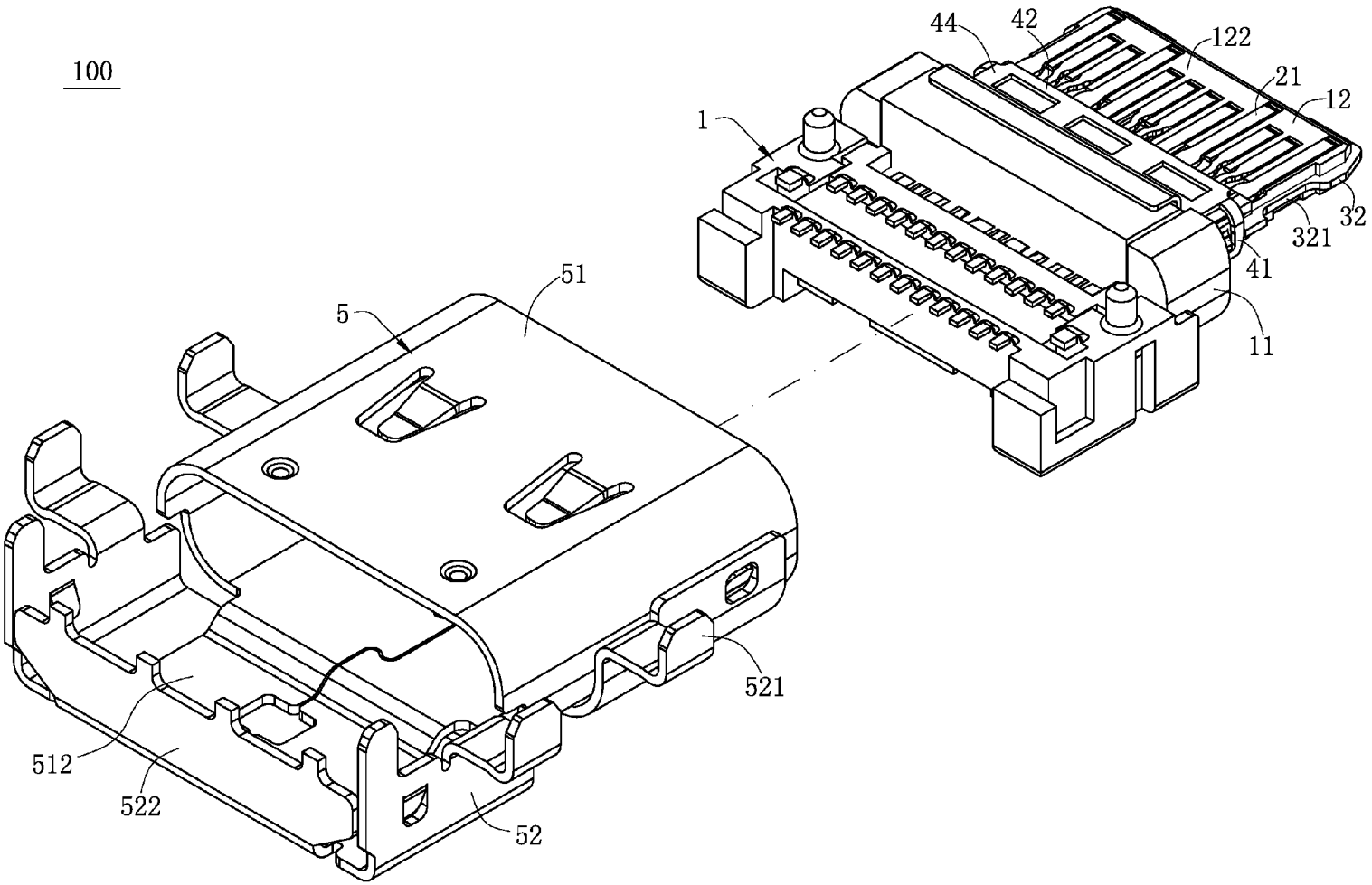
FIG. 34 is a partial three-dimensional exploded view of the electrical connector according to the tenth embodiment of the present invention.
Figure 35:
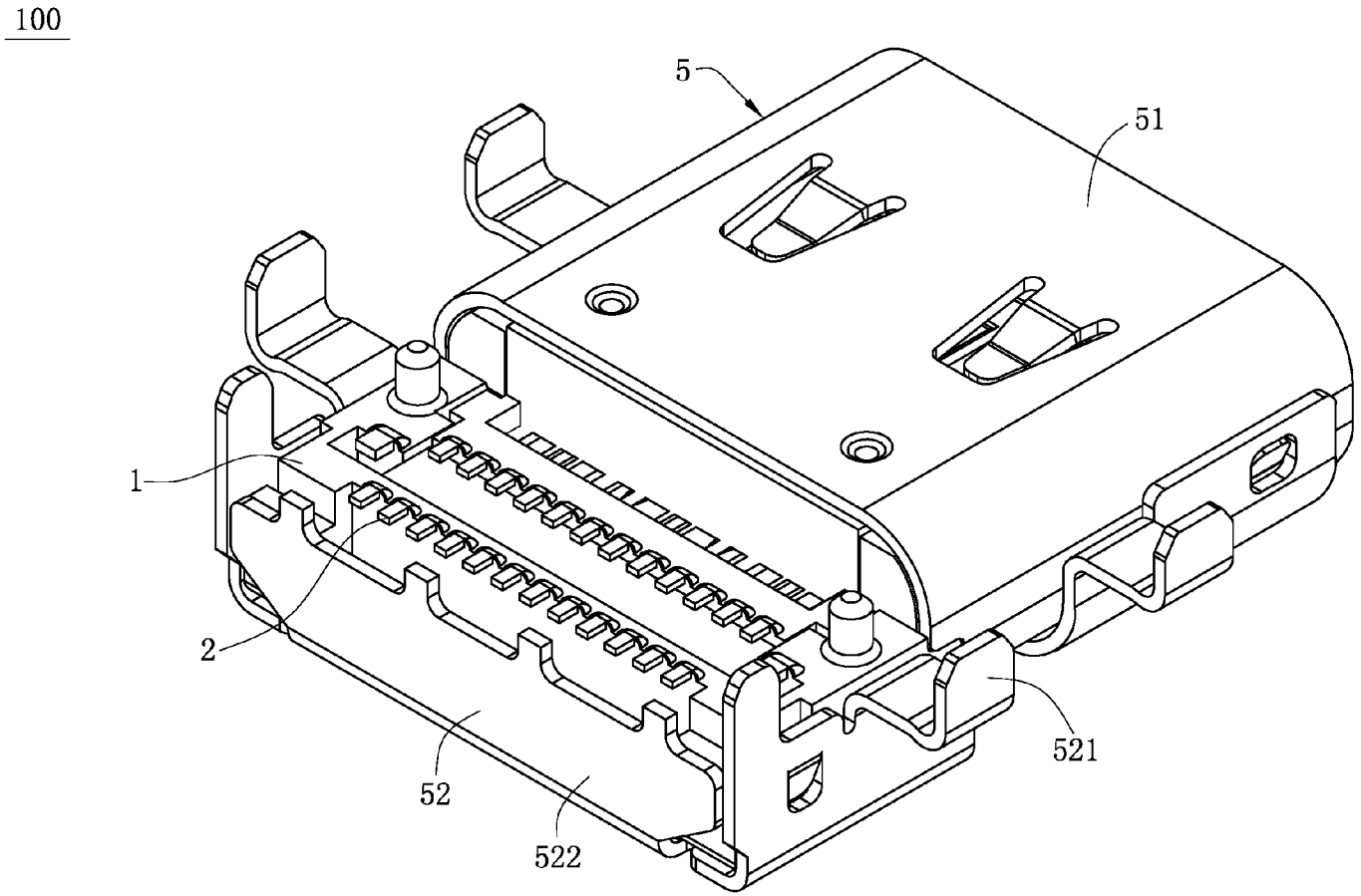
FIG. 35 is a three-dimensional assembly view of the electrical connector viewed from another viewing angle according to the tenth embodiment of the present invention.
Figure 36:
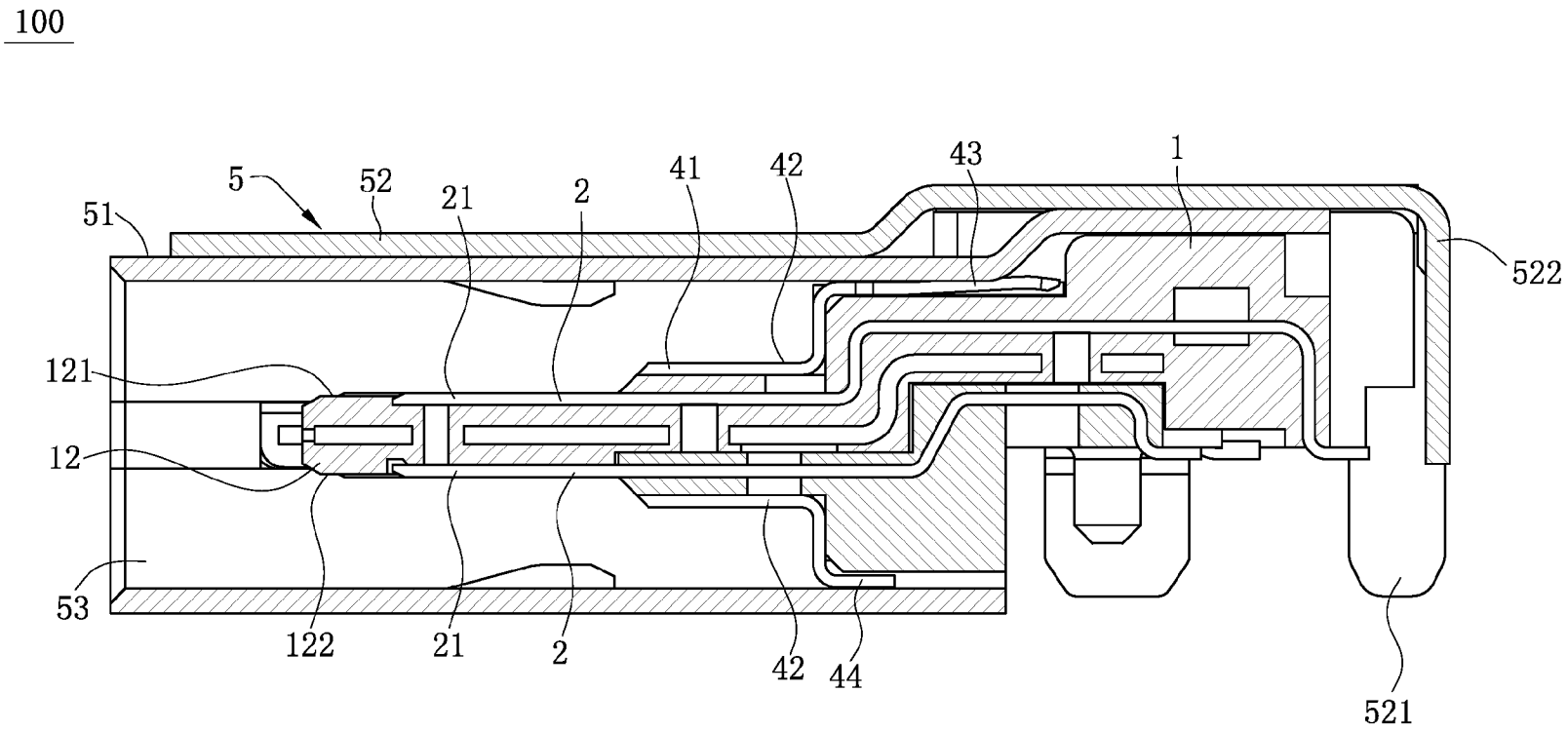
FIG. 36 is a sectional view of the electrical connector according to the tenth embodiment of the present invention.
Figure 37:
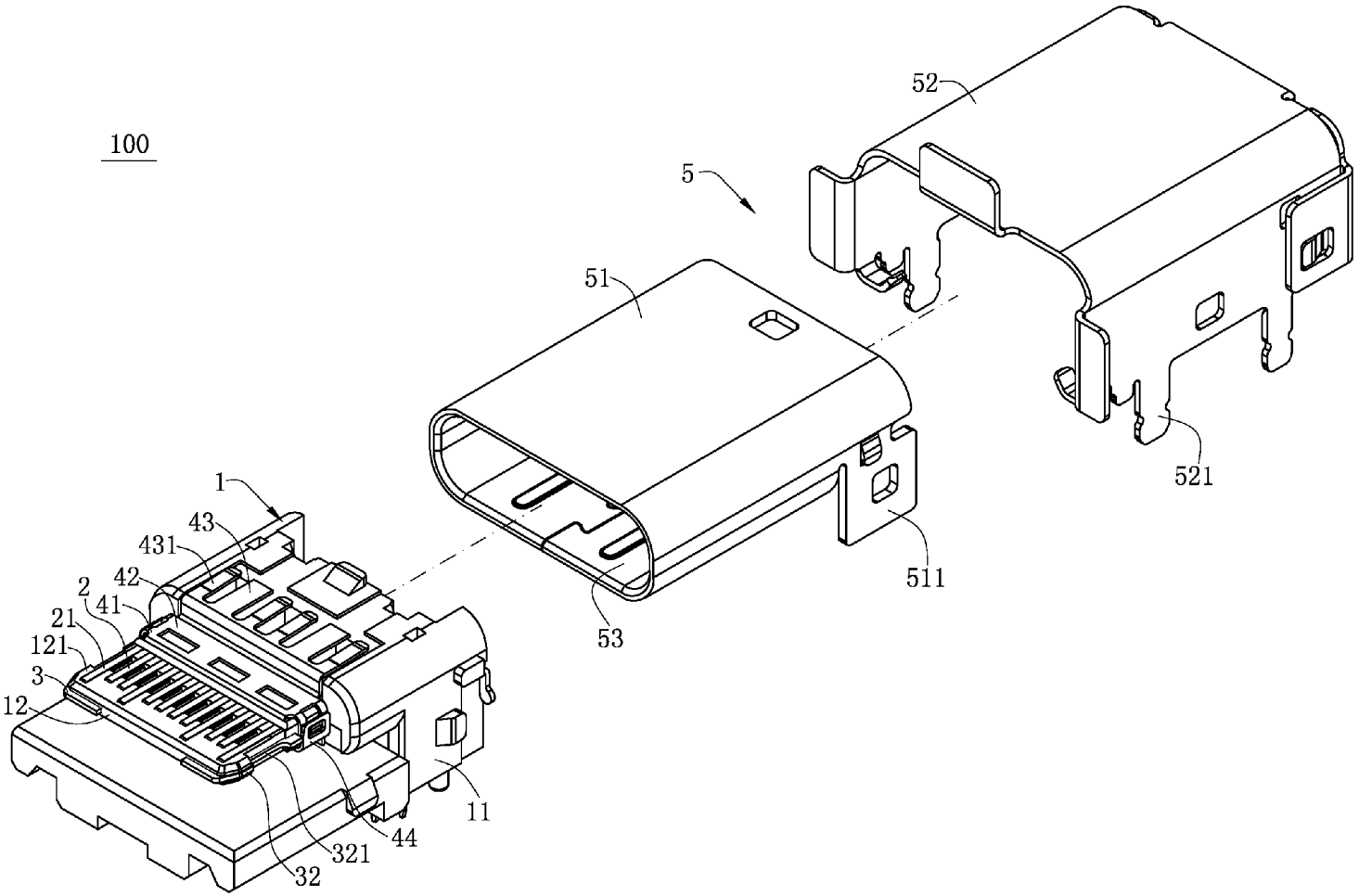
FIG. 37 is a partial three-dimensional exploded view of an electrical connector according to an eleventh embodiment of the present invention.
Figure 38:
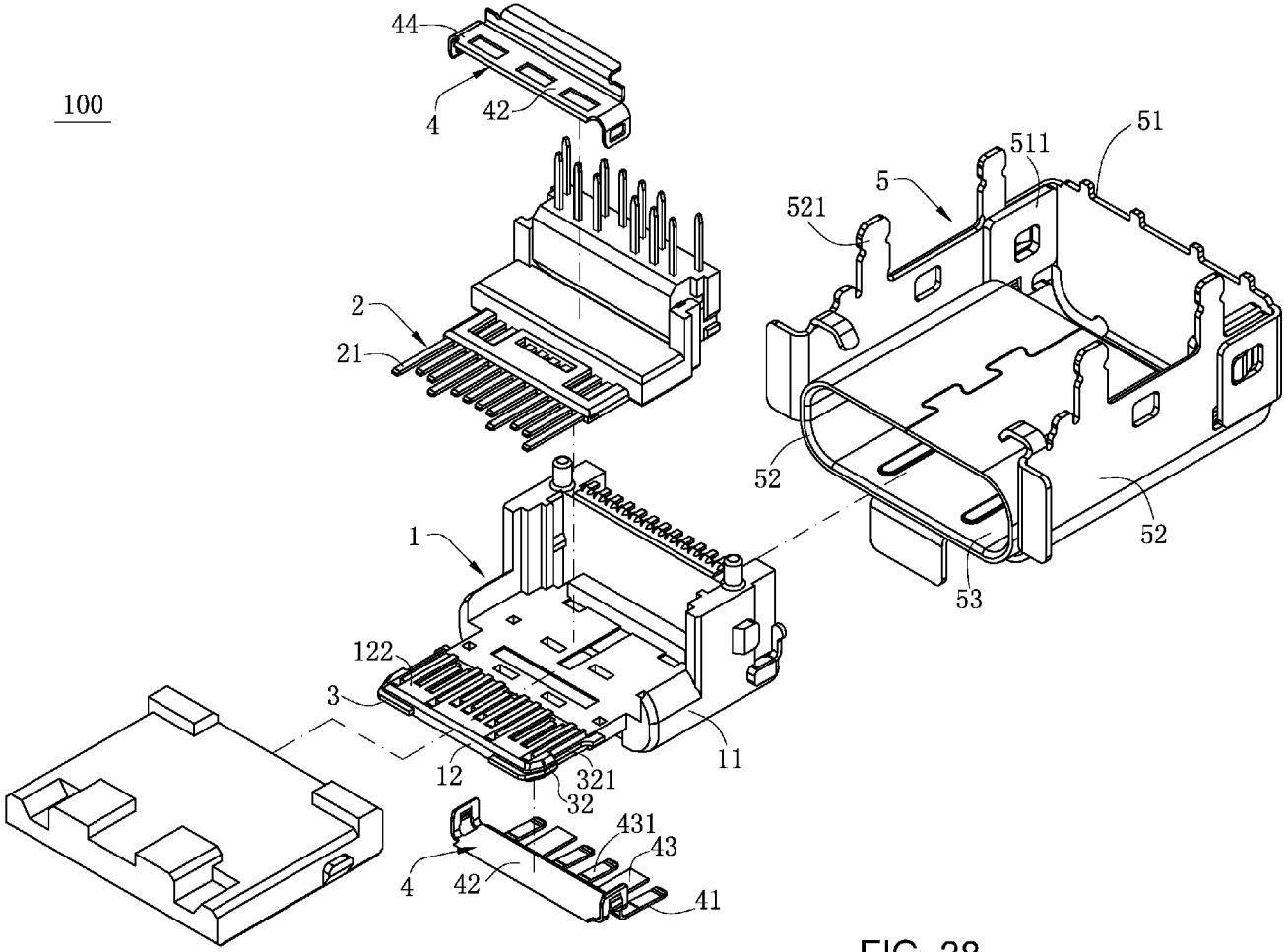
FIG. 38 is a three-dimensional exploded view of the electrical connector according to the eleventh embodiment of the present invention.
Figure 39:
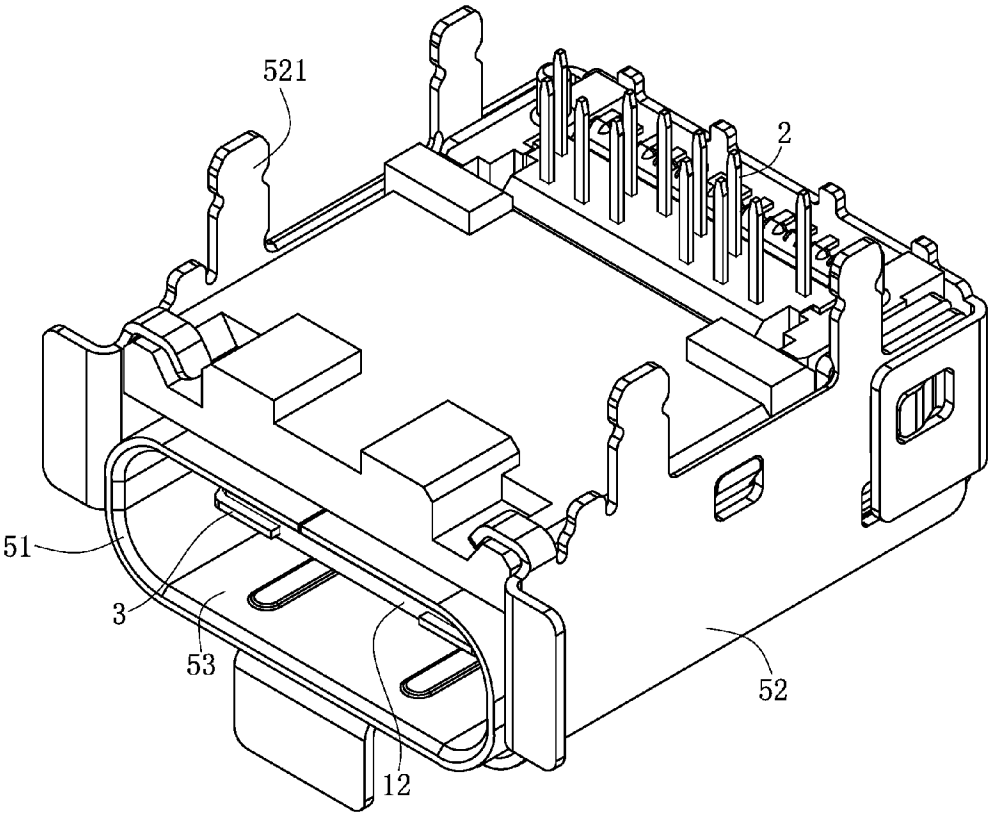
FIG. 39 is a three-dimensional assembly view of the electrical connector according to the eleventh embodiment of the present invention.
Figure 40:
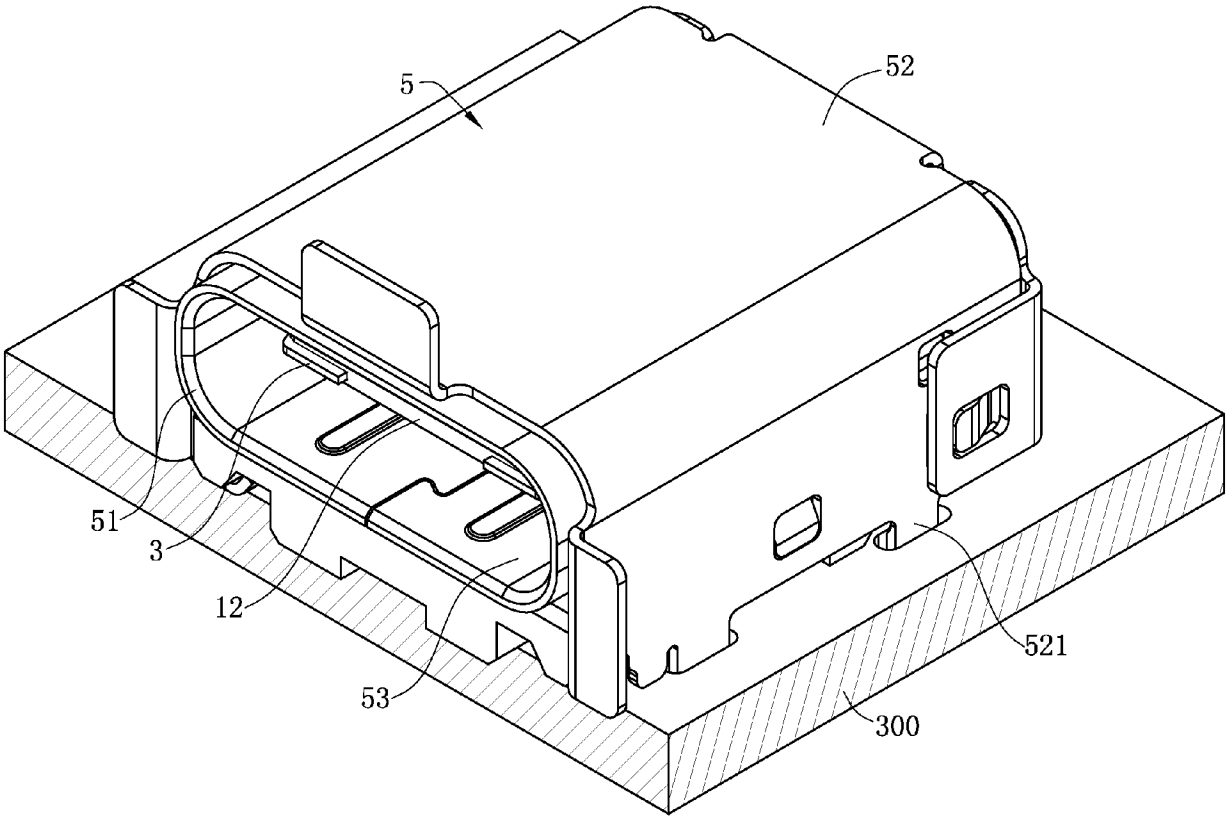
FIG. 40 is a three-dimensional assembly view of the electrical connector mounted on a circuit board according to the eleventh embodiment of the present invention.
Figure 41:
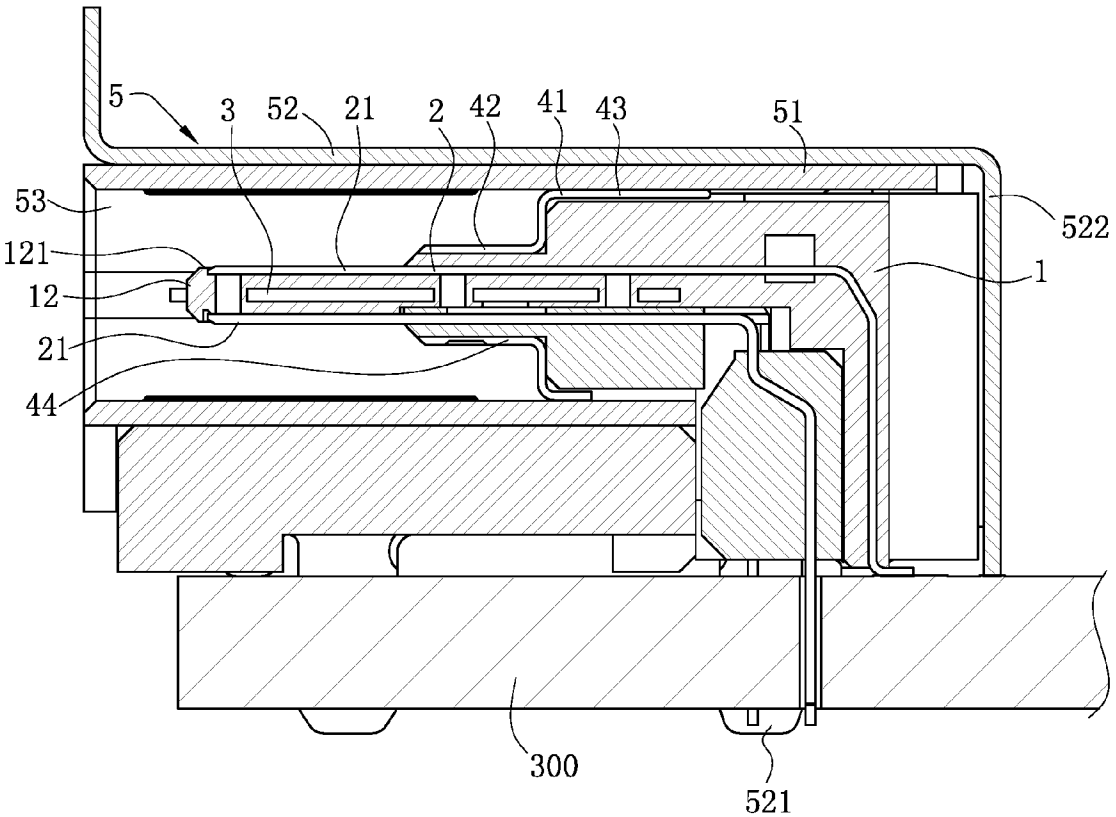
FIG. 41 is a sectional view of the electrical connector mounted on the circuit board according to the eleventh embodiment of the present invention.
Figure 42:
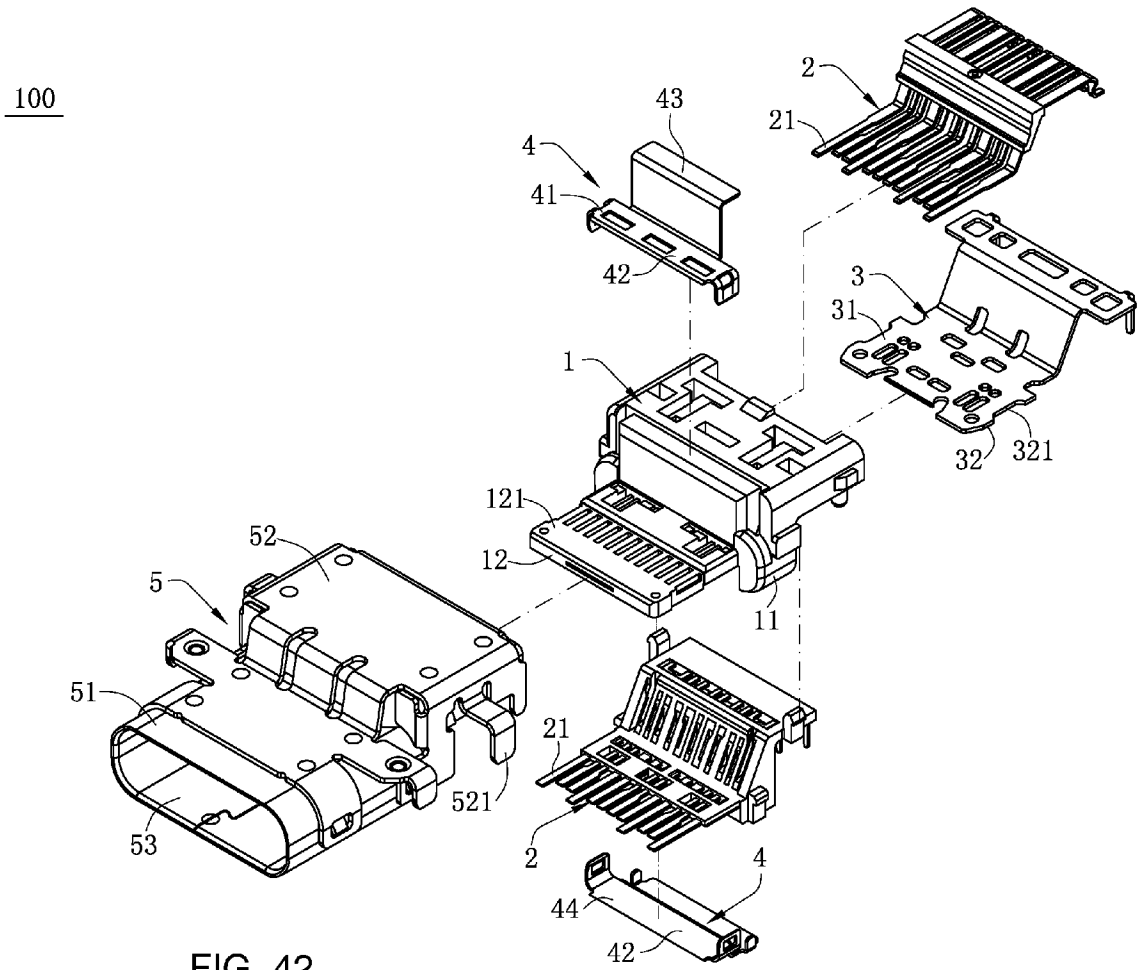
FIG. 42 is a three-dimensional exploded view of an electrical connector according to a twelfth embodiment of the present invention.
Figure 43:
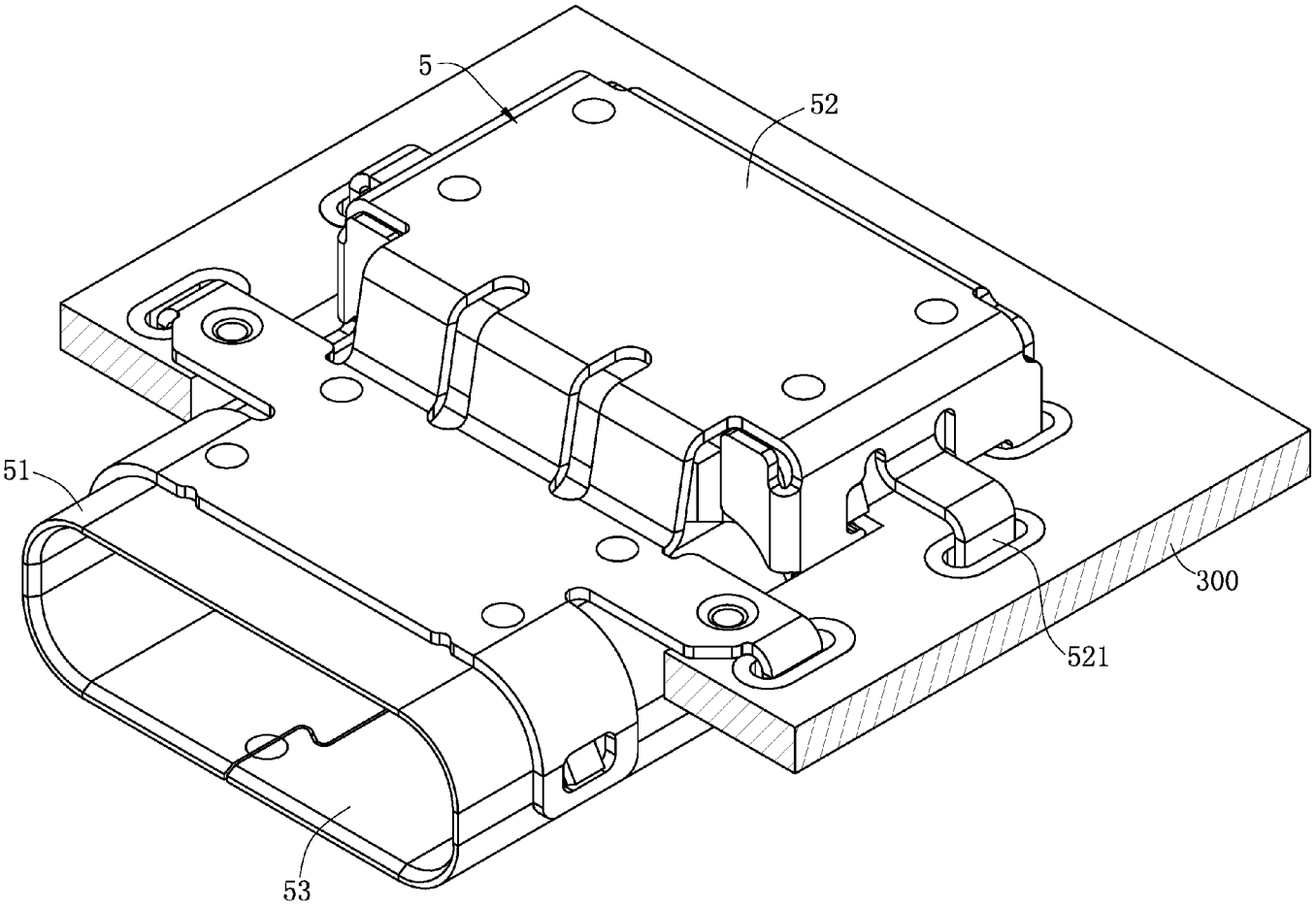
FIG. 43 is a three-dimensional assembly view of the electrical connector mounted on a circuit board according to the twelfth embodiment of the present invention.
Figure 44:
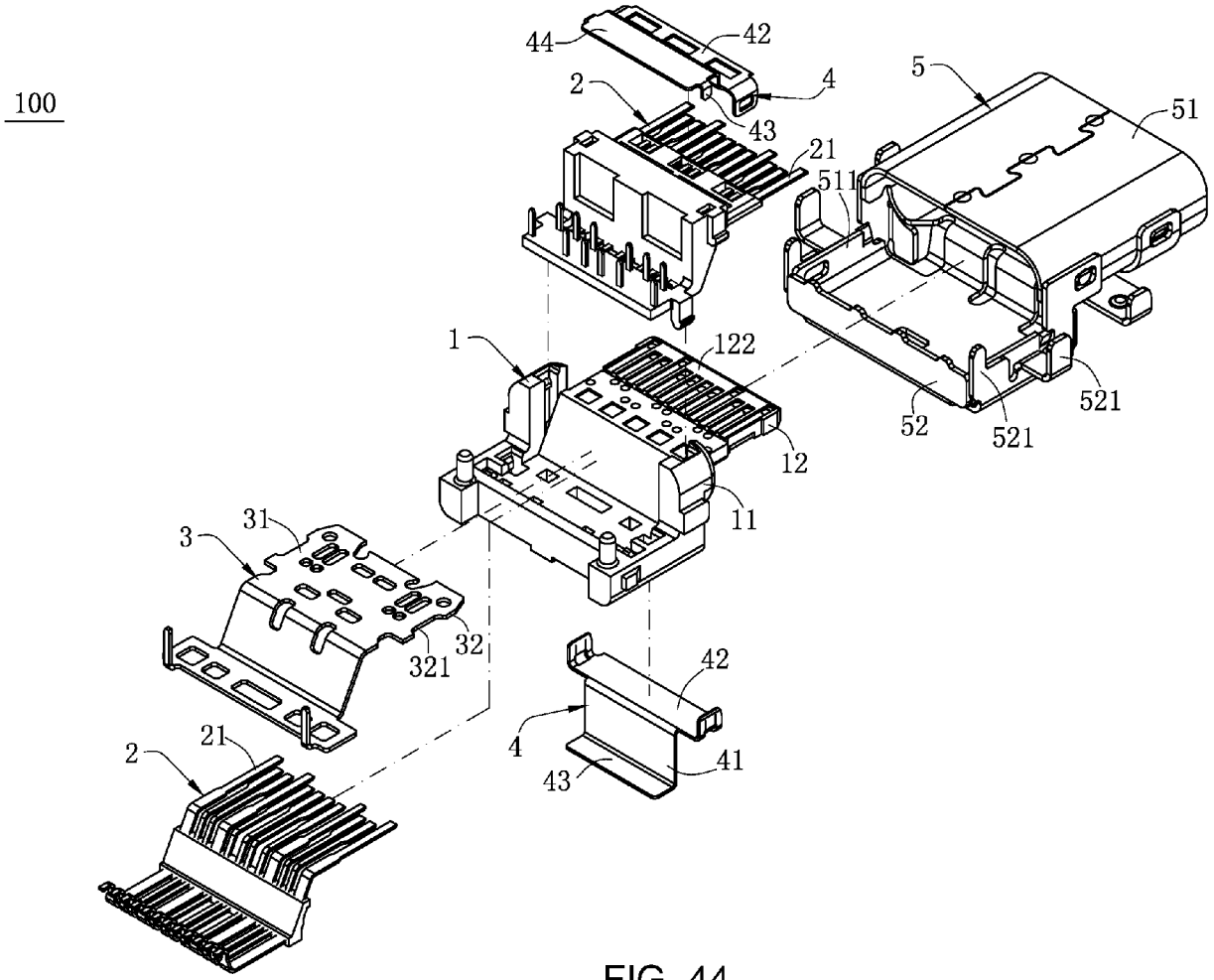
FIG. 44 is a three-dimensional exploded view of the electrical connector viewed from another viewing angle according to the twelfth embodiment of the present invention.
Figure 45:
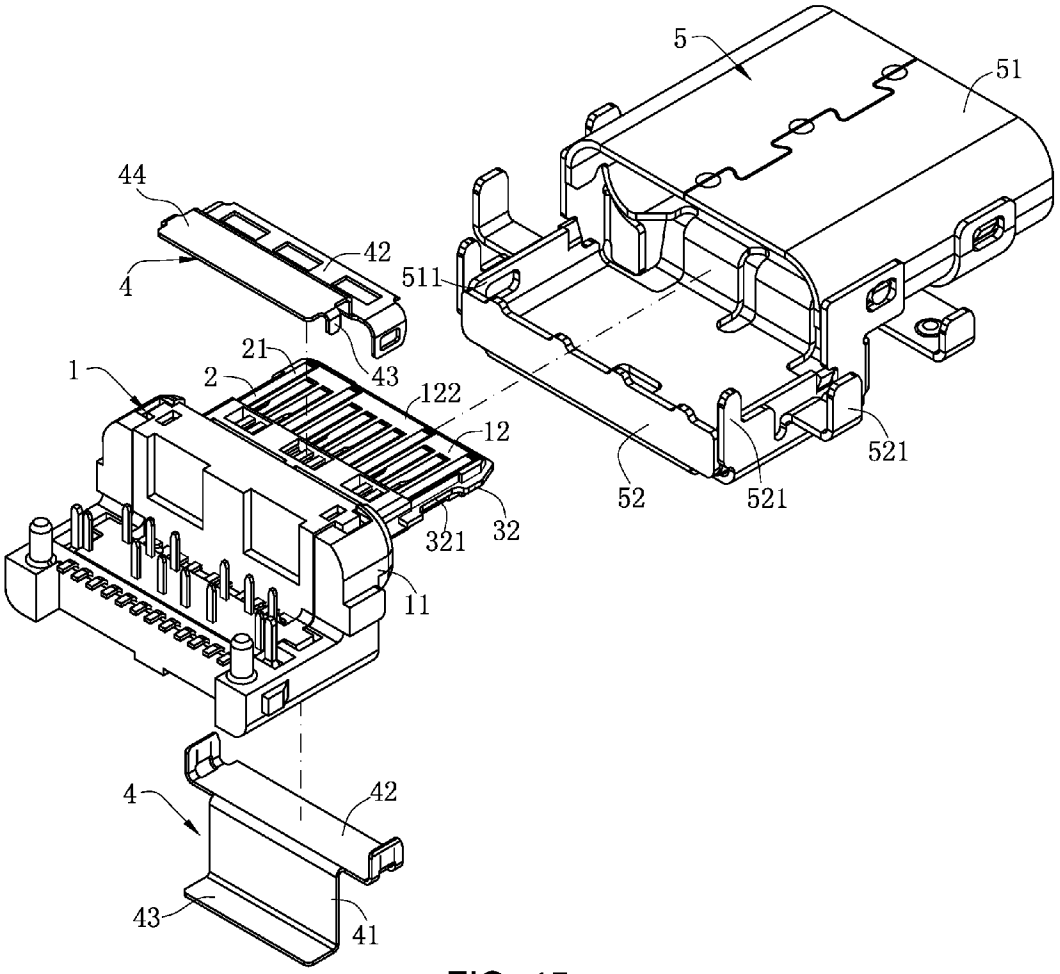
FIG. 45 is a partial three-dimensional exploded view of the electrical connector viewed from another viewing angle according to the twelfth embodiment of the present invention.
Figure 46:
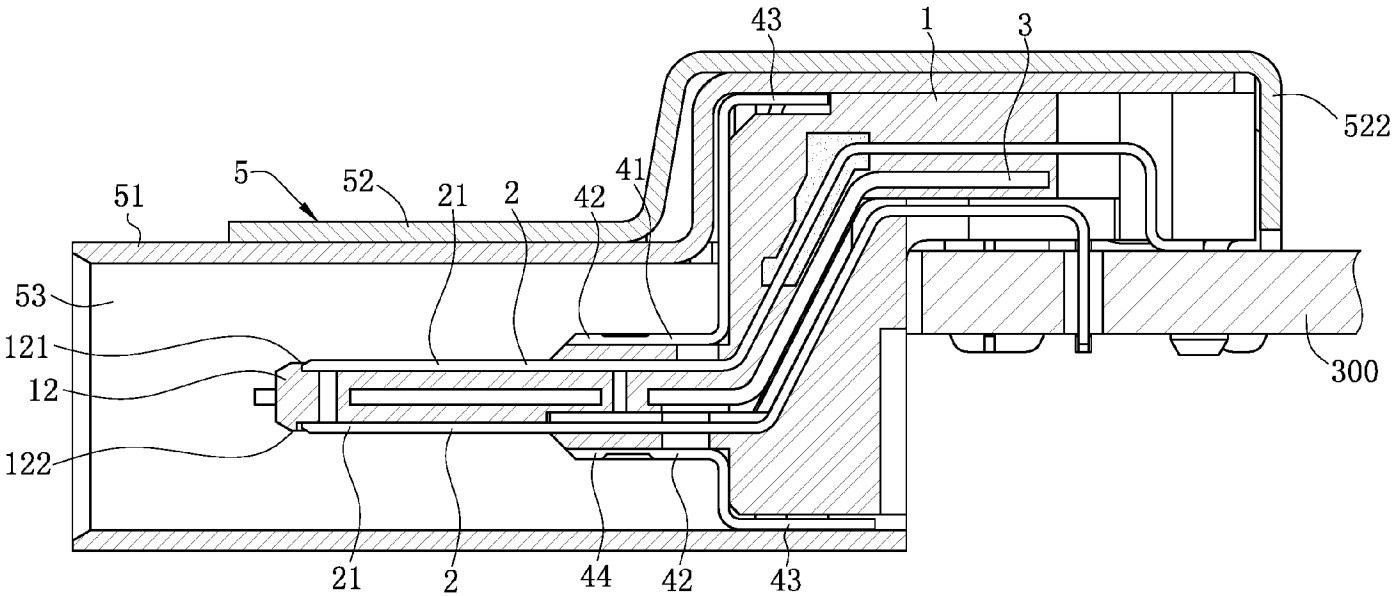
FIG. 46 is a sectional view of the electrical connector according to the twelfth embodiment of the present invention.
Figure 47:
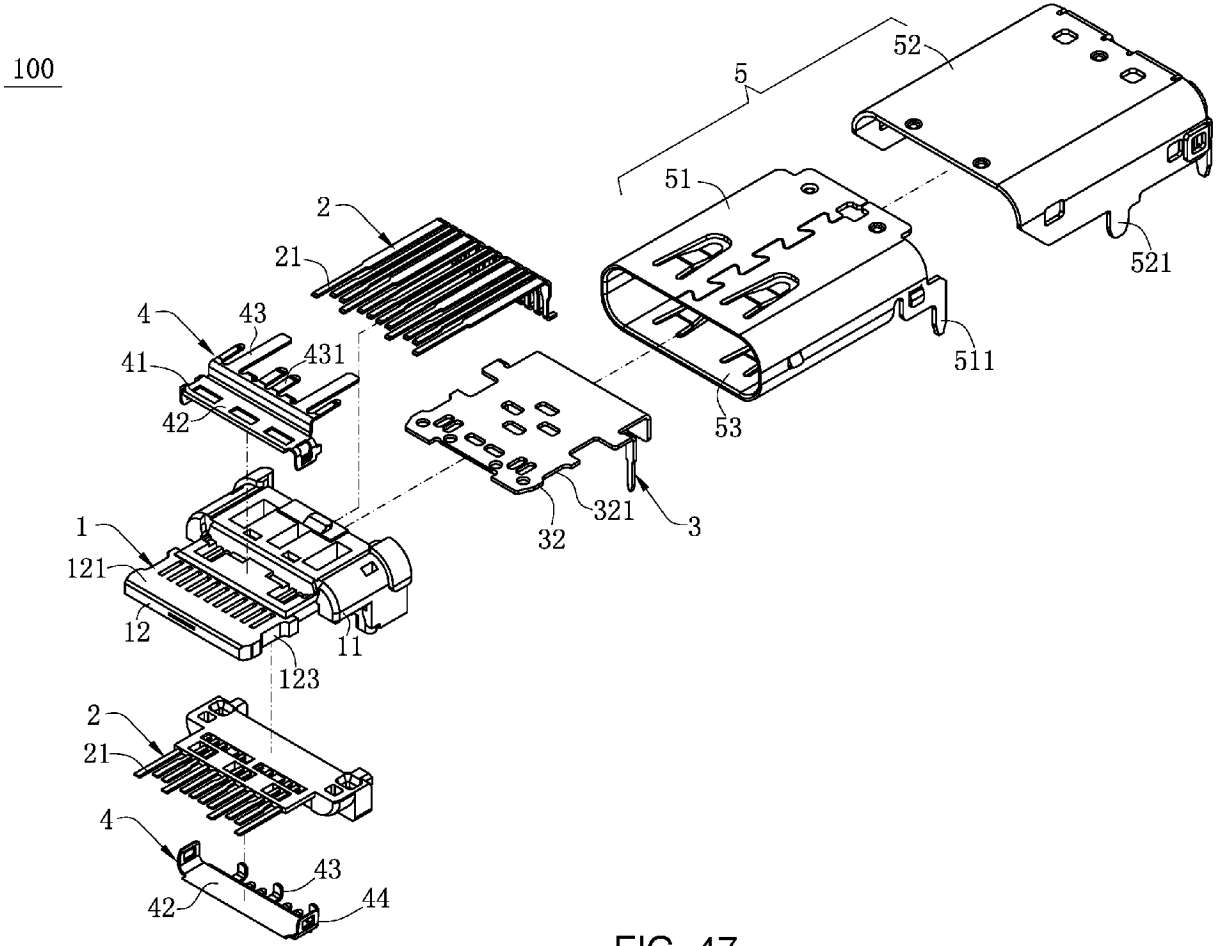
FIG. 47 is a three-dimensional exploded view of an electrical connector according to a thirteenth embodiment of the present invention.

As shown in FIG. 31 and FIG. 36, the electrical connector 100 is also of a sinking board type, and a part of the tongue 12 and the lower row of terminals 2 are lower than the circuit board 300. A height difference is formed between the front segment and the rear segment of the shielding casing 52, the second soldering pins 521 are four in number, and are separately disposed at two sides of the shielding casing 52, and each of the front segment and the rear segment of the shielding casing 52 is provided with two second soldering pins. The sinking board is low, and structures of the electrical connector 100 fixed onto the circuit board 300 are less than those in the on-board type. Therefore, in order to improve the strength, welding is performed between the wrapping casing 51 and the shielding casing 52 by means of point welding, so as to further firmly fix the wrapping casing 51 and the shielding casing 52. Disposition of the four second soldering pins 521 also further ensures that the electrical connector 100 is stably welded to the circuit board 300.

As shown in FIG. 37 to FIG. 41, the electrical connector 100 is used in a desktop host. Because of disposition of external interfaces, the center of the electrical connector 100 is at a long distance from the upper surface of the circuit board 300, and the welding portions of the multiple terminals 2 need to be designed to be very long, and correspondingly, the first soldering pins 511 and the second soldering pins 521 also need to be designed to be very long, so that it can be satisfied that the electrical connector 100 is highly disposed on the upper surface of the circuit board 300. In order that the electrical connector 100 is stably mounted onto the circuit board 300, and the electrical connector 100 is not slanted when the mating connector 200 is inserted into the electrical connector 100, a heightening block is added between the electrical connector 100 and the circuit board 300, and the heightening block is used for supporting the electrical connector 100.

As shown in FIG. 42 to FIG. 46, the electrical connector 100 is also of a sinking board type, and the tongue 12 and the terminals 2 are all located below the circuit board 300.

In summary, the electrical connector 100 and the electrical connector assembly of the present invention have the following beneficial effects:

(1) The upper shielding sheet 41 has the extending portion 43 covering the base portion 11, so as to increase the coverage range of the inner metal casing 4, and can, when the electrical connector 100 performs high-speed signal transmission, more effectively prevent the electromagnetic radiation in the insertion space 53 from being leaked backward which interferes with the tail of the terminals 2 to cause crosstalk, thereby improving the signal transmission quality of the electrical connector 100.

(2) The middle shielding sheet 3 has the two protruding portions 32 exposed from the two sides of the tongue 12, and the groove 321 is disposed at the protruding portion 32. Because both the middle shielding sheet 3 and the metal elastic sheet 8 are made of a metal material, when the mating connector 200 enters the insertion space 53, the metal elastic sheet 8 and the groove 321 are snap-fit and fixed, which not only can implement stable buckling of the mating connector 200 and the electrical connector 100, but also can prevent the abrasion problem.

Additionally, the protruding portion 32 and the groove 321 extend out of the two sides of the tongue 12 and are located in the insertion space 53, which helps the mating connector 200 enter the insertion space 53 to snap-fit the groove 321, the snap-fit strength is large, and the mating connector 200 is not easily disengaged.

The above detailed description only describes preferable embodiments of the present invention, and is not intended to limit the patent scope of the present invention, so any equivalent technical changes made by use of the specification of the creation and the content shown in the drawings fall within the patent scope of the present invention.

What is claimed is:

1. An electrical connector for mating with a mating connector, the mating connector having at least two metal elastic sheets, the electrical connector comprising:

an insulation body, having a base portion and a tongue located at a front end of the base portion;

a plurality of terminals fixedly disposed in the base portion in a manner of an upper row and a lower row, wherein each of the terminals has a contact portion exposed from an upper surface or a lower surface of the tongue, and the mating connector and the contact portions are contacted;

a middle shielding sheet, fixedly disposed at the base portion and the tongue, and located between the upper row of terminals and the lower row of terminals;

at least two snap-fit portions disposed at two sides of the middle shielding sheet and exposed from two sides of the tongue, wherein two of the metal elastic sheets buckle the snap-fit portions to stop the metal elastic sheet from being disengaged;

an outer metal casing, wrapping peripheries of the base portion and the tongue; and an inner metal casing, wherein the inner metal casing comprises:

at least one covering portion disposed on an upper surface of the tongue; and at least one extending portion extending from the covering portion toward the base portion, the extending portion having at least one contact arm, and the contact arm urging an inner wall of the outer metal casing.

2. The electrical connector according to claim 1, wherein the extending portion includes two positioning portions, the base portion includes two positioning slots corresponding to the two positioning portions, and the two positioning slots accommodate and fix the two positioning portions.

3. The electrical connector according to claim 1, wherein the upper row of terminals comprises two grounding terminals, two power supply terminals and two signal terminals, the lower row terminals comprises two grounding terminals, two power supply terminals and two signal terminals, and the upper row of terminals and the lower row of terminals are disposed symmetrically on the upper surface and the lower surface of the tongue respectively.

4. The electrical connector according to claim 1, wherein the outer metal casing comprises a wrapping casing and a shielding casing, the wrapping casing wraps the peripheries of the base portion and the tongue, the shielding casing is disposed out of the wrapping casing, each of two sides of the wrapping casing has a first soldering pin, each of two sides of the shielding casing has a second soldering pin, the first soldering pins and the second soldering pins are staggered front and back, the first soldering pins are close to a lateral side of the base portion, and the second soldering pins are close to a lateral side of the tongue.

5. The electrical connector according to claim 4, wherein the wrapping casing has a first rear wall, the shielding casing has a second rear wall, the first rear wall includes a first middle portion and first sheltering portions located at two sides of the first middle portion, the second rear wall includes a second middle portion and a second sheltering portion connected to a lower part of the second middle portion, the first middle portion and the second middle portion are approximately superposed front and back, the second rear wall forms a notch at a place corresponding to the first sheltering portion, and the second sheltering portion exceeds the first middle portion downward.

6. An electrical connector for mating with a mating connector, the mating connector having at least two metal elastic sheets, the electrical connector comprising:

an insulation body, having a base portion and a tongue located at a front end of the base portion;

a plurality of terminals fixedly disposed in the base portion in a manner of an upper row and a lower row, wherein each of the terminals has a contact portion exposed from an upper surface or a lower surface of the tongue, and the mating connector and the contact portions are contacted;

a middle shielding sheet, fixedly disposed at the base portion and the tongue, and located between the upper row of terminals and the lower row of terminals;

at least two snap-fit portions disposed at two sides of the middle shielding sheet and exposed from two sides of the tongue, wherein two of the metal elastic sheets buckle the snap-fit portions to stop the metal elastic sheet from being disengaged; and an outer metal casing, wrapping peripheries of the base portion and the tongue;

wherein the middle shielding sheet has a plate portion fixedly disposed in the tongue, two protruding portions extend respectively from two sides of the plate portion out of the two sides of the tongue, two of the snap-fit portions are grooves disposed at the two protruding portions, and the two grooves are exposed from the two sides of the tongue.

7. The electrical connector according to claim 6, further comprising an inner metal casing, wherein the inner metal casing comprises:

at least one covering portion disposed on an upper surface of the tongue; and at least one extending portion extending from the covering portion toward the base portion, the extending portion having at least one contact arm, and the contact arm urging an inner wall of the outer metal casing.

8. The electrical connector according to claim 7, wherein the extending portion includes two positioning portions, the base portion includes two positioning slots corresponding to the two positioning portions, and the two positioning slots accommodate and fix the two positioning portions.

9. The electrical connector according to claim 6, wherein the upper row of terminals comprises two grounding terminals, two power supply terminals and two signal terminals, the lower row terminals comprises two grounding terminals, two power supply terminals and two signal terminals, and the upper row of terminals and the lower row of terminals are disposed symmetrically on the upper surface and the lower surface of the tongue respectively.

10. The electrical connector according to claim 6, wherein the outer metal casing comprises a wrapping casing and a shielding casing, the wrapping casing wraps the peripheries of the base portion and the tongue, the shielding casing is disposed out of the wrapping casing, each of two sides of the wrapping casing has a first soldering pin, each of two sides of the shielding casing has a second soldering pin, the first soldering pins and the second soldering pins are staggered front and back, the first soldering pins are close to a lateral side of the base portion, and the second soldering pins are close to a lateral side of the tongue.

11. The electrical connector according to claim 10, wherein the wrapping casing has a first rear wall, the shielding casing has a second rear wall, the first rear wall includes a first middle portion and first sheltering portions located at two sides of the first middle portion, the second rear wall includes a second middle portion and a second sheltering portion connected to a lower part of the second middle portion, the first middle portion and the second middle portion are approximately superposed front and back, the second rear wall forms a notch at a place corresponding to the first sheltering portion, and the second sheltering portion exceeds the first middle portion downward.

12. An electrical connector assembly, comprising:

an electrical connector, comprising:

an insulation body, wherein the insulation body has a base portion and a tongue located at a front end of the base portion, a plurality of terminals are fixedly disposed in the base portion in a manner of an upper row and a lower row, and each of the terminals has a contact portion exposed from an upper surface or a lower surface of the tongue;

a middle shielding sheet, fixedly disposed at the base portion and the tongue, and located between the upper row of terminals and the lower row of terminals;

at least two snap-fit portions disposed at two sides of the middle shielding sheet and exposed from two sides of the tongue; and an outer metal casing wrapping peripheries of the base portion and the tongue, wherein two of the metal elastic sheets buckle the snap-fit portions to stop the metal elastic sheet from being disengaged; and a mating connector, having two metal elastic sheets corresponding to two of the snap-fit portions, wherein when the mating connector and the electrical connector are mated, the two metal elastic sheets are respectively cooperatively fixed to two of the snap-fit portions, and the mating connector and the contact portion are contacted;

wherein the mating connector has a metal cover, the metal cover is formed by means of one-piece drawing or stretching, the metal cover has a front segment and a rear segment connected to each other, the front segment has a top surface and a bottom surface opposite to each other, and two side surfaces connected to the top surface and the bottom surface, a place at which each of the top surface and the bottom surface is connected to the rear segment is provided with a step, and the two side surfaces and the rear segment are in a form of direct extension.

13. The electrical connector according to claim 12, wherein the mating connector comprises an insertion portion, the insertion portion has a mating space, each of two sides of the insertion portion has a hollowing portion in communication with the mating space, the two metal elastic sheets are at least partially located at the two sides of the insertion portion, and pass through the hollowing portion to enter the mating space, and the tongue and the snap-fit portions are located in the mating space.

14. An electrical connector for mating with a mating connector, the mating connector having at least two metal elastic sheets, the electrical connector comprising:

an insulation body, having a base portion and a tongue located at a front end of the base portion;

a plurality of terminals fixedly disposed in the base portion in a manner of an upper row and a lower row, wherein each of the terminals has a contact portion exposed from an upper surface or a lower surface of the tongue, and the mating connector and the contact portions are contacted;

a middle shielding sheet, fixedly disposed at the base portion and the tongue, and located between the upper row of terminals and the lower row of terminals;

at least two snap-fit portions disposed at two sides of the middle shielding sheet and exposed from two sides of the tongue, wherein two of the metal elastic sheets buckle the snap-fit portions to stop the metal elastic sheet from being disengaged; and an outer metal casing, wrapping peripheries of the base portion and the tongue;

wherein the outer metal casing comprises a wrapping casing and a shielding casing, the wrapping casing wraps the peripheries of the base portion and the tongue, the shielding casing is disposed out of the wrapping casing, each of two sides of the wrapping casing has a first soldering pin, each of two sides of the shielding casing has a second soldering pin, the first soldering pins and the second soldering pins are staggered front and back, the first soldering pins are close to a lateral side of the base portion, and the second soldering pins are close to a lateral side of the tongue.

15. The electrical connector according to claim 14, further comprising an inner metal casing, wherein the inner metal casing comprises:

at least one covering portion disposed on an upper surface of the tongue; and at least one extending portion extending from the covering portion toward the base portion, the extending portion having at least one contact arm, and the contact arm urging an inner wall of the outer metal casing;

wherein the extending portion includes two positioning portions, the base portion includes two positioning slots corresponding to the two positioning portions, and the two positioning slots accommodate and fix the two positioning portions.

16. The electrical connector according to claim 14, wherein the upper row of terminals comprises two grounding terminals, two power supply terminals and two signal terminals, the lower row terminals comprises two grounding terminals, two power supply terminals and two signal terminals, and the upper row of terminals and the lower row of terminals are disposed symmetrically on the upper surface and the lower surface of the tongue respectively.

17. The electrical connector according to claim 14, wherein the wrapping casing has a first rear wall, the shielding casing has a second rear wall, the first rear wall includes a first middle portion and first sheltering portions located at two sides of the first middle portion, the second rear wall includes a second middle portion and a second sheltering portion connected to a lower part of the second middle portion, the first middle portion and the second middle portion are approximately superposed front and back, the second rear wall forms a notch at a place corresponding to the first sheltering portion, and the second sheltering portion exceeds the first middle portion downward.

* * * * *